US012270168B2

(12) United States Patent
Favorito et al.

(10) Patent No.: US 12,270,168 B2
(45) Date of Patent: Apr. 8, 2025

(54) AUXILIARY MATERIAL MOVING ASSEMBLY FOR SNOW PLOW-BLOWER OR OTHER MATERIAL MOVING DEVICE

(71) Applicants: Paul Favorito, Morganville, NJ (US); Francesco Marino, Staten Island, NY (US)

(72) Inventors: Paul Favorito, Morganville, NJ (US); Francesco Marino, Staten Island, NY (US)

( * ) Notice: Subject to any disclaimer, the term of this patent is extended or adjusted under 35 U.S.C. 154(b) by 987 days.

(21) Appl. No.: 17/331,950

(22) Filed: May 27, 2021

(65) Prior Publication Data

US 2021/0301486 A1 Sep. 30, 2021

Related U.S. Application Data

(63) Continuation-in-part of application No. 16/798,373, filed on Feb. 23, 2020, now Pat. No. 11,732,430.

(51) Int. Cl.

| | |
|---|---|
| ***E01H 5/07*** | (2006.01) |
| ***E01H 5/06*** | (2006.01) |
| *E01H 5/12* | (2006.01) |

(52) U.S. Cl.

CPC ..... *E01H 5/076* (2013.01); *E01H 5/061* (2013.01); *E01H 5/12* (2013.01)

(58) Field of Classification Search

CPC ..... E01H 5/076; E01H 5/061; E01H 5/12; E01H 5/066; E01H 5/065

See application file for complete search history.

(56) References Cited

U.S. PATENT DOCUMENTS

| | | | |
|---|---|---|---|
| 1,552,714 | A | 4/1925 | Linzy |
| 2,777,218 | A | 10/1952 | Klecker et al. |

(Continued)

FOREIGN PATENT DOCUMENTS

| | | | |
|---|---|---|---|
| CA | 646078 | | 8/1962 |
| CA | 2133495 | A1 | 10/1994 |

(Continued)

OTHER PUBLICATIONS

Web Address—http://www.youtube.com/watch?v=oig5NGc8Qb4—entitled: Unimog Snow Plow—found at http://www.youtube.com/watch?v=oig5NGc8Qb4 (hereinafter, "the 'Unimog publication") discloses a Unimog 1200 and RASCO Karnik 3.0 snow plow. Date—Dec. 18, 2010.

(Continued)

*Primary Examiner* — Jamie L McGowan

(74) *Attorney, Agent, or Firm* — Ernest D. Buff; Ernest D. Buff & Associates, LLC

(57) ABSTRACT

An auxiliary material moving assembly operates in conjunction, independently and/or concomitantly with a material moving machine for proficient handling, removal, and management of material such as snow, ice, and/or other materials. The auxiliary material moving assembly is configured to be mounted on a material moving machine. The auxiliary material moving assembly comprises at least one attachment arm, preferably at least two foldable or rotatable attachment arms, and at least one material moving element. The material moving machine includes a snowplow, snow plow-blower, or other material moving machine. Preferably, the auxiliary material moving element comprises one or more snow cutter, snow beater, screw-like auger, auger, ribbon-cutter, rotary fan, impeller, rotary (sweeping) broom, blower, scraper, paddle or other mechanical device that permits (Continued)

handling, removal and management of snow, ice and/or other materials.

23 Claims, 37 Drawing Sheets

(56) References Cited

U.S. PATENT DOCUMENTS 3,309,798 A 3/1967 Devlin et al.
3,424,251 A * 1/1969 Bouley ..... E02F 3/7609 172/810
3,911,601 A 10/1975 Maheu
4,023,287 A * 5/1977 de Brito ..... E01H 5/04 37/231
4,164,820 A * 8/1979 Krickovich ..... E01H 5/104 15/340.3
4,249,322 A 2/1981 McLaughlin et al.
4,346,645 A 11/1982 Hine et al.
4,479,312 A 10/1984 Turgeon
5,127,174 A 7/1992 Takeshita
5,438,770 A * 8/1995 Miller ..... E01H 5/04 37/249
5,513,453 A 5/1996 Norton
5,899,007 A 5/1999 Niemela et al.
5,915,835 A 6/1999 Fair
6,154,985 A * 12/2000 Champagne ..... E01H 5/098 37/222
6,247,254 B1 * 6/2001 Wessman ..... E01H 5/067 37/248
6,367,176 B1 4/2002 Zaugg et al.
6,513,267 B2 2/2003 Yoshida
7,174,660 B2 2/2007 Sakai et al.
7,681,337 B2 3/2010 Watson
8,191,289 B2 6/2012 Raftery
9,359,734 B2 * 6/2016 Favorito ..... E01H 5/04
2004/0216333 A1 11/2004 Quenzi et al.
2009/0217554 A1 9/2009 Tucker
2009/0307934 A1 12/2009 Wendoroff
2009/0307941 A1 12/2009 Gamble
2010/0205834 A1 8/2010 McKeown et al.
2011/0113657 A1 5/2011 Mills
2011/0239491 A1 10/2011 Chen
2012/0079749 A1 4/2012 Dimario
2012/0279093 A1 * 11/2012 Niemela ..... E01H 5/061 37/242
2013/0298429 A1 * 11/2013 Niemela ..... E01H 5/04 37/242
2014/0130384 A1 * 5/2014 Favorito ..... E01H 5/04 37/248
2015/0068074 A1 3/2015 Mast et al.
2015/0190021 A1 * 7/2015 Barkow ..... E01H 1/0809 15/405
2020/0363796 A1 * 11/2020 Muro ..... G05D 1/0223

FOREIGN PATENT DOCUMENTS

CA 2872166 A 11/2013
JP 2003041544 A 8/2001

OTHER PUBLICATIONS

LED Snow Plow Lights Enhance Safety (Traffic Safety Direct)[online](retrieved from the internet on Mar. 5, 2021 ) URL https://trafficsafetydirect.com/led-snow-plow-lights-enhance- safety, Jan. 19, 2020 (Jan. 19, 2020); entire document, especially Fig. 1.

* cited by examiner

AUXILIARY MATERIAL MOVING ASSEMBLY FOR SNOW PLOW-BLOWER OR OTHER MATERIAL MOVING DEVICE

This application is a continuation-in-part of U.S. patent application Ser. No. 16/798,373 filed Feb. 23, 2020, entitled: SNOW PLOW-BLOWER the disclosure of which is hereby incorporated in its entirety by reference hereto.

BACKGROUND OF THE INVENTION

1. Field of the Invention

The present invention relates to auxiliary assemblies for snow, ice and/or other material moving machines; and, more particularly, to an auxiliary material moving mechanical assembly having an external material moving element mountable on a snow plow-blower, ice removing machine, or other material moving apparatus adapted to be used in operation with a vehicle/moveable machine to remove material.

2. Description of the Prior Art

Material removal, including ice and/or snow, is a tedious and costly operation for residents, municipalities and commercial enterprises and involves attachments that are generally mounted on vehicles for use when removing snow and ice from outdoor surfaces such as roads and parking lots. Snow plows typically use a blade to push snow to the side or straight ahead, clearing the snow from a surface. Snowbanks are thereby created, and snow piles build up along the side of the roadway or the like, causing dangerous conditions and visibility issues at intersections and driveways. As additional snow accumulates, the snowbanks or piles created by plowing operations become increasingly difficult to manage.

An alternative to snow removal involves the use of snow blowers, which remove and/or throw snow from one location to another. Snow blowers or snow throwers generally involve machines for removing snow from an area such as a driveway, sidewalk, roadway, railroad track, rink, runway, or parking lot, where snow is not wanted. While snow throwers are generally like snow blowers, snow throwers involve machines that use a single stage to remove or "throw" snow while snow blowers generally use at least two stages to remove or "blow" snow. Such snow throwing and snow blowing devices typically use either electric power or a gasoline or diesel engine to energize the throwing or blowing of snow to another location or into a truck to be hauled away. This throwing or blowing operation is in contrast with the action of snowplows, which merely push snow to the front or side.

In operation, snow blowers are broadly divided into two classes, single-stage and two stages. Single-stage snow throwers implement a single snow moving part, such as a high-speed impeller or auger, to both move the snow into the machine and force it out of a discharge chute. Two or more curved paddles can optionally be utilized to move snow towards the centerline of the machine where the discharge chute is located. These single-stage snow throwers usually are light-duty machines. In a two-stage machine, two mechanisms move the snow; an auger feeds the snow to a high-speed impeller, which blows the snow out of the machine. These two-stage snow blowers generally range from small machines having a few horsepower to large commercial-grade machines powered by diesel engines of over 1000 horsepower (746 kW). Generally, the large machines are used for clearing roadways and airport runways, often by throwing the snow into trucks, which haul it away.

A variety of devices have been suggested for forming snow moving units. For example:

U.S. Pat. No. 1,552,714 to Linzy discloses a rotary snowplow. A chassis frame carries an engine, transmission, driving shaft and reverse control. At the front of the chassis is provided a housing carrying a peripherally mounted member.

U.S. Pat. No. 2,777,218 and counterpart Foreign Patent Publication No. CA646078 to Kiecker et al. disclose a combination snow plow and blower normally drawn by an implement such as a tractor.

U.S. Pat. No. 3,309,798 to Devlin et al. discloses a snow melter.

U.S. Pat. No. 3,911,601 to Maheu discloses a snow blower vehicle comprising a snow plow assembly mounted on the front of a vehicle chassis. The snow plow assembly has an open-fronted scoop and a scraper blade resiliently mounted on the lower edge of the scoop.

U.S. Pat. No. 4,023,287 to De Brito discloses a plow attachment for a snow blower that may be pivoted between work and storage positions, about a horizontal axis located rearwardly of the snow blower blade and may be angularly adjusted about a vertical axis. The plow attachment includes a frame and a blade which may be readily connected to and removed from the frame.

U.S. Pat. No. 4,249,322 to Mclaughlin et al. discloses a vehicle-mounted snowplow having a scoop with a large intake opening for receiving snow and air. The scoop tapers to a narrow throat connected to an outlet means. Airspeed through the scoop is increased as the scoop narrows so that the air carries the scooped snow through the outlet means and discharges it from the outlet means at a high velocity.

U.S. Pat. No. 4,356,645 to Hine et al. discloses a variable wing plow blade and mounting structure for attaching the plow blade to a tractor, snow grooming vehicle, and the like feature distribution of the load on the blade over a relatively wide area of the supporting structural members thereby to permit a reduction in their size, weight and number and in their manufacturing and assembling costs while maintaining the essential structural strength.

U.S. Pat. No. 5,127,174 to Takeshita discloses an improved snow thrower and specifically an improved blower that improves efficiency and reduces the likelihood of snow accumulation.

U.S. Pat. No. 5,513,453 to Norton discloses a combined snow plowing and snow throwing vehicle that includes an elongate plow blade at its forward end. The plow blade can be shifted to direct snow to either the right or the left, and includes separate snow throwing fans mounted, respectively, at the right and left ends of the plow blade.

U.S. Pat. No. 4,479,312 to Turgeon discloses a foldable snow compactor that has a center pan with a pair of operatively positioned wings extending from the ends thereof. The wings are mounted for pivotal movement about axes fixed in relation to the center pan.

U.S. Pat. No. 5,899,007 to Niemela et al. discloses a plow assembly for vehicles such as pickup trucks and tractors for moving snow or other materials has at least one extendable, forwardly pivotable plow wing which is extendable on one end of a main plow by sliding movement along the front of the plow between a retracted and an extended position in which the plow wing is generally aligned with the plow front surface.

U.S. Pat. No. 5,915,835 to Fair discloses a snowblower including a housing. Attached to the snowblower is a drive mechanism that actuates a snow gate for movement about a vertical axis, inwardly towards and outwardly away from the snowblower housing.

U.S. Pat. No. 6,154,985 to Champagne et al. discloses a device for use with a snow blower being of the type having an auger. The device allows the snow blower to operate while moving backward.

U.S. Pat. No. 6,367,176 to Zaugg et al. discloses a rotary snow blower plow with a plow worm that delivers the snow and a fan blower that throws the delivered snow. The fan blower is located on a line with the plow worm. The fan blower and the plow worm can be mounted on a common shaft so that they rotate with the same angular speed.

U.S. Pat. No. 6,513,267 to Yoshida et al. discloses a snow removing machine equipped with a snow removing plate. The snow removing plate is mounted to a front portion of a vehicle body which forms part of the snow removing machine. An operating handle having grip portions is mounted to a rear portion of the vehicle body and obliquely extends upward.

U.S. Pat. No. 7,174,660 to Sakai et al. discloses a snow removing machine having an auger for plowing and collecting snow, a rotatable blower for throwing snow collected by the auger, and a shooter for guiding the snow thrown by the blower so that the snow reaches a selected point. The blower has a central shaft part and blades extending radially outwardly from the shaft part.

U.S. Pat. No. 7,681,337 to Watson discloses a plow assembly comprising a blade, structure attached to the blade and adapted to be attached to a vehicle for mounting the blade to and supporting the blade from the vehicle, and a wing attached to an end of the blade. The wing has a first portion mounted to the blade for translational movement relative thereto, and a second portion mounted to the first portion for rotational movement relative thereto.

U.S. Pat. No. 8,191,289 to Raftery discloses a skid for use on a snow blower. The snow blower includes an auger housing through which snow removed from an area is channeled. The skid includes a body that is secured to a vertical side wall of the auger housing.

U.S. Pat. No. 9,359,734 to Favorito et al. discloses a snow plow-blower that operates as a snow plow, snow blower, or as a snow plow-blower combination. The device includes a plow head blade optionally having retractable/pivotal scoop wings and a cavity with an aperture with blower doors and a blower unit. The snow blower unit includes an auger and impeller to move snow into the unit and force it out of a discharge chute. Blower doors are provided over the snow blower unit cavity to prevent snow from entering the cavity when the blower is off. Optionally, the blower doors move along a track and rest flush against the plow head to open and close off access to the cavity.

U.S. Patent Application Publication No. 20100205834 to Mckeown et al. discloses an apparatus and a method of clearing an accumulation of matter from a surface. The apparatus includes a collecting section, a casting section, and a shifting section. The shifting section is at least one of a diverting section, a sweeping section, and an air blowing section.

U.S. Patent Application Publication No. 20040216333 to Quenzi et al. discloses a plow assembly includes a pair of plow wings that are pivotally mounted at opposite ends of a center plow. Each of the plow wings may pivot between a forwardly angled position and an aligned position. The plow assembly may pivot a trailing plow wing in response to the center plow being urged or angled toward that side of the vehicle.

U.S. Patent Application Publication No. 20090307941 to Gamble discloses a plow, including a center blade and wing blades coupled to each end of the center blade. Each wing blade is pivotally connected to the center blade about an axis.

U.S. Patent Application Publication No. 20110113657 to Mills discloses a snow deflector apparatus that easily attaches to a snowplow. The deflector apparatus includes a kit, and the snowplow system includes two snow deflectors and a control system.

U.S. Patent Application Publication No. 20110239491 to Chen discloses a remnant snow removing apparatus for a snow thrower includes a scraper bucket and at least one extension panel located on the scraper bucket.

U.S. Patent Application Publication No. 20110067273 to Koch et al. discloses a snow plow including a quick connect/disconnect hitch. The snow plow includes a hitch frame nose assembly configured to couple to a vehicle. The hitch frame nose assembly includes a chassis coupler secured at each end of a hitch frame tube with each chassis coupler including a traverse pin. A plow frame is included, with the plow frame having a front portion and a rear portion. A plow blade is coupled to the front portion of the plow frame.

U.S. Patent Application Publication No. 20120079749 to Dimario discloses a device and method of use of a plow back blade for snow removal. The plow-back blade is attached to a snowplow or snow blower to assist with removing snow from areas that are otherwise difficult to access with conventional snow removal equipment. The plow-back blade is rotatably attached to a snowplow blade at a pivot point.

U.S. Patent Application Publication No. 20120279093 to Niemela et al. discloses a combination snow blower and plow apparatus that provides at least two operating configurations, including (i) a standard-width snow blowing configuration, and (ii) an expanded-width plowing and blowing configuration.

U.S. Patent Application Publication No. 20130298429 to Niemela et al. discloses a combination snow blower and plow apparatus that provides at least two operating configurations, including a standard-width snow blowing configuration, and a snow plowing configuration, movable between a lowered deployed position for engaging snow, and a raised undeployed position for disengaging the plow assembly from the snow.

Foreign Patent Publication No. JP2003041544 to Morimoto et al. discloses a blower for a snow plow. The blower reduces noise during work and surely discharges collected snow to a snow discharge chute. The snow discharge is affected by radially standing a plurality of blades, etc., in a blower baseboard and bending a tip part of each blade in the turning direction.

Foreign Patent Publication No. CA2133495 to Pedersen discloses a scraping implement that can be quickly coupled and uncoupled to a conventional self-propelled snow blower for the removal of snow from a driveway or sidewalk.

Non-Patent Literature entitled "*Unimog Snow Plow*" found at http://www.youtube.com/watch?v=oig5NGc8Qb4 (hereinafter, "the Unirnog publication") discloses a Unimog 1200 and RASCO Karnik 3.0 snow plow.

Non-Patent Literature entitled "*Crafts Manual-Stage Snow Blower Tractor Attachment*" found at http://www searsoutlet.com/d/ product_details.jsp?pid=41354&mode=buyUsedOnly& sid=IDx20110411x000008&ci_sku=8797230&ci_gpa= pla&ci_kw={keyword} (hereinafter, "the 'Crafts publication") discloses a dual-stage snow blower tractor attachment. The dual-stage snow blower tractor attachment is connected to a lawn tractor type device.

Notwithstanding the efforts of prior art workers, there remains a need in the art for an auxiliary material moving assembly mountable on a material-removing machine, such as a snow plow, material blower, snow plow-blower apparatus, ice breaker or other machine adapted to be used in operation with a vehicle to plow and remove material, or independently, wherein the auxiliary assembly can function unilaterally or in conjunction with the material-removing machine. Additionally, there exists a need in the art for an auxiliary assembly having the ability to break apart, cut-up, chop-up, stir, process, extend, rotate, collect, grab, scrape, push, pull, back-drag, &/or proficiently move, and/or direct all material, ice and/or snow, as needed to prevent clogging and/or jamming of the material removing apparatus.

SUMMARY OF THE INVENTION

The present invention provides an auxiliary material moving device and snow plow assembly that is especially well suited for use in operation with a land vehicle/movable unit to remove snow, providing a single and/or dual stage or multi-stage blower configuration. Generally stated, the auxiliary material moving assembly/device may be a stand-alone device that is configured to be mounted on a material moving machine, or primary device, to provide an improved function to the material moving machine or primary device, i.e., Snow Plow-Blower, plow, blower and/or a material moving machine. Alternatively, the auxiliary material moving assembly is integrated with a material moving machine, or primary device for moving snow, ice and other materials.

In an embodiment, an auxiliary material moving assembly is provided that is adapted to be mounted on a material moving machine. The stand-alone auxiliary material moving assembly is adapted to be mounted on a plurality of material moving machines. The auxiliary material moving assembly comprises at least one attachment arm and at least one material moving element. The auxiliary material moving assembly and, consequently, the auxiliary material moving element, is adapted to operate in conjunction, independently and/or concomitantly with the material moving machine for proficient handling, removal, and management of material.

In an embodiment, the auxiliary material moving element comprises one or more snow cutter, snow beater, screw-like auger, auger, ribbon-cutter, rotary fan, impeller, rotary (sweeping) broom, blower, scraper, paddle, or other mechanical device that permits handling, removal and management of snow, ice and/or other materials.

In an embodiment, the auxiliary material moving assembly includes at least one foldable or rotatable auxiliary moldboard being one or more of straight, curved, box, V-shaped and wedge-shaped. The auxiliary moldboard is located proximal to the auxiliary material moving element.

In an embodiment, the auxiliary material moving assembly includes at least one electrical, electronic operating Central Processing Unit (CPU), Electrical Panel, Switches, Specific Electronic panel circuitry system for operator end user control of the auxiliary material moving assembly and/or the material moving machine on which it is adapted to be mounted.

In an embodiment, the at least one attachment arm is foldable or rotatable to provide multiple positions and angles of the auxiliary material moving element proximal to the material moving machine ranging from about 1 degree to about 360 degrees. The foldable or rotatable operation may be carried out manually, automatically, and/or by use of a controller device. The at least one attachment arm may comprise a fold-down arm, fold-down hinge, and one or more motor or hydraulic assembly for operational folding or rotating movement. One or more motor or hydraulic assembly may be utilized for operational folding or rotating movement of the at least one attachment arm of the auxiliary material moving assembly. The at least one attachment arm may comprise two or more attachment points appointed for mountable adjustment on the material moving machine.

In an embodiment, there are at least two attachment arms and the at least one auxiliary material moving element is located therebetween. The at least two attachment arms can be foldable or rotatable to provide different positions of the auxiliary material moving element proximal to the material moving machine. There may be at least two auxiliary material moving elements arranged proximal to one another located between the at least two attachment arms. The at least two auxiliary material moving elements may be arranged substantially perpendicular to the at least one attachment arm and substantially parallel to one another.

In an embodiment, the auxiliary material moving assembly comprises a timing device for intermittent operation. The auxiliary material moving assembly preferably includes a controller device having wired or wireless operation.

In an embodiment, the at least one auxiliary material moving element is interchangeable, and is one or more auger, ribbon, screw-like auger, ribbon-cutter, snow cutter, snow beater, wheel-cutter, rotary fan, impeller, broom, sweeper, sweeper-broom, rotary (sweeping) broom, blower, edge, scraper, edge-scraper, dragger/puller, pusher, paddle, rotating paddle, drum cutter, ice-breaker and/or any combination mechanical device that permits handling, removal and management of snow, ice and/or other materials.

Another embodiment provides that the at least one attachment arm and the at least one auxiliary material moving element comprise articulation for movement along a horizontal plane and/or vertical plane for different positions when mounted on the material moving machine.

In an embodiment, the at least one attachment arm and the at least one auxiliary material moving element is powered by at least one or more of hydraulic power, electrical power, and other source of power. The at least one auxiliary material moving element can rotate or spin in one or more rotational/spinning direction, clockwise and counter-clockwise direction. In an embodiment, the least one auxiliary material moving element is configured to telescope, extend, bend, fold, retract, slide, and/or rotate about at least one axis, as required for its intended purpose, in any number of degrees of freedom and/or directions, including, but not limited to, the ability to extend, collect/grab, scrape and/or back-drag snow, ice, and/or other materials with an optional protective cover (cap), and/or back-blade.

In another embodiment, the auxiliary material moving assembly constitutes part or all of the snow moving means of a snow plow-blower comprising: a plow head blade with a moldboard; and a snow blower unit having a cavity containing the material moving means for moving snow, ice and other materials out through at least one discharge chute and/or at least one opening; and the auxiliary material moving assembly comprises an auxiliary material moving element located outside said cavity.

In another embodiment, the auxiliary material moving assembly comprises a snow plow-blower comprising: a plow head blade with a moldboard; at least one blower door; a snow blower unit having a cavity containing snow moving means for moving snow, ice and other materials out through at least one discharge chute and/or at least one opening; the at least one blower door being adapted to move to an open configuration to expose the cavity, and from the open configuration to a closed configuration to thereby prevent snow, ice and other material ingress into the snow blower unit. The auxiliary material moving assembly may be mounted proximal to the at least one blower door, within the cavity of the snow blower or outside the cavity of the snow blower.

Another embodiment provides a material moving machine having mounted thereon an auxiliary material moving assembly, wherein: (a) the auxiliary material moving assembly comprises at least one attachment arm and at least one material moving element; (b) a snow plow-blower comprises: a plow head blade with a moldboard; at least one blower door, a snowblower unit having a cavity containing snow moving means for moving snow, ice and other materials out through at least one discharge chute and/or at least one opening, said at least one blower door being adapted to move to an open configuration to expose said cavity, and from said open configuration to a closed configuration to thereby prevent snow, ice and other material ingress into said snowblower unit; (c) said auxiliary material moving assembly comprises at least part of said snow moving means and is configured to operate in conjunction, independently and/or concomitantly with said material moving machine for proficient handling, removal, and management of material.

In an embodiment, the assembly includes at least two arms forming a bracket assembly with the material moving implement located therebetween. The auxiliary material moving assembly is mounted on said blower or placed along its sides, in back of, beneath, or at a location proximal to said blower, and said auxiliary material moving element is configured to operate at least partially outside of said cavity to assist in the proficient handling, removal and successful management of snow, ice and/or other materials.

In an embodiment, the auxiliary material moving element is located above and outside of the cavity and/or the door. Alternatively, the auxiliary material moving element is located inside of the cavity and/or the door.

In an embodiment, the auxiliary material moving element is built on both sides of doors, inside the cavity or outside the cavity.

Another embodiment provides that the auxiliary material moving element is one or more of sweeping/rotating broom, a blower, a scraper, a paddle, and/or any other mechanical device that permits the proficient handling, removal and successful management of snow, ice and/or other material (s). The auxiliary material moving element is preferably adapted to move upward and downward over the cavity to open and close the cavity. The auxiliary material moving element may be adapted to move one or more of horizontally left and right or vertically over the cavity to open and close the cavity through an activating device with a controller.

In an embodiment, a power source is provided selected from the group consisting of hydraulic power, pneumatic (air/fluid) power, internal combustion engine power, mechanical energy direct linkage power including a PTO, chemical energy power, electrical energy power, energy engineered from power sources and electromagnetic energy power or energy engineered from known power sources and/or any other sources of energy from which one trained in the art may derive and transfer power from.

In an embodiment, the auxiliary material moving assembly comprises a specific or universal wired or wireless communication controller device and switching device for operating/controlling substantially all operative functions of the auxiliary material moving assembly and Snow Plow-Blower apparatus, so that the snow blowing or snow throwing function and the snow plowing functions can be carried out concomitantly or independently of each other wirelessly by the use of the specific/universal wired/wireless communication/controller device, and/or a smart device type application for raising or lowering the snow plow-blower apparatus or by articulating the plow head blade attack angle, varying the pitch, yaw and roll of the plow head blade, opening and closing the doors, varying the speed of the blower, controlling the heat devices, controlling a mechanical scraper guide and/or turning headlights, LED guide lights/light bar lights on and off and turning LED lights on and off.

In an embodiment, the auxiliary material moving assembly and the material moving machine comprises at least one caster wheel and skid assembly.

Another embodiment provides a material moving machine having mounted thereon an auxiliary material moving assembly, wherein the auxiliary material moving assembly comprises at least one attachment arm and at least one material moving element; the material moving machine is a dual stage snow plow-blower having a cavity therein for receiving and discharging material, and said material moving element is configured to operate on either side of said cavity, for proficient handling, removal, and management of material.

BRIEF DESCRIPTION OF THE DRAWINGS

The invention will be more fully understood and further advantages will become apparent when reference is made to the following detailed description of the preferred embodiments of the invention and the accompanying drawing, in which.

DETAILED DESCRIPTION OF THE INVENTION

Figure 1A:
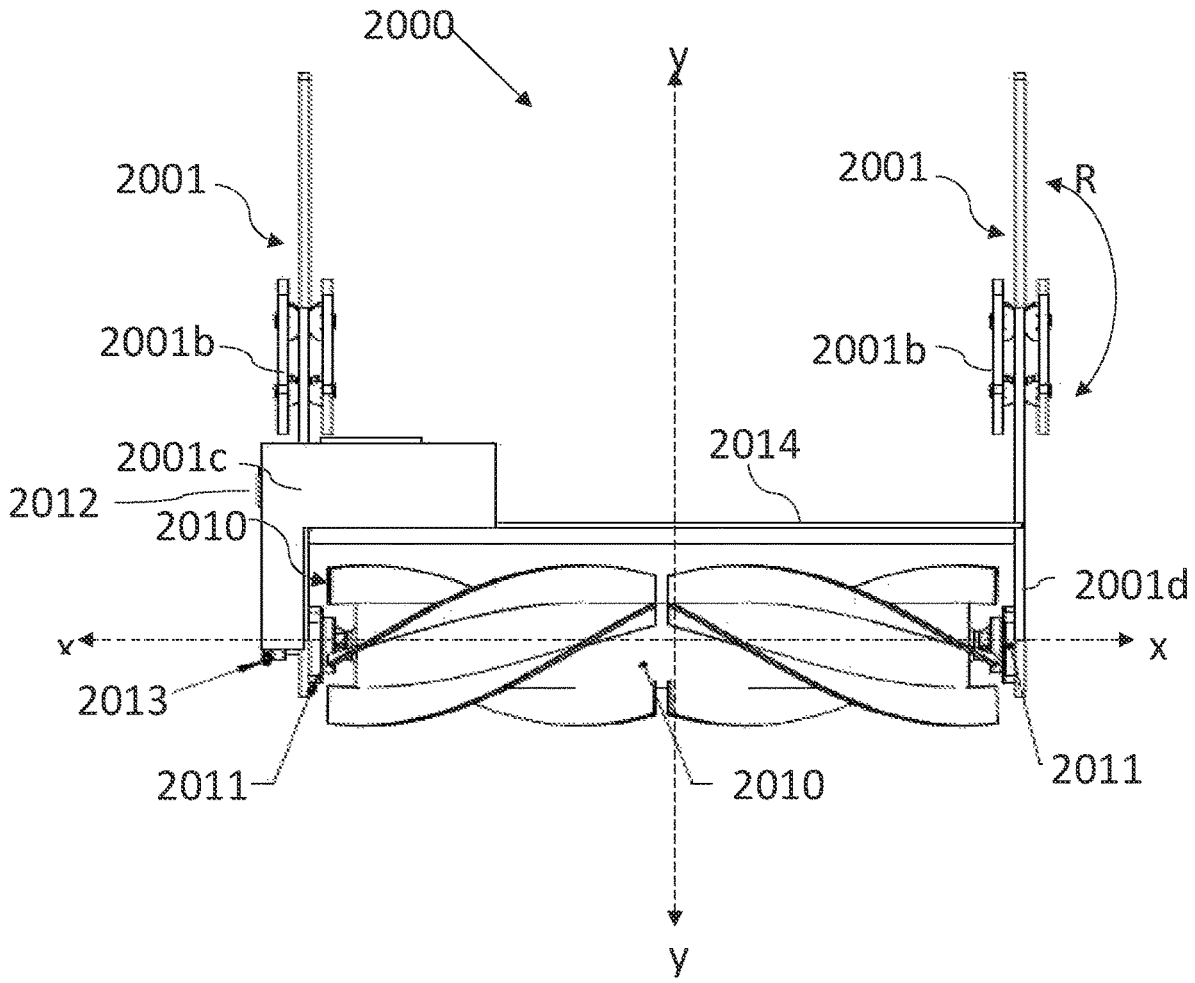
FIG. 1*a* is a front plan view of an embodiment of the auxiliary material moving assembly adapted to be mounted on a material moving machine.

The subject invention is directed to an external/auxiliary assembly, such as an external swing arm assembly, mounted on or attached to, and/or adapted to be mounted on or attached to a snow/ice, and/or other material moving device. Material moving devices contemplated include, for non-limiting example, snow plows, blowers, and/or snow plow-blowers, skid-steer loader, backhoe-loader, tractor-loader/tractor, zero-turn radius machines/mowers, ATV's/UTV's, and/or dedicated material moving equipment wherein the following engineered devices/device assembly are examples of custom tailored devices suited for use either individually, alongside another, or in combination with the others, i.e., snow cutters, snow beaters, screw-like augers, augers, ribbon-cutters, rotary fans, impellers, rotary (sweeping) brooms or any other snow, ice and/or material moving mechanical device means. For non-limiting example, the subject auxiliary assembly can be readily mounted on either side of a snow plow-blower unit's door(s), or anywhere proximal to or on the snow plow-blower unit, operable to function in conjunction, concomitantly, and/or independently with the unit. As such, the subject external/auxiliary facilitates improved and more proficient handling, removal and successful management of snow, ice and/or other material(s).

As used herein, the term "external/auxiliary material moving assembly" shall mean at least one attachment arm and at least one material moving element comprising an auger, ribbon, screw-like auger, ribbon-cutter, snow cutter, snow beater, wheel-cutter, rotary fan, impeller, broom, sweeper, sweeper-broom, rotary (sweeping) broom, blower, snow-blower, edge, scraper, edge-scraper, dragger/puller, pusher, paddle, rotating paddle, drum cutter, ice-breaker and/or a combination thereof.

An external/auxiliary material moving assembly is adapted to be removably mounted on and/or permanently mounted on a material moving device, such as for non-limiting example, a snow plow-blower device to provide for improved operation of the material moving device. The subject external/auxiliary material moving assembly operates in conjunction with the material moving device, such as snow plow, snow blower, or a snow plow-blower, concomitantly and/or separately as needed to maximize material movement. Improvements include, for non-limiting example, improvements in the type of blower structure utilized, single or double stage, and single structural and single hydraulic designs, to enhance snow moving capability, decrease the size and weight of the apparatus and reduce overall manufacturing cost. Further improvements include incorporation of at least one, preferably at least three (3), and more preferably at least four (4) individual wheels/casters.

As used herein, vehicle shall mean, without limitation, truck, tractor, construction equipment, loader, skid steer, locomotives, or other powered/ride-on device or machine capable of or operative to move snow and/ice, and/other materials. The term moveable machine refers broadly to walk behind or push snow blower, thrower or plow device that clears or moves snow ice and other materials; or to a snow blower, thrower or plow device configured to be mounted on or integrally associated with a vehicle. Herein, the terms "snow blower" and "snow thrower" are utilized interchangeably, unless otherwise stated.

As used herein, the term "movable machine" means a self-propelled or manually operable wheel/track machine that the user can either Walk-behind and push or Walk-behind with partial/full power-assist (e.g., self-propelled lawn mower/snow-blower/thrower/sweeper on wheels, or tracks) machine; or to a snow blower, thrower or plow device configured to be mounted on or integrally associated with a vehicle. Moveable machine refers broadly to a walk-behind, push, or vehicle-powered snow blower, thrower or plow device that clears or moves snow and/or ice and/or other materials.

As used herein, the term "vehicle" shall mean, without limitation, truck, tractor, construction equipment, loader, skid steer, locomotives, or other powered/ride-on device or machine capable of or operative to move snow and/or ice and other materials. The term "vehicle" further means a self-propelled wheeled or track machine, such as a Zero-Turn Radius Machine (ZTR), a Lawn Mower, Truck/Car, ATV/Utility ATV (All-Terrain Vehicle/Utility All-Terrain Vehicle), Skid-steer loader, Compact loader, Front-end loader (Pay-Loaders), Backhoe Front-End Loader, Dozer, Motor-grader, Specialty/Dedicated Vehicle/Machine, Off-Road Vehicle, and Trains/Locomotive).

Herein, the terms "snow blower" and "snow thrower" are utilized interchangeably, unless otherwise stated.

The subject external/auxiliary arm may be rotatable, retractable sliding from the unit, for example, from above a moldboard of the unit. The external/auxiliary arm may begin from within the blower box aperture/cavity, it may slide or swing out from the sides of a unit, or it may slide or swing out from beneath a snow plow blower unit.

In an embodiment, the external/auxiliary is constructed having one or more folding-bracket arm, such as for having two or more bar linkages, preferably having three bar linkages, most preferably having four (4) bar linkages forming the folding-bracket arm. The folding-bracket arm can be constructed with or without hydraulics and/or electrical power, for example, with gravity assist design, without rotational actuators and/or pistons, and/or with or without telescoping linear actuators/pistons, as opposed to the more common linear actuator/piston to control the arm's swing movement from above and down to all varying positions. Also, the external arm assembly may be powered by any means necessary, whether that power be designed by any mechanical design system, or any hydraulic design system (i.e., from a movable machine such as a skid-steer/loader, truck, etc.), from its own custom-designed hydraulic power system, and/or any electrical power systems (from a movable machine or not). Preferably, the external arm assembly includes linear actuators with foldable mechanical linkages and is powered by hydraulic power.

An attachment arm or external auger, snow/ice, material moving apparatus is provided for additional movement of material apart from main unit's internal material moving means. Alternatively, the material moving apparatus associated with the attachment arm or external auger may replace one or more of the main unit's internal material moving means. The attachment arm or external auger has one or more arm member attached to one or more material moving member. The material moving member may be an auger-like mechanical device (i.e., "Archimedes screw-like auger"), ribbon-cutter-auger, or any type of auger with flights, a mechanical device that functions like a rotating helix in any orientation or direction that may be constructed in all configurations and arrangements as a physical apparatus to basically convert rotational motion to linear motion. The subject external/auxiliary may be built and used specifically for the collection, harvesting and/or movement of fluid, granular and solid materials apart from a main mechanical unit's internal material moving means for the proficient handling, removal and successful management of snow, ice and/or other material(s). Additional attachments or parts that may also scoop-up, grab/collect, scrape, drag, push, throw, sweep, etc., and move materials of all dimensions from varying heights, widths, depths, and distances are also contemplated in order to make materials more easily manageable so they may be moved more effectively.

The external/auxiliary (arm(s)) may be added to or mounted on a snow blower, or a snow plow, or a plough, or any combination snow plow-blower-like mechanical device. The subject external/auxiliary (arm(s)) may be an individual, stand-alone, device adapted to be added or mounted to any other mechanical device or movable machine, separate from any snow plow-blower like mechanical device, any snow plow, any snow blower, and/or any other movable machine, for its purpose is to contribute to processing and moving materials more efficiently. This attachment assembly (arm(s)) and/or external auger-like mechanical device may have an optional back blade embodiment, and/or a scrapper embodiment that may be able to drag and/or push materials while simultaneously providing a protective cover to any of its moving or rotating parts.

In an embodiment, at least one external/auxiliary (i.e., "arm") mechanical device for snow/ice, and/or other material moving means, i.e., snow cutter, snow beater, screw-like auger/auger, ribbon-cutter, rotary fan, impeller, rotary (sweeping) broom or any other snow, ice and/or other material moving means mechanical device that can be placed on either side of a Snow Plow-Blower door(s), or anywhere on the physical Snow Plow-Blower unit (e.g., anywhere within the vicinity of the SPB unit) but functions in conjunction with the unit. The external arm assembly may work independently or not (e.g., concomitantly) in the proficient handling, removal and successful management of snow, ice and/or other material(s). In an embodiment, at least one snow, ice and/or other materials moving means can be built on both sides of doors, inside the cavity or outside the cavity. Snow, ice and/or other material moving machines/units can work independently of doors to a cavity being open or not.

At least one snow, ice and/or other material moving means can be built into the moldboard or can be placed along its side(s), in back of, beneath, or any combination that will ultimately move any kind of snow, ice and/or other materials and/or assist in the proficient handling, removal and successful management of snow, ice and/or other material(s). At least one snow, ice and/or other material moving means may come from above and outside of the cavity to work with other snow, ice and/or other material moving means inside cavity or behind the cavity doors. At least one snow, ice and/or other material moving means may be of a form of sweeping/rotating broom, a blower, a scraper, a paddle, and/or any other mechanical device that permits the proficient handling, removal and successful management of snow, ice and/or other material(s). At least one snow, ice and/or other material moving means can be in any place on the snow plow-blower unit, horizontally, vertically or in any combination of directions. At least one moldboard may be in any geometric configuration, i.e., straight, curved, box, V-shaped, Wedge-shaped, and/or any other varied geometrically shaped moldboard configuration, and/or a combination thereof.

At least one cavity with snow, ice and/or other material moving means may be anywhere in front of the unit, on the back of the unit, on top of the unit, beneath the unit, along the side(s) of the unit, and/or not attached to the unit at all. Snow, ice and/or other material moving means can be anywhere that will allow the free flow and proficient handling, removal and successful management of snow, ice and/or other material. At least one blower box cavity/cavities does not have to be fully enclosed and does not have to have any specific number of sides, floors, or roofs. Snow, ice and/or other material moving means may be incorporated (anywhere) onto the snowplow blower unit or separate from the unit in order to effectively handle and manage the proficient movement of snow, ice, and/or other material(s) in order to permit any moving direction(s): forward, backward, diagonal, or sideways (lateral movement) and/or any combination thereof. At least one snow, ice and/or other material (s) moving means can be part of the snow plow-blower unit and may be attached to any and all moving machines, including, but not limited to, any land vehicles, construction equipment, walk-behind units, independent/self-dedicated vehicles and/or any other device/machine, including those that can move a snow plow-blower unit to accomplish an end user's chosen means to proficiently handle, remove and successfully manage snow, ice and/or other material(s). At least one snow, ice and/or other material moving means may be incorporated (anywhere) to the SPB unit in order to proficiently handle, remove and successfully manage snow, ice and/or other material(s). At least one electrical and/or electronic operating Central Processing Unit (CPU)/Electrical Panel/Switches/Specific Electronic panel circuitry system may be provided in order to give an operator/end user the control of a Snow Plow-Blower units function and communications of all its moving means and associated embodiments and/or unit assemblies (including, the unit itself), whether or not the electrical and/or electronic signaling system(s) are housed within (and/or onto) the Snow Plow-Blower unit or a movable machine/vehicle, or any combination machine thereof.

In another embodiment, is directed to a separate device from the snow plow-blower unit or material moving machine/unit. An external/auxiliary (i.e., "arm") mechanical device is adapted to be mounted on any other machine, any other device, and/or any other invention or movable machine (i.e., snowblower, snowplow, plough, snow-pusher, movable machines), as a separate external/auxiliary. At least one external/auxiliary (i.e., "arm") mechanical device can be moved from inside or outside the cavity. At least one external/auxiliary (i.e., "arm") mechanical device timing may be added for intermittent operation with or without an additional timing device. At least one external/auxiliary (i.e., "arm") mechanical device can move inside or outside of cavity manually or automatically by a controller and/or communication device. At least one external/auxiliary (i.e., "arm") mechanical device can have interchangeable parts, i.e., auger, ribbon cutter, paddles, rotating broom, sweeper, and/or any combination thereof. The mechanical device can move through multiple positions and angles, i.e., 1-360 degrees of rotation, and may be moved manually (by hand), by automatic means, and/or by the use of a controller device.

At least one auxiliary assembly (i.e., "arm idea") mechanical device may have a controller device and it may be a wired or a wireless device from all proven and known technologies as well any and all developed and yet to be proven technologies. At least one (i.e., "arm idea") mechanical device may articulate (like a snowplow) whether its axis of rotation is horizontal, vertical, and/or diagonal in many different directions/positions depending on where the auxiliary assembly is mounted to a said SnowPlow-Blower, a snowplow, or a snowblower device, and/or any movable machine. At least one auxiliary assembly (i.e., "arm idea") mechanical device may be powered by at least one or more of any form of hydraulic power, electrical power, and/or any other sources of energy from which one trained in the art may derive and transfer power.

At least one auxiliary assembly (i.e., "arm construction") mechanical device may move in a rotational/spinning direction, clockwise and/or counter clockwise, and/or in any other direction thereof. At least one auxiliary assembly (i.e., "arm construction") mechanical device may have the ability to telescope, extend, bend, fold, retract, slide, and/or rotate about at least one axis, as required for its intended purpose, in any number of degrees of freedom and/or directions, including, but not limited to, the ability to extend, collect/grab, scrape and/or back-drag snow, ice, and/or other materials with an optional protective cover (cap), and/or back-blade.

Another embodiment provides for a caster wheel assembly.

In an embodiment, the subject auxiliary assembly is integrated with or alternatively, a separate unit adapted to be mounted on a snow plow-blower preferably having a plow head blade with retractable/pivotal wing or wings and a cavity having an aperture with blower doors and a blower unit. The blower unit is preferably constructed as a single stage snow blower when a lighter snow plow-blower device is needed. Alternatively, the blower unit may be a dual stage snow blower with impeller and auger features.

In one embodiment, the snow blower unit includes an impeller to move snow into the unit and force it out of a discharge chute. The snow blower unit can further include at least one auger. An engineered heating device can additionally be provided. The heating device may comprise a heat coil/element, placed strategically on, within or about the auger/or material cutting and/or processing embodiment's surface area to prevent packing and freezing of snow/ice, and other materials build up. Optionally, a mechanical scraper guide or electromechanical scraper guide can be provided. At least one blower door is provided over the snow blower unit cavity to prevent unwanted snow/ice/other materials, and especially animals/people from unintentionally entering the cavity when the blower is off. Optionally, the blower door moves along a track and rests flush against the plow head to open and close. Alternatively, the blower door is mounted on a hinge to pivot to open and closed positions. The blower door or doors may be controlled by hydraulics and may be constructed to operate as blower blades to direct snow into the blower unit as shown in FIG. 11; alternatively, separate blower blades are provided to optimize snow removal and mitigate jamming/clogging.

The present invention provides an auxiliary assembly adapted to be mounted on a snow plow-blower apparatus adapted to be used in operation with a land vehicle to plow and remove snow. Functionality of the blower and/plow can operate unilaterally or in conjunction with one another. Advantageously, the blower can be covered to prevent snow ingress when the blower is not being utilized. Additionally, the subject snow plow-blower apparatus provides secondary blades for directing snow as needed to mitigate and/or prevent clogging, unwanted snow distribution and/or snow pile placement.

The snow plow-blower apparatus comprises, in combination, a plow head blade which may include one or more wings located on the plow head blade. Preferably at least two wings located on opposing side walls of the plow head blade. The optional at least one wing is preferably retractable and/or has pivot means. In a first embodiment, the snow plow-blower plow head blade includes an aperture leading to a cavity having an aperture with blower doors. Alternatively, in another embodiment, the plow head blade does not have the aperture integrated therein, and the plow head blade itself is the blower door. In this embodiment, the plow head blade is operable to move upward and downward along the vertical plane to open and expose the aperture and consequently the cavity (i.e., the aperture is essentially the opening to the cavity) and allow snow blowing operation.

In one embodiment, the cavity is an opening directly leading to the auger for snow removal; in another embodiment, the cavity is a sealed chamber whereby a vacuum system of snow removal can be employed with some minor engineering changes and optional parts. The cavity includes a snow blower unit housed therein. The cavity may or may not be a sealed chamber whereby a vacuum system of snow removal can be employed with some minor engineering changes and optional parts. The snow blower unit comprises at least one auger in communication with a power source adapted to move the snow into the unit and force it out of a discharge chute. Alternatively, the chute may rotate up to 360° to permit the blowing of snow directly into the truck the device is mounted to as well as into forwardly and adjacently located trucks that are moving or stationary during removal operations.

The subject snow plow-blower/thrower device may utilize a dual-stage snow blower, single-stage snow blower (or snow thrower), or a combination thereof. Generally, snow blowers are designated into two classes: single-stage and dual or two-stage snow blowers. The snow plow-blower shown herein is optionally designed to include a multi-stage blower apparatus, wherein generally more than two (2) moving parts may process and manage snow, ice/other materials. Typically, a single-stage snow blower includes a single snow moving part such as an auger, impeller, or sweeper-paddle-like mechanism, generally located in front of the blower, that pulls snow into the machine and directs snow through at least one (1) discharge chute and/or at least one (1) opening. Conversely, a two-stage snow blower typically includes both at least a single auger and an impeller, or at least a single ribbon-cutter and an impeller, or at least a single rotary fan-cutter and an impeller, or at least any other material moving means mechanical device, or at least a sweeper-paddle-like mechanism that works in unison to pull or collect snow into or around the machine for processing and management, and then directs the snow through a discharge chute or opening. Two-stage snow blowers can typically process deeper snow depths than simpler single-stage blower/thrower designs, and generally throw the snow faster and farther away than a single-stage snow blower/thrower. It is noted that the subject snow plow-blower can be utilized for blowing snow, ice, and water, and/or particles and debris.

The plow head blade of the snow plow-blower may further include a moldboard, curved plate or outer covering made of a metal, steel, polymeric material, or other suitable material which, together with a hinge located near the center of the moldboard, enables the plow head blade to open and transform to different shaped moldboard configurations. The moldboard configurations preferably include a straight blade, an angled blade, a scooped blade, a windrow blade, a wedge blade, a v-shaped blade, and combinations thereof.

The subject invention is preferably constructed as a single-stage snow blower when a lighter snow plow-blower device is warranted. Generally, the subject snow plow-blower uses a single-stage snow blower when weight constraints (weight limits) are of a concern, which is typically lighter in construct than the dual-stage type snow blowers, particularly when mounting to transport vehicles. Single-stage designs of impeller/fan blowers and/or throwers vs. dual stage designs of impeller and auger blowers and/or throwers are typically preferred by most manufacturers because single-stage designs limit the number of moving parts thereby minimizing potential failure and increasing the integrity of the design, thereby permitting commercial/residential and/or industrial applications of greater longevity for the end-user and effectively increasing consumer value.

Single-stage structural implementation of the present snow plow-blower may further incorporate at least one (1) snow beater/ribbon cutter, or any combination of an engineered geometrical, physical device, to be mounted to at least one (1) impeller/rotary fan and its central rotating shaft, versus a horizontal auger, because it is simpler to construct, easier to manufacturer, and is a lighter device, not requiring any maintenance (such as periodic lubrication so often found with augers). Typically, single-stage blower hydraulic designs are simpler than dual-stage because they require fewer hydraulic valves and controls for communications, permitting manufacturers to minimize potential hydraulic leaks mitigating mid-storm failures that readily occur in industry removal operations. The subject snow blower constructs offer improvements over heretofore designed and utilized snow plows/snow blowers and/or snow throwers. Those improvements, including the type of blower, single or double stage, and single structural and single hydraulic designs, reduce overall manufacturing cost.

Further improvements result owing to the subject snow plow-blower, which further improvements include incorporation of at least one individual wheel/caster, preferably at least three (3) wheels/casters, and most preferably at least four (4) wheels/casters rather than the typical single wheel/caster type construct. The subject snow plow-blower preferably utilizes at least one individual wheel/caster that is engineered in a manner to balance the weight of the device from its center of gravity, allowing users to attach and detach the device to transport the vehicle without the use of additional equipment or persons. Preferably at least four wheels/casters are utilized.

A hydraulic and/or electrically powered telescoping and/or folding chute is preferably utilized by the subject snow plow-blower, electronically controlled using a wired or wireless controller, rather than a standard (manual) chute. The wireless controller preferably uses infrared, radio and/or blue tooth technologies. The wired or wireless controller typically communicates with a switching device, preferably in communication with a specifically engineered switching device or box associated with the snow plow-blower apparatus attachment. Additionally, the subject snow plow-blower preferably includes larger pivoting wings on a hinge point at the end of the plow head blade, wherein the wings can pivot up to 90 degrees without the need for the wings to retract into a cavity behind and/or within the plow head blade (moldboard) minimizing the wings mechanical moving parts, thus preventing potential failures and maintenance issues and enabling plow head blade (moldboard) to bucket snow, ice and/or other materials into the blower box more proficiently. Preferably, there is at least one wing having a length extending on the horizontal plane ranging from at least greater than one (1) inch; more preferably, the length ranges from about four (4) to sixteen (16) inches or more; most preferably, the length ranges from about twelve (12) to thirty-six (36) inches or more. For airport runway applications, a considerable larger wing may be needed. In such airport runway applications, a wing ranging from about thirty-six (36) to one-hundred and twenty (120) inches or more may be needed. Preferably, there are at least two wings located opposite one another on the plow head blade. It is noted that the ranges can be scaled or otherwise adjusted to accommodate small/large moveable machines/vehicles.

The subject plow head blade has a varied radius of curvature to maximize the production of plowing function. Preferably, the radius of curvature ranges from about one (1) to sixty (60) inches; more preferably, the radius of curvature ranges from about four (4) to twenty-four (24) inches or more; most preferably, the radius of curvature ranges from ten (10) to sixteen (16) inches. It is noted that the ranges can be scaled or otherwise adjusted to accommodate small/large moveable machines/vehicles.

The plow head blade curvature facilitates in permitting the end-user to utilize the plowing function as a high production municipal plow at faster speeds providing greater windrowing (roll) of snow, ice and/or other materials versus slower speeds and control of snow windrowing (roll) useful depending on the density of snow, ice and/or other materials. Articulation of the moldboard and plow head blade and blower box behind it facilitates windrowing/attack angle of the snow. Windrowing/attack angle of the plow head blade is at various angles, limited only by physical constraints/practical limitations, i.e., 35 degrees, whereby permitting the end-user to windrow and manage the blowing of snow more proficiently while in semi-plowing-blowing/throwing mode. Windrowing angles are effectuated by turning the whole moldboard or plow head blade, and preferably range from about one (1) to seventy (70) degrees; more preferably range from about ten (10) to sixty-five (65) degrees; and most preferably range from about twenty-five (25) to fifty (50) degrees, with about thirty-five (35) degrees being the most preferred angle. Guides are typically used on plows and blowers, preferably manual mechanical guides. LED guides may also be included by being integrated in or attached to the plow head blade of the subject snow plow-blower. A light rail portion of a light tower is typically used to mount headlights for plows and/blowers. In addition, an LED light bar may be used with the snow plow-blower, and more preferably, a light rail portion of a light tower with an LED light bar may also be integrated or attached to the plow head blade of the subject snow plow-blower.

The blower doors are adapted to move into closed and open configurations. The blower doors are positioned over the snow blower unit cavity to prevent snow from entering the cavity when the blower is off. Optionally, the blower doors move along a track and rest flush against the plow head to open and close. Alternatively, the blower doors are hingedly mounted to pivot to open and closed positions. The blower doors may be constructed to operate as blower blades to direct snow into or away from the blower unit. Alternatively, separate blower blades, external to the snow blower cavity, are provided to optimize snow removal and mitigate jamming/clogging. In one embodiment, tracks are located on the blade head perpendicular and proximate to the blower doors. Moving along the track, the blower doors are adapted to provide open and closed configurations to open and close the aperture of the cavity. Preferably, the tracks are flush against the blade head so that the blower doors lay substantially flat or flush against the blade head. The blower doors may further comprise a hinged joint so that the doors are adapted to pivot open to channel snow into the aperture of the cavity and the blower unit. Alternatively, separate blades/wings may be provided proximate and adjacent to the blower doors.

In another embodiment, the snow blower doors and/or wings further comprise a hinged joint so that the doors and/or wings are adapted to pivot open to channel snow into or away from the aperture of the cavity and the blower unit, thereby providing the end user an efficient means for proficient snow, ice and/or material management.

Preferably the cavity having the aperture with the blower doors is located substantially centrally along the plow head blade.

The blower unit of the snow plow-blower apparatus is appointed to be powered by an engine of a vehicle via hydraulic fluid power hook-up to the vehicle or tractor. Alternatively, the snow plow-blower apparatus includes a blower engine integrated within the blower unit for powering the snow blower unit. Power for the device isn't limited only to hydraulic power, but can, and may be utilized using one or many forms of energy transfer, or power. The energy transfer, or delivery of power can be obtained by the employment of Pneumatic (air/fluid) Power, Internal Combustion Engine Power (i.e., gasoline, diesel, biodiesel, natural gas, and/or hybrid engines), Electrical Power, Mechanical Energy (direct physical linkage) Power, such as a Power Take Off (PTO), Chemical Energy Power, and/or Electromagnetic Energy Power. Horsepower of the blower engine may vary according to the commercial size/requirements necessary. For example, for a commercial or municipality commercial grade device, the blower engine should be enough horsepower to accommodate large projects. Different geographical areas will further require greater horsepower and/supplementary scaled engineering to address the snowfall and accumulation specifics for a region. For residential devices, a lower horsepower may be used with supplementary scaled engineering.

Though the device herein is discussed in terms of attachment to a vehicle, such as a truck, bulldozer or tractor, it should be understood that this device may be adaptable to fit on to other movable machines and/or vehicles (large and small); such as lawnmowers (i.e., Toro, Honda, Craftsman), ATV/Utility ATV's, road-vehicles, utility sidewalk traveling vehicles, winter service vehicles, railcars and trains, skid-steer (i.e., bobcat), backhoes, backhoe-loader, backhoe-loader-tractor, Pay loaders and Front end-loaders (i.e., Caterpillar), or any combination of large or small earthmoving type equipment, i.e., motor graders, tractors and bulldozers. Accordingly, the device may be of such a size and construct so that it can be readily attached to a small tractor or lawnmower for residential snow removal.

The wing or wings preferably retract or pivot in line/behind the plow head blade when the wings are disengaged, no longer needed, or when the blade needs to be of a shorter width to fit into smaller plowing areas (i.e., small driveways, parking lots, and the like). Preferably, the at least one wing is on pivot hinges, wherein the hinges provide pivot of at least 90 degrees in front of the plow head blade and at least 90 degrees behind the plow head blade. Optimally, the wing or wings each have separate wing controls so that each can be pivoted separately. With this arrangement, each of the wing or wings can be adjusted to different angles and degrees in relation to one another and in relation to the plow head blade.

The blower blades (or blower doors depending on the embodiment) are on pivot hinges. These pivot hinges provide a pivot range of at least 180 degrees in front of the plow head blade. Like the wing or wings, the blower blades each have separate blower blade controls so that they can be pivoted separately. In this manner, the blower blades can be adjusted to different angles and degrees in relation to one another and in relation to the blower unit and the plow head blade.

Figure 1B:
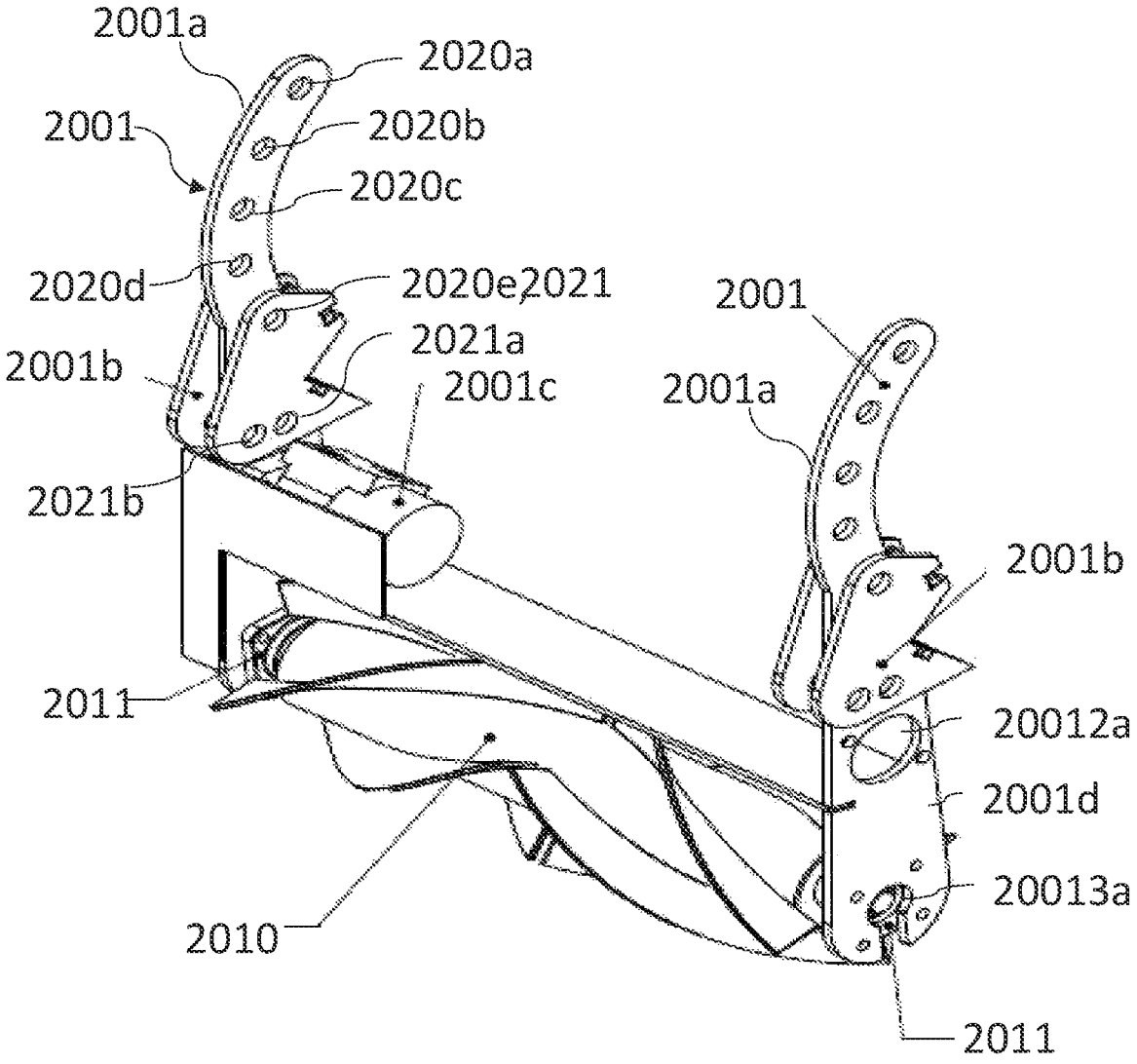
FIG. 1*b* is a top plan view of the embodiment of FIG. 1*a;*
Figure 1C:
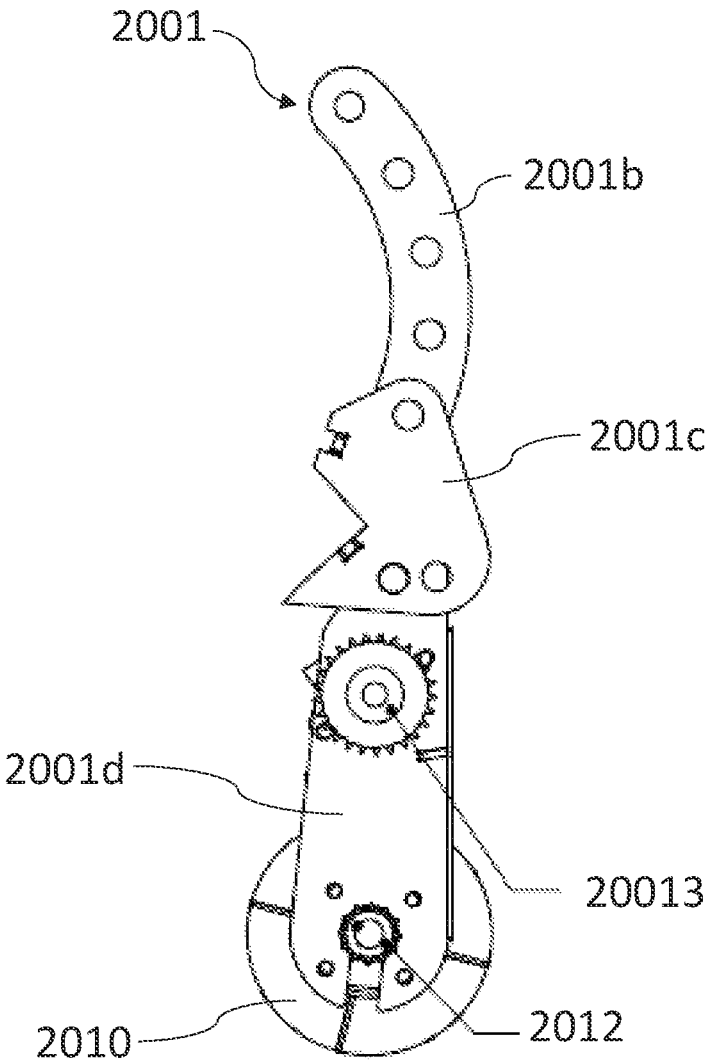
FIG. 1*c* is a side view of an attachment arm of the auxiliary assembly of FIG. 1*a;*

Referring to FIGS. 1*a*-1*c*, FIG. 1*a* is a front plan view of an embodiment of the auxiliary material moving assembly adapted to be mounted on a material moving machine, shown generally at 2000. FIG. 1*b* is a top plan view of the embodiment of FIG. 1*a*. FIG. 1*c* is a side view of an attachment arm of the auxiliary assembly of FIG. 1*a*. The auxiliary material moving assembly 2000 herein shown is a stand-alone assembly adapted to be mounted on a plethora of different material moving machines. These machines include, for non-limiting example, snowplows, snow plow blowers, snowblowers, plows, icebreakers, snow-pushers, snow, dirt, sand sweepers, asphalt machinery, construction/landscape type of equipment/machinery and/or other material moving machinery, devices or units, which can be walk-behind, or vehicle-powered units.

The auxiliary material moving assembly 2000 is constructed having at least one attachment arm 2001 and at least one material moving element 2010. The at least one attachment arm 2001 and/or at least one material moving element 2010 may operate in conjunction with the material moving machine, at the same time, but separately. Alternatively, the auxiliary material moving assembly may operate concomitantly or at the same time and in the same configuration as the material moving machine. Or, alternatively, the auxiliary material moving assembly may operate independently with the material moving machine. In each arrangement, the auxiliary material moving assembly 2000 provides for improved and proficient handling, removal, and management of material when used with the material moving machine.

The stand-alone auxiliary material moving assembly 2000 is adapted to be mounted on a plurality of material moving machines to facilitate and improve the handling, removal and/or management of material. The auxiliary material moving element 2010 comprises one or more snow cutter, snow beater, screw-like auger, auger, ribbon-cutter, rotary fan, impeller, rotary (sweeping) broom, blower, scraper, paddle, or other mechanical device that permits handling, removal and management of snow, ice and/or other materials. Herein, the auxiliary material moving element 2010 is shown as an auger. It is noted that a single auxiliary material moving element 2010 is shown. However, there may be at least two auxiliary material moving elements 2010 (see, i.e., FIG. 3). The auxiliary material moving assembly 2000 may include at least one foldable or rotatable auxiliary moldboard (3050, FIG. 2).

Preferably, as shown, there are at least two attachment arms 2001 and the at least one auxiliary material moving element 2010 is located therebetween. At least two attachment arms (left and right) 2001 can be foldable or rotatable to provide different positions of the auxiliary material moving element 2010 proximal to the material moving machine. Preferably, the at least one attachment arm 2001 is foldable or rotatable (upward and downward) to provide multiple positions and angles of the auxiliary material moving element 2010 proximal to the material moving machine. The rotation preferably ranges from about 1 degree to about 360 degrees from horizontal plan x. The foldable or rotatable operation may be carried out manually, automatically, and/or by use of a controller device. The at least one attachment arm 2001 may comprise a fold-down arm 2001*a*, fold-down hinge 2001*b*, and one or more motor or hydraulic assembly 2001*c* for operational folding or rotating movement as shown via arrow R. Fold-down arm 2001*a* is hinged attached to fold down hinge 2001*b*, which in turn is operable for folding/bending or rotation by way of motor or hydraulic attachment 2001*c*. Attachment arm 2001 fold-down arm 2001*a* is an arched or curved semi-circle and includes position adjustment apertures 2020*a*-2020*e*, preferably five apertures for adjustment positioning. In turn, these adjustment apertures 2020*a*-2020*e* are each correspondingly aligned with fold-down hinge 2001*b* primary hinge aperture 2021, and secondary hinge apertures "in" 2021*a* and "out" 2021*b* for positioning of the assembly on the material moving machine (see, i.e., FIGS. 4*a*-4*g*).

Preferably, arms 2001 are attached horizontally at the horizontal x by support bar 2014 for stabilization. Auxiliary material mover element 2010 is formed as a fold-down auger for positional adjustment during operation, storage and/or transport. Preferably, auxiliary material mover element 2010 is an auger/or other implement attached by way of bearing 2011 attached to lower arm bar support 2001*d*, mounted with driven sprocket 2012 in turn received in sprocket aperture 2012*a*, and drive sprocket weldment 2013 received in drive aperture 2013*a*.

Attachment arm 2001 provides articulation for movement of the auxiliary material moving element 2010 radially angled along the horizontal plan x and movement on vertical plane y for different positions when mounted on the material moving machine. One or more motor or hydraulic assembly and/or any other mechanical advantage device system may be provided for operational folding or rotating movement of the at least one attachment arm 2001 of the auxiliary material moving assembly 2000.

The external/auxiliary material moving element 2010 is preferably interchangeable and can readily be replaced with another auxiliary material moving element 2010 to suit the operator's needs. For example, the external/auxiliary material moving element 2010 may be for non-limiting example, an auger, ribbon, screw-like auger, ribbon-cutter, snow cutter, snow beater, wheel-cutter, rotary fan, impeller, broom, sweeper, sweeper-broom, rotary (sweeping) broom, blower, edge, scraper, edge-scraper, dragger/puller, pusher, paddle, rotating paddle, drum cutter, snow-cutter, ice-breaker and/or any combination mechanical device thereof that permits handling, removal and management of snow, ice and/or other materials, other material mover, and/or mechanical driveline/driveshaft system, and/or any combination thereof whether the moving element coordinate axes is placed relative to any material movable machines coordinate axes (i.e., parallel to its width or x-axis), and/or whether the whole systems coordinate axes are placed relative to any material movable machines coordinate axes/vehicles coordinate axes, a.k.a. its Cartesian coordinate system in a plane: x, y and z axis, respectively, its abscissa, ordinate and applicate coordinates whenever referencing any material moving machine coordinate systems or any vehicle coordinate systems. For example, a moving elements horizontal position (e.g., abscissa or x-coordinate), it's vertical position (e.g., ordinate or y-coordinate), its' orthogonal/perpendicular position (e.g., applicate or z-coordinate), and/or its lateral position/reflective position and/or its diagonal position relative to any of its axes, and/or any combination thereof may be referenced to any material movable machines coordinate system and vice versa within three dimensional Euclidean space (or geometrical cartesian coordinates).

Attachment arm 2001 and auxiliary material moving element 2010 is preferably powered by at least one or more of hydraulic power, electrical power, and other source of power or motor 2001*c*. Additional to movement along the horizontal plane x, the auxiliary material moving element 2010 can rotate or spin in one or more rotational/spinning direction, clockwise and counter-clockwise direction. Furthermore, attachment arm 2001 and visa vie auxiliary material moving element 2010 can have the ability to telescope, extend, bend, fold, retract, slide, and/or rotate about at least one axis, as required for its intended purpose, in any number of degrees of freedom and/or directions, including, but not limited to, the ability to extend, collect/grab, scrape and/or back-drag snow, ice, and/or other materials with an optional protective cover (cap), and/or back-blade.

The auxiliary material moving assembly 2000 is adapted to be mounted on a snow plow-blower (see, i.e., FIG. 3), or other material moving machine/unit. Preferably, the external material moving assembly 2000 is mounted proximal to the snow plow-blower unit's blower door, within the cavity or outside the cavity of the snow blower (see, i.e., FIG. 3).

The auxiliary material moving assembly 2000 may include a timing device for intermittent operation. A controller device is preferably provided having wired or wireless operation. Preferably, the auxiliary material moving assembly 2000 includes at least one electrical, electronic operating Central Processing Unit (CPU), Electrical Panel, Switches, Specific Electronic panel circuitry system for operator end-user control of said auxiliary material moving assembly and/or said material moving machine which it is adapted to be mounted thereon.

Figure 2:
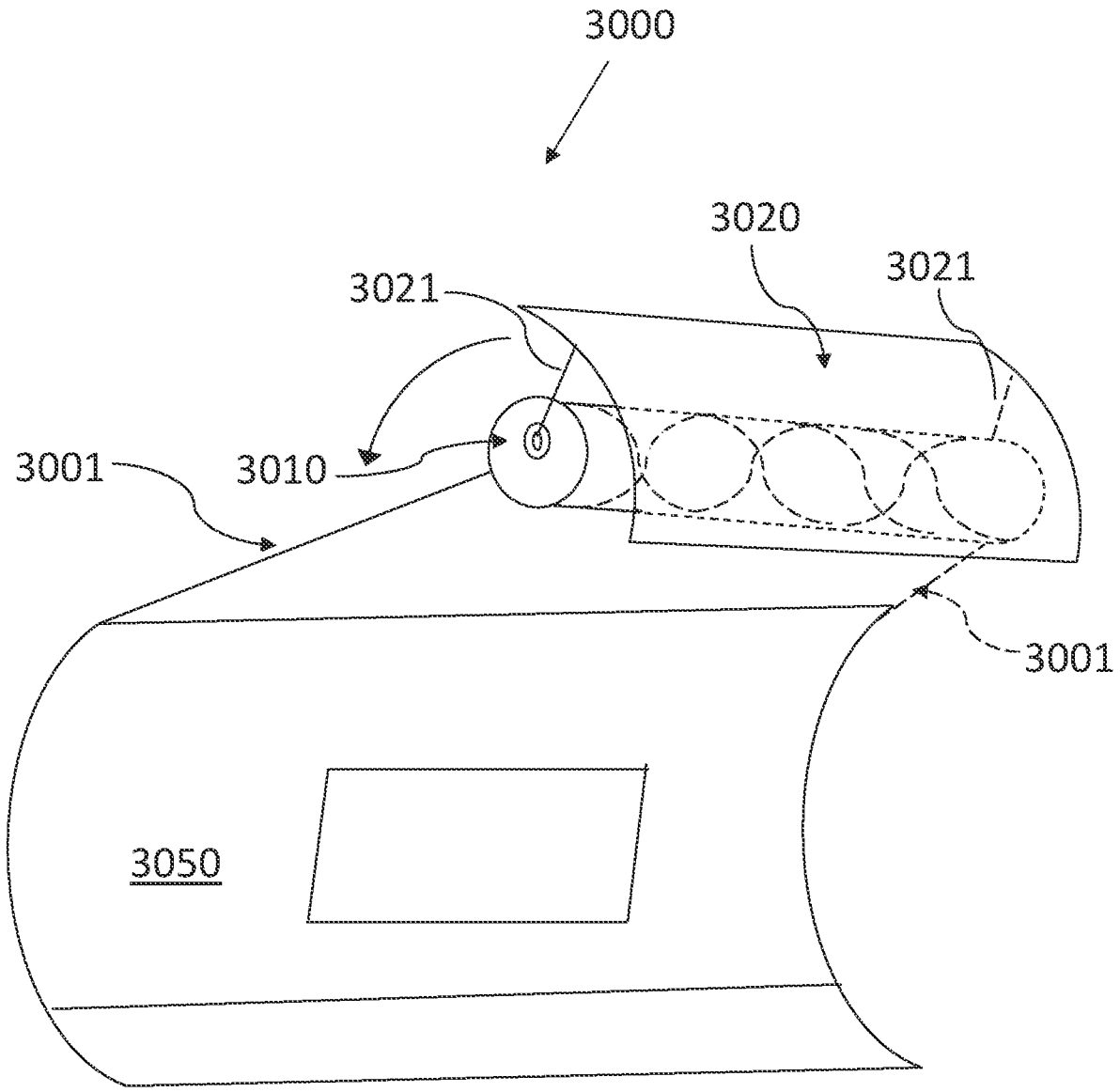
FIG. 2 is a top plan view of an embodiment of the auxiliary material moving assembly with an auxiliary material mover element/auger and a back-blade that can scrape and cover the auger.

FIG. 2 is a top plan view of an embodiment of the auxiliary material moving assembly with an auxiliary material mover element/auger and a back-blade that can scrape and cover the auger, shown generally at 3000. In the embodiment shown, the auxiliary material moving assembly 3000 is mounted on a snow-plow blade/mold board shown generally at 3050 by way of attachment arms 3001. Auxiliary material mover element 3010 is shown in the raised position. In this embodiment, a scraper or back-blade 3020 is hingedly/rotatably mounted with minor foldable arms 3021 on auger/auxiliary material moving assembly 3010 so that the back-blade 3020 can scrape and cover auger/auxiliary material moving assembly 3010.

Figure 3:
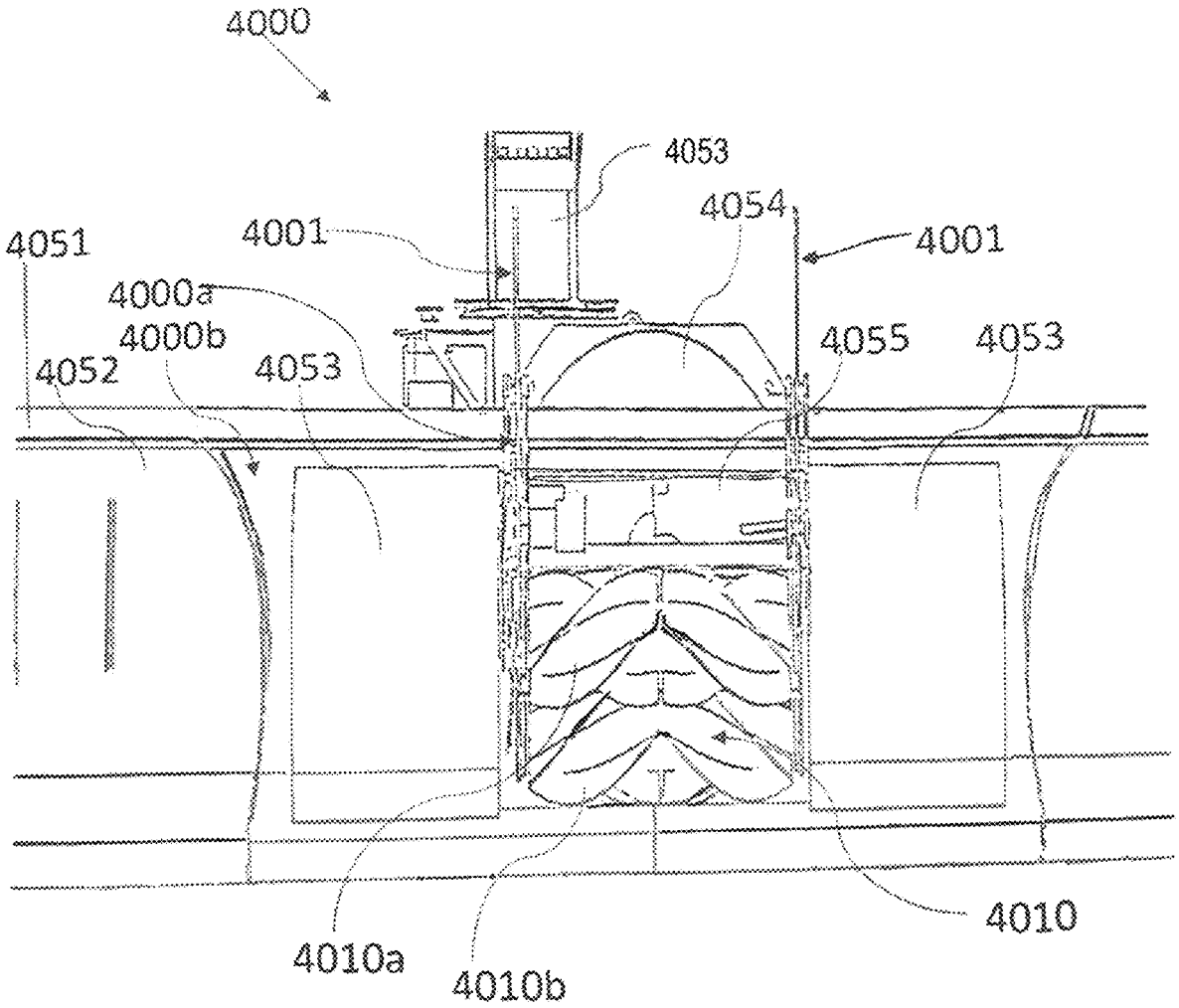
FIG. 3 is a top plan view of an embodiment of the auxiliary material moving assembly with dual auxiliary material mover elements mounted on a snow plow blower.

FIG. 3 is a top plan view of an embodiment of the auxiliary material moving assembly with dual auxiliary material mover elements mounted on a snow plow blower, shown generally at 4000. In this embodiment, an auxiliary material moving assembly 4000*a* is mounted on a material moving machine 4000*b*, shown as a snow plow blower. The auxiliary material moving assembly 4000*a* comprises at least one attachment arm 4001 and at least one auxiliary material moving element 4010. In this embodiment, there are dual/at least two auxiliary material moving elements 4010. Snow plow-blower 4000*b* comprises a plow head blade 4051 with a moldboard 4052; at least one blower door 4053 (herein two blower doors); a snow blower unit 4054 having a cavity 4055 containing snow moving means for moving snow, ice, and other materials out through at least one discharge chute 4056 and/or at least one opening. The blower doors 4053 are adapted to move to an open configuration to expose the cavity, and from the open configuration to a closed configuration to thereby prevent snow, ice, and other material ingress into the snow blower unit. The auxiliary material moving assembly 4000*a* is adapted to operate in conjunction, independently and/or concomitantly with the machine 4000*b* for proficient handling, removal, and management of material.

The assembly includes at least two arms 4001 forming a bracket assembly with the material moving implement/element 4010 located therebetween. This figure shows an example of a dual auger/cutter, arranged in upper auger 4010*a* and lower auger 4010*b* positions. Herein, the upper and lower augers 4010*a*, 4010*b* are arranged substantially parallel to one another, and substantially perpendicular to the attachment arms 4001. The figure also shows the auxiliary assembly located in the inner cavity, with the augers 4010*a*, 4010*b* being fixed to blower box walls. The auxiliary material moving assembly 4000*a* is preferably mounted on the moldboard or placed along its sides, behind, beneath, or at a location proximal to the moldboard to assist in the proficient handling, removal and successful management of snow, ice and/or other materials. The auxiliary material moving element 4010 may be located above and outside of the cavity, however, alternatively, the auxiliary material moving element 4010 may be located inside of the cavity. The auxiliary material moving element 4010 may be built on both sides of doors, inside the cavity or outside the cavity.

FIGS. 4*a*-4*h* illustrate views of embodiments of the auxiliary material moving assembly in first and second mounting positions (in and out).

Figure 4A:
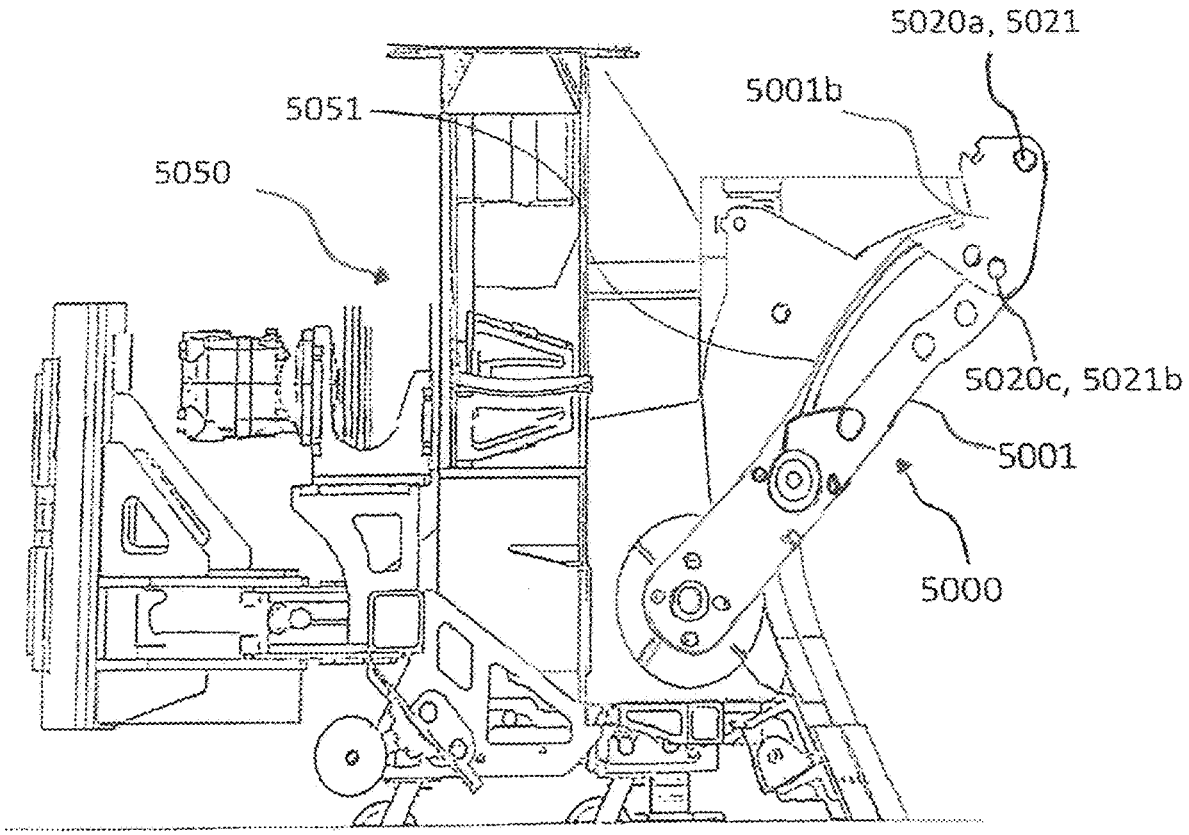
FIG. 4*a* is a side view of an embodiment of the auxiliary material moving assembly in a first position (out)

FIG. 4*a* is a side view of an embodiment of the auxiliary material moving assembly 5000 in a first position (out) to a snow plow-blower 5050 moldboard 5051. In this position, attachment arm 5001 is attached at position adjustment aperture 5020*a* with primary hinge aperture 5021 of fold-down hinge 5001*b*, and position adjustment aperture 5020*c* is aligned and mounted with secondary hinge aperture "out" 5021*b* of fold-down hinge 5001*b* yielding first position—out, of the auxiliary assembly 5000.

Figure 4B:
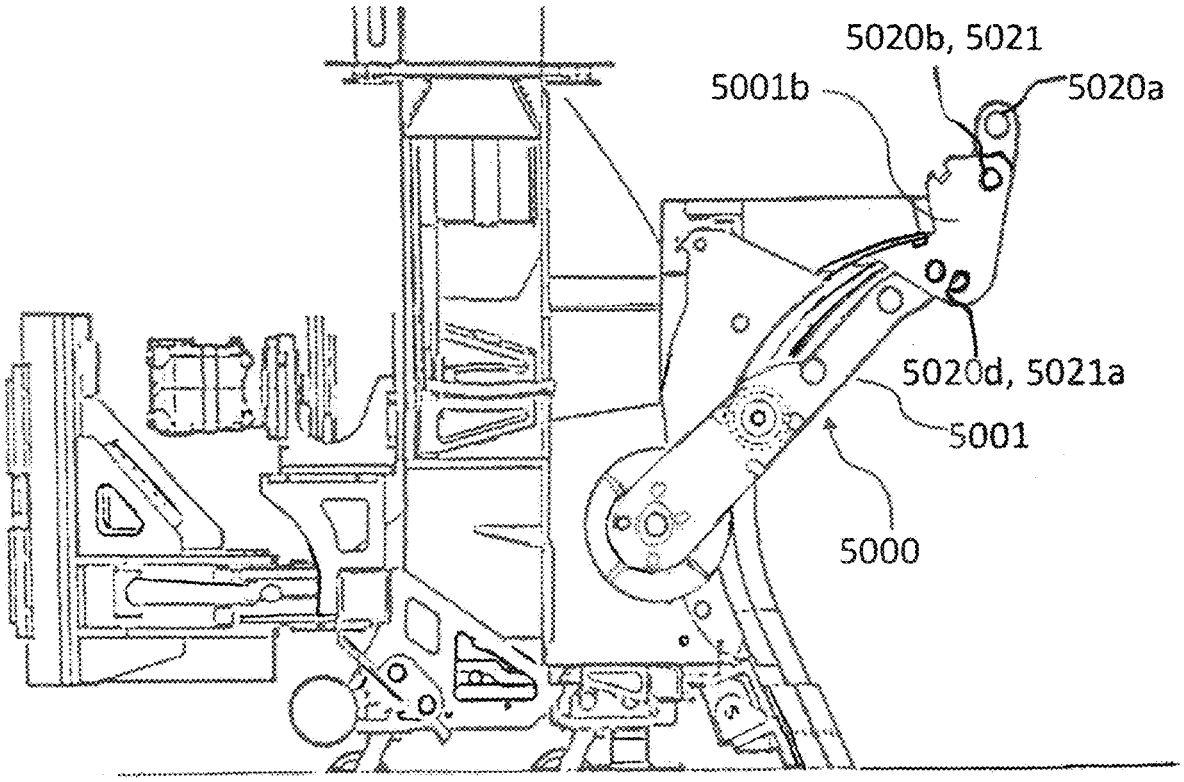
FIG. 4*b* is a side view of an embodiment of the auxiliary material moving assembly in a second position (in)

FIG. 4*b* is a side view of an embodiment of the auxiliary material moving assembly 5000 in a second position (in).

Figure 4C:
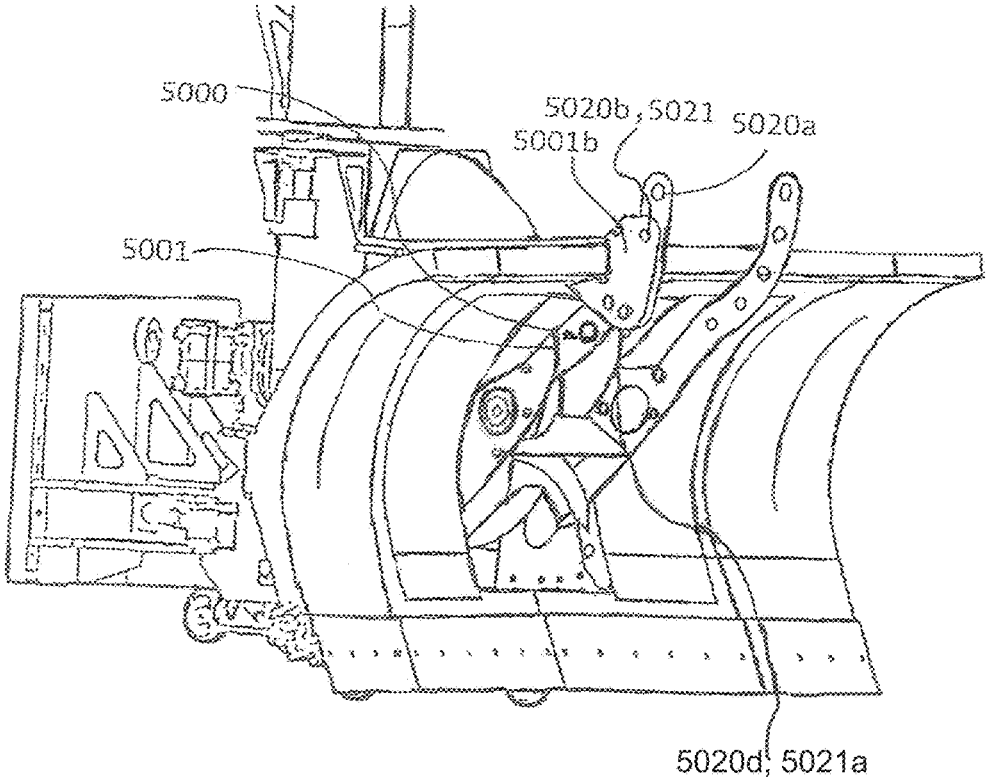
FIG. 4*c* is a bottom side view of an embodiment of the auxiliary material moving assembly in a second position (in)

FIG. 4*c* is a bottom side view of an embodiment of the auxiliary material moving assembly in a second position (in). Referring to FIGS. 4*b* and 4*c*, in this position, attachment arm 5001 is attached at position adjustment aperture 5020*b* with primary hinge aperture 5021, and position adjustment aperture 5020*d* is aligned and mounted with secondary hinge aperture "in" 5021*a* of fold-down hinge 5001*b* yielding the second position—in mount of the auxiliary assembly 5000.

Figure 4D:
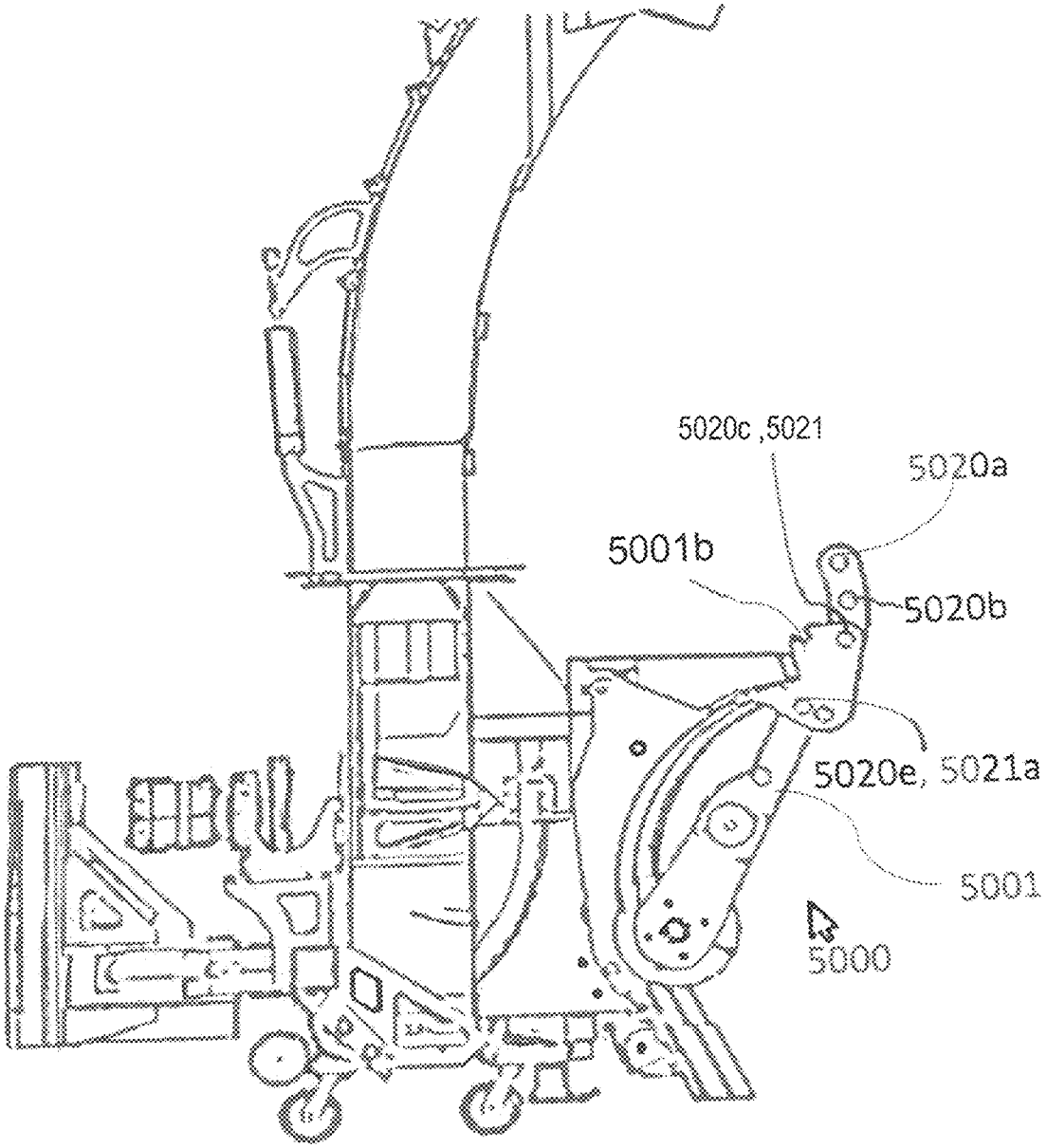
FIG. 4*d* is a side view of an embodiment of the auxiliary material moving assembly in a third position (in)

FIG. 4*d* is a side view of an embodiment of the auxiliary material moving assembly 5000 in a third position (in). In this position, attachment arm 5001 is attached at position adjustment aperture 5020*c* with primary hinge aperture 5021, and position adjustment aperture 5020*e* is aligned and mounted with secondary hinge aperture "in" 5021*a* of fold-down hinge 5001*b* yielding third position—in mount of the auxiliary assembly 5000.

Figure 4E:
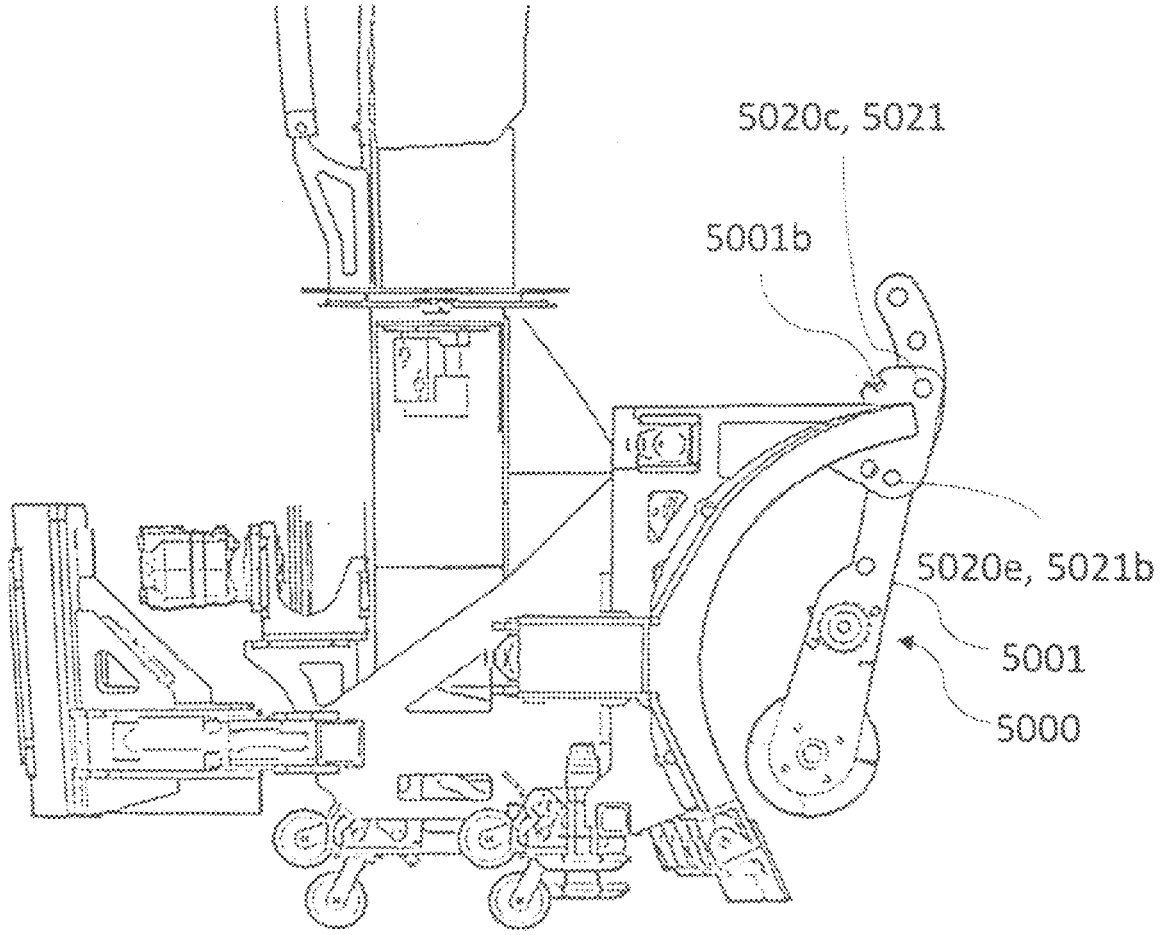
FIG. 4*e* is a side view of an embodiment of the auxiliary material moving assembly in a third position (out)

FIG. 4*e* is a side view of an embodiment of the auxiliary material moving assembly 5000 in a third position (out). In this position, attachment arm 5001 is attached at position adjustment aperture 5020*c* with primary hinge aperture 5021, and position adjustment aperture 5020*e* is aligned and mounted with secondary hinge aperture "out" 5021*b* of fold-down hinge 5001*b* yielding the third position—in mount of the auxiliary assembly 5000.

Figure 4F:
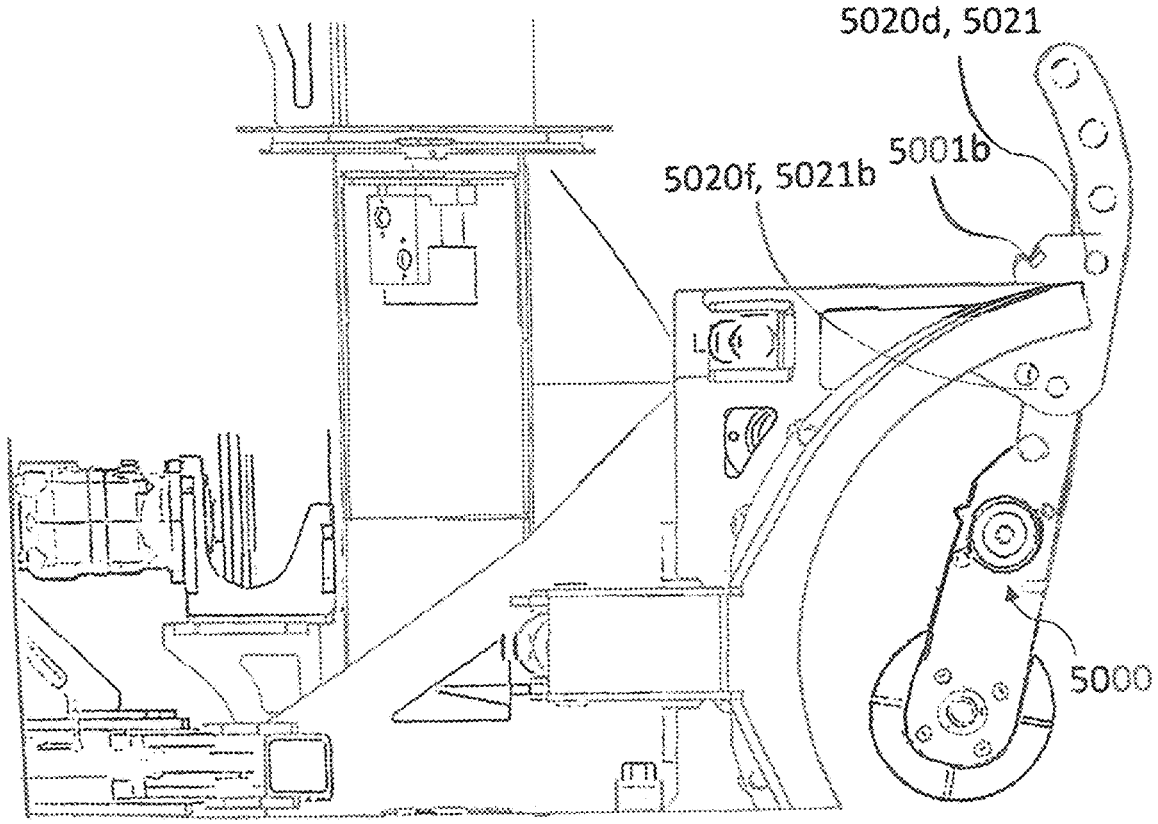
FIG. 4*f* is a side view of an embodiment of the auxiliary material moving assembly in a fourth position (out)

FIG. 4*f* is a side view of an embodiment of the auxiliary material moving assembly 5000 in a fourth position (out). In this position, attachment arm 5001 is attached at position adjustment aperture 5020*d* with primary hinge aperture 5021, and position adjustment aperture 5020*f* is aligned and mounted with secondary hinge aperture "out" 5021*b* of fold-down hinge 5001*b* yielding the fourth position—out mount of the auxiliary assembly 5000.

Figure 4G:
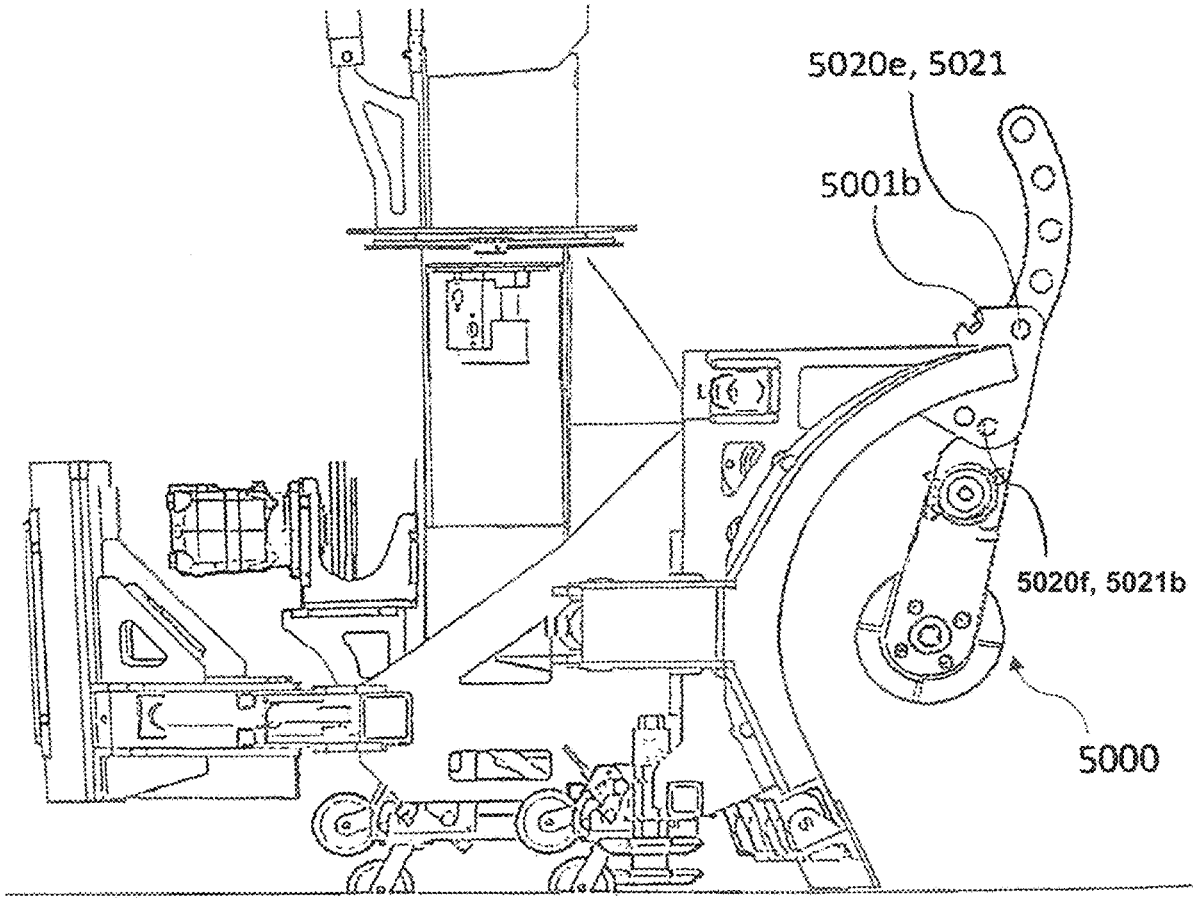
FIG. 4*g* is a side view of an embodiment of the auxiliary material moving assembly in a fifth position (out)

FIG. 4*g* is a side view of an embodiment of the auxiliary material moving assembly 5000 in a fifth position (out). In this position, attachment arm 5001 is attached at position adjustment aperture 5020*e* with primary hinge aperture 5021, and position adjustment aperture 5020*g* is aligned and mounted with secondary hinge aperture "out" 5021*b* of fold-down hinge 5001*b* yielding the fifth position—out mount of the auxiliary assembly 5000.

Figure 4H:
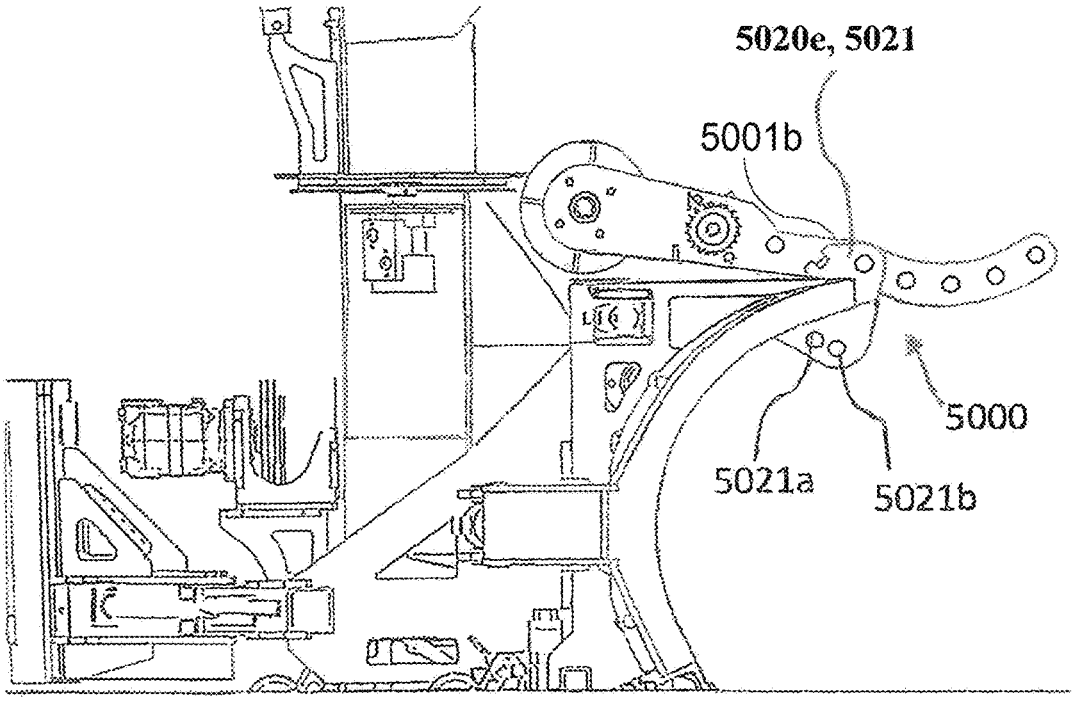
FIG. 4*h* is a side view of an embodiment of the auxiliary material moving assembly in a fifth position, swung up at rest.

FIG. 4*h* is a side view of an embodiment of the auxiliary material moving assembly 5000 in a fifth position, swung up at rest. In this arrangement, the attachment arm 5001 is not connected to secondary hinge aperture "in" or "out", 5021*a*, 5021*b*, respectively. Attachment arm 5001 is attached at position adjustment aperture 5020*e* with primary hinge aperture 5021.

FIGS. 5*a*-5*j* illustrate views of a single auger/auxiliary material mover element of an auxiliary material moving assembly in a fifth position.

Figure 5A:
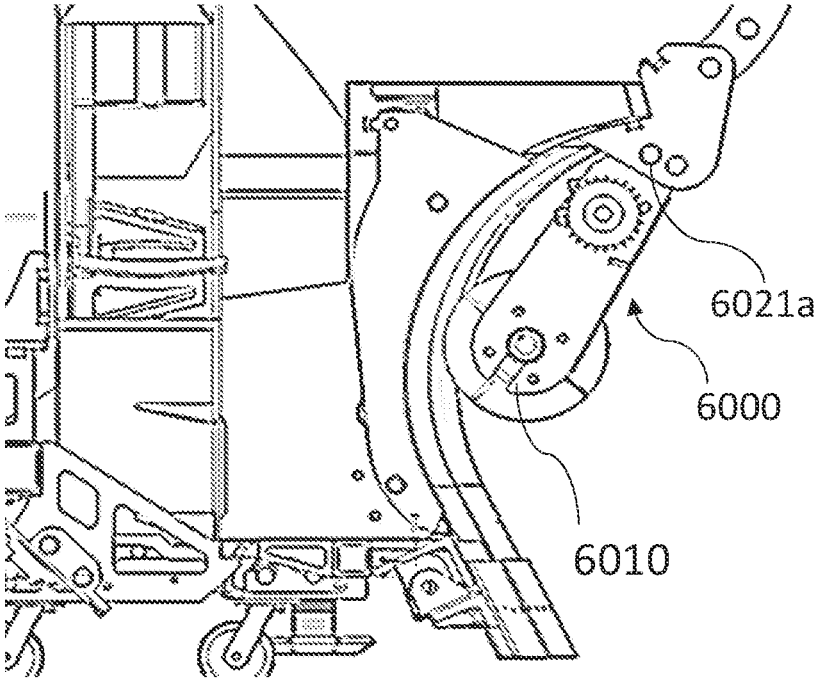
FIG. 5*a* is a side view of an embodiment of a single auxiliary material moving assembly in a fifth position.
Figure 5B:
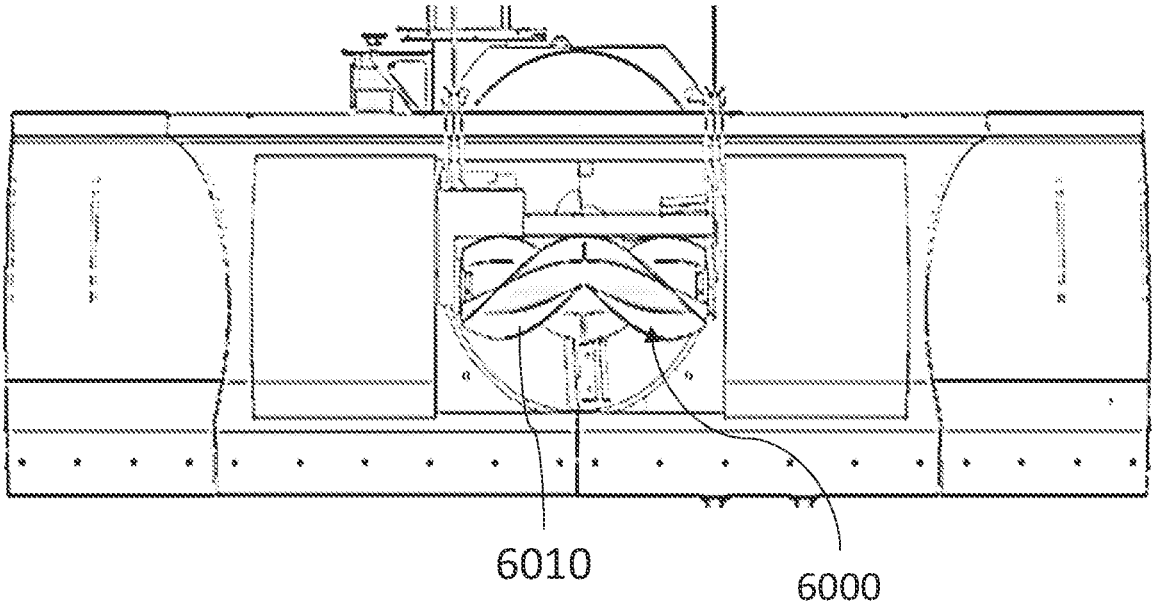
FIG. 5*b* is a front plan view of the auxiliary material moving assembly of FIG. 5*a;*

Referring to FIGS. 5*a* and 5*b*, FIG. 5*a* is a sectional side view of an embodiment of a single auxiliary material moving assembly 6000 in a fifth position. In this view, a single external/auxiliary assembly with an auger-cutter/auxiliary material mover 6010 element bolted to the fifth position—inside bolt hole/aperture 6021*a*. FIG. 5*b* is a front plan view of the auxiliary assembly 6000 of FIG. 5*a*.

Figure 5C:
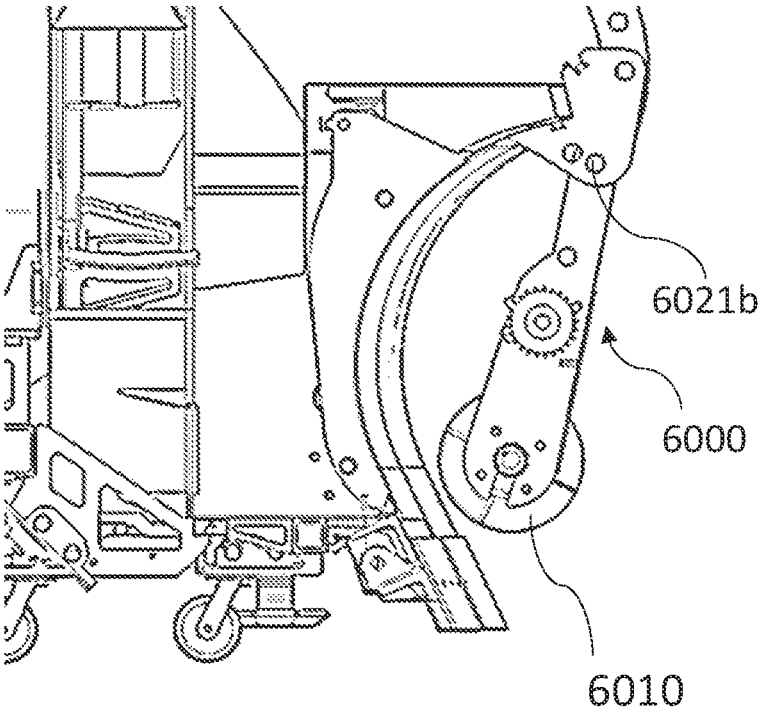
FIG. 5*c* is a side view of an embodiment of a single auxiliary material moving assembly in a third position, outside bolt hole.
Figure 5D:
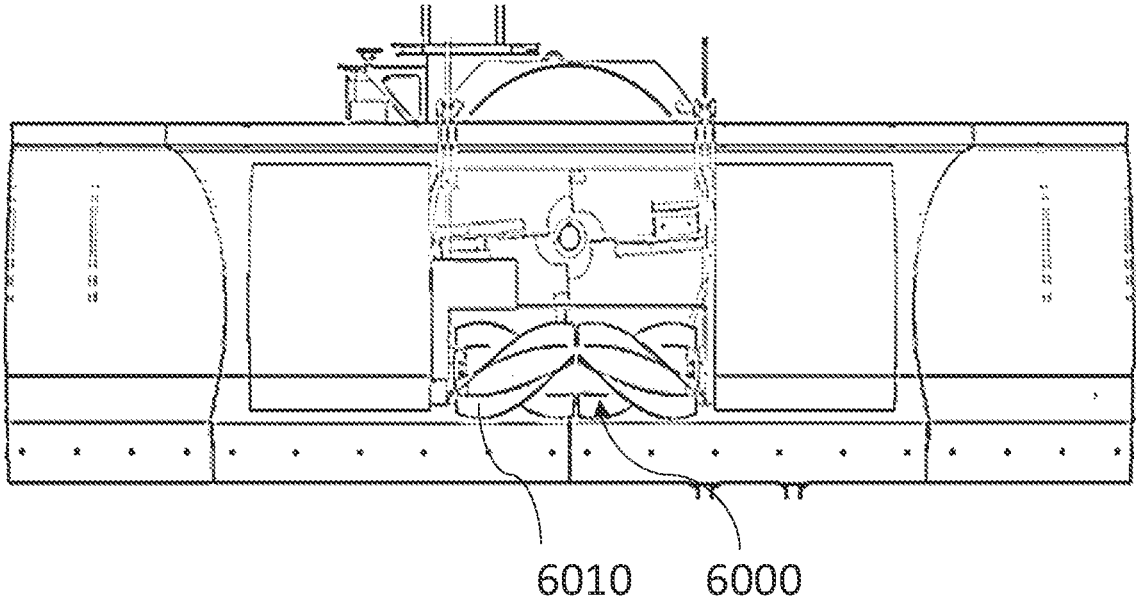
FIG. 5*d* is a front plan view of the assembly of FIG. 5*c;*

Referring to FIGS. 5*c* and 5*d*, FIG. 5*c* is a side view of an embodiment of a single auxiliary assembly 6000 in a third position, outside bolt hole. In this view, a single auxiliary assembly with an auger-cutter/auxiliary material mover 6010 element bolted to the third position—outside bolt hole/aperture 6021*b*. FIG. 5*d* is a front plan view of the assembly 6000 of FIG. 5*c*.

Figure 5E:
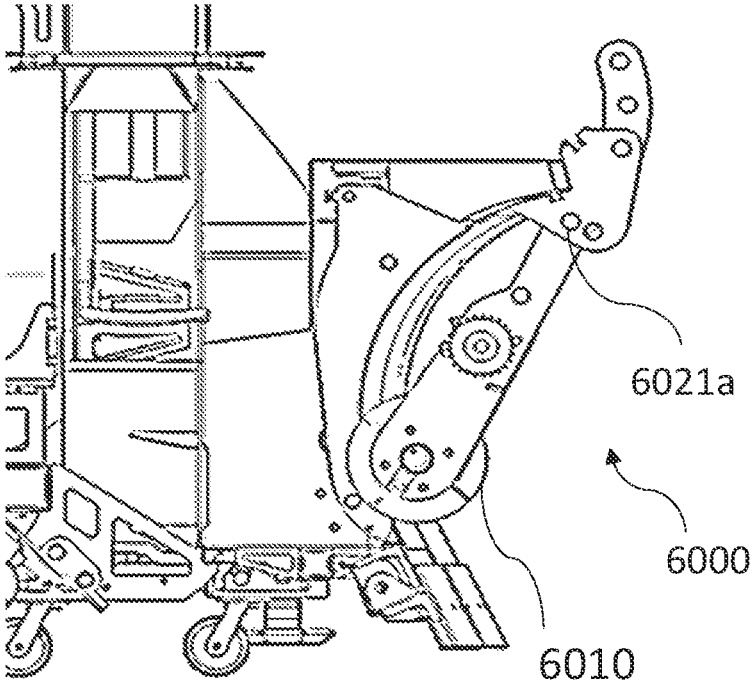
FIG. 5*e* is a side view of an embodiment of a single auxiliary material moving assembly in a third position, inside bolt hole.
Figure 5F:
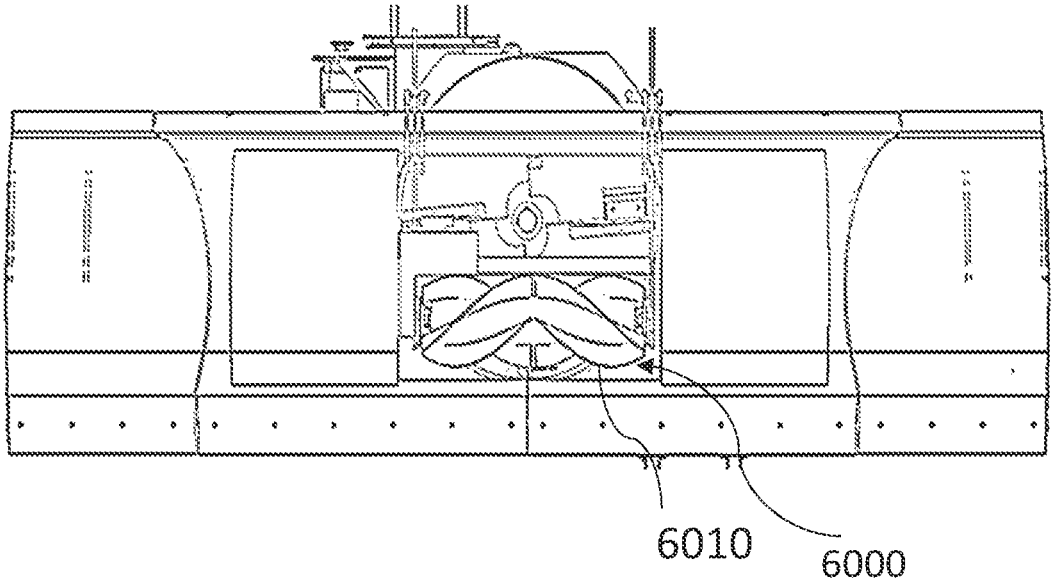
FIG. 5*f* is a front plan view of the assembly of FIG. 5*e;*

Referring to FIGS. 5*e* and 5*f*, FIG. 5*e* is a side view of an embodiment of a single auxiliary material moving assembly 6000 in a third position, inside bolt hole. In this view, a single auxiliary assembly with an auger-cutter/auxiliary material mover 6010 element bolted to the third position—inside bolt hole/aperture 6021*a*. FIG. 5*f* is a front plan view of the assembly 6000 of FIG. 5*e*.

Figure 5G:
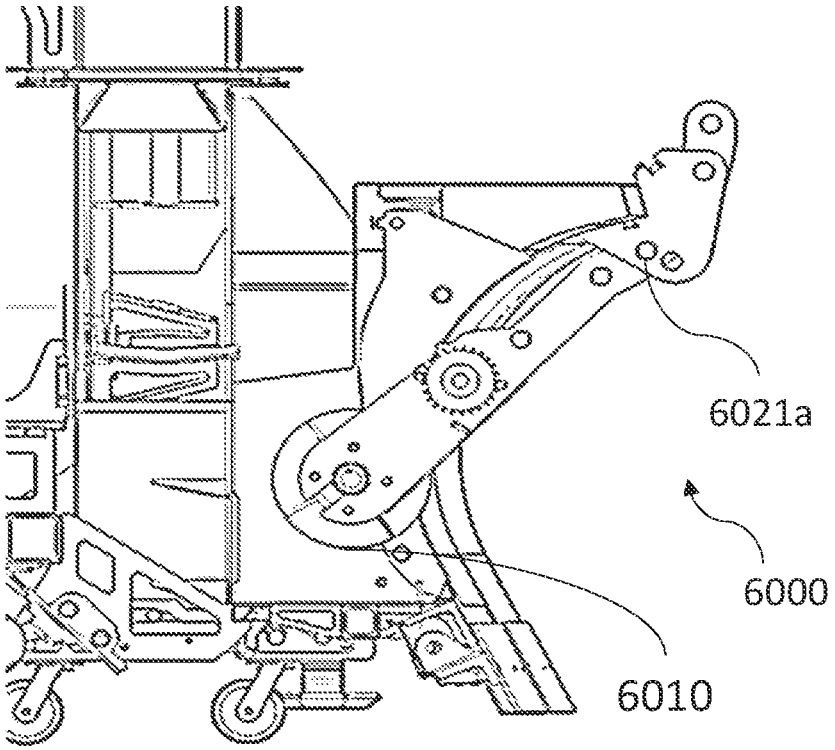
FIG. 5*g* is a side view of an embodiment of a single auxiliary material moving assembly in a second position, inside bolt hole.
Figure 5H:
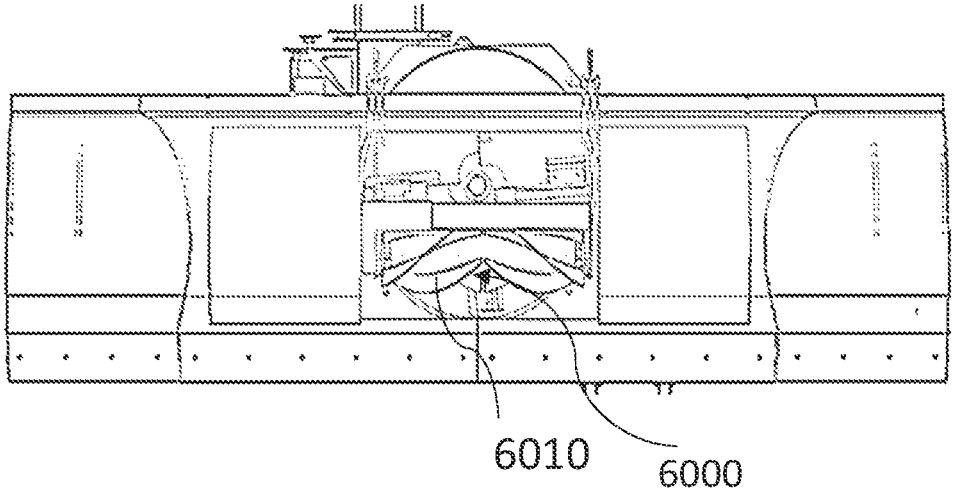
FIG. 5*h* is a front plan view of the assembly of FIG. 5*g;*

Referring to FIGS. 5*g* and 5*h*, FIG. 5*g* is a side view of an embodiment of a single auxiliary material moving assembly 6000 in a second position, inside bolt hole 6021*a*. FIG. 5*h* is a front plan view of the assembly of FIG. 5*g*.

Figure 5I:
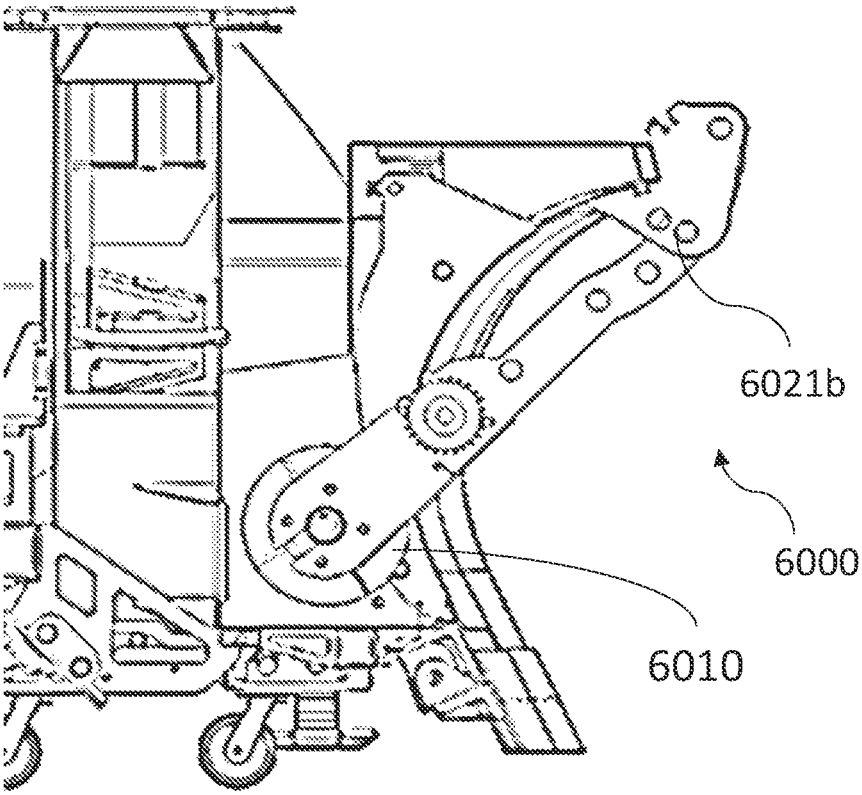
FIG. 5*i* is a side view of an embodiment of a single auxiliary material moving assembly in a second position, outside bolt hole.
Figure 5J:
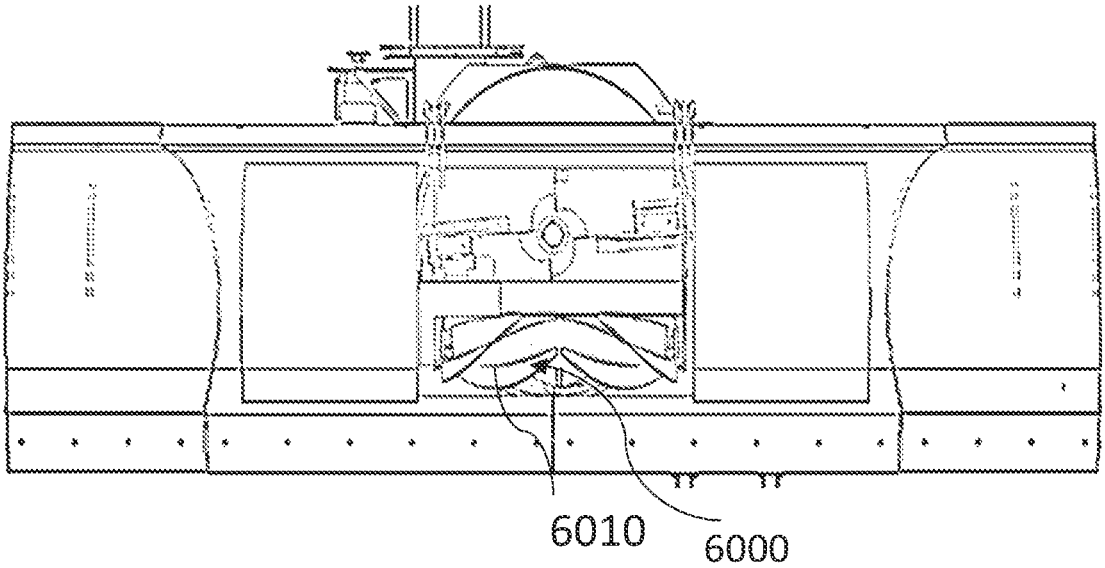
FIG. 5*j* is a front plan view of the assembly of FIG. 5*i;*

Referring to FIGS. 5*i* and 5*j*, FIG. 5*i* is a side view of an embodiment of a single auxiliary material moving assembly 6000 in a second position, outside bolt hole 6021*b*. FIG. 5*j* is a front plan view of the assembly of FIG. 5*i*.

Figure 6A:
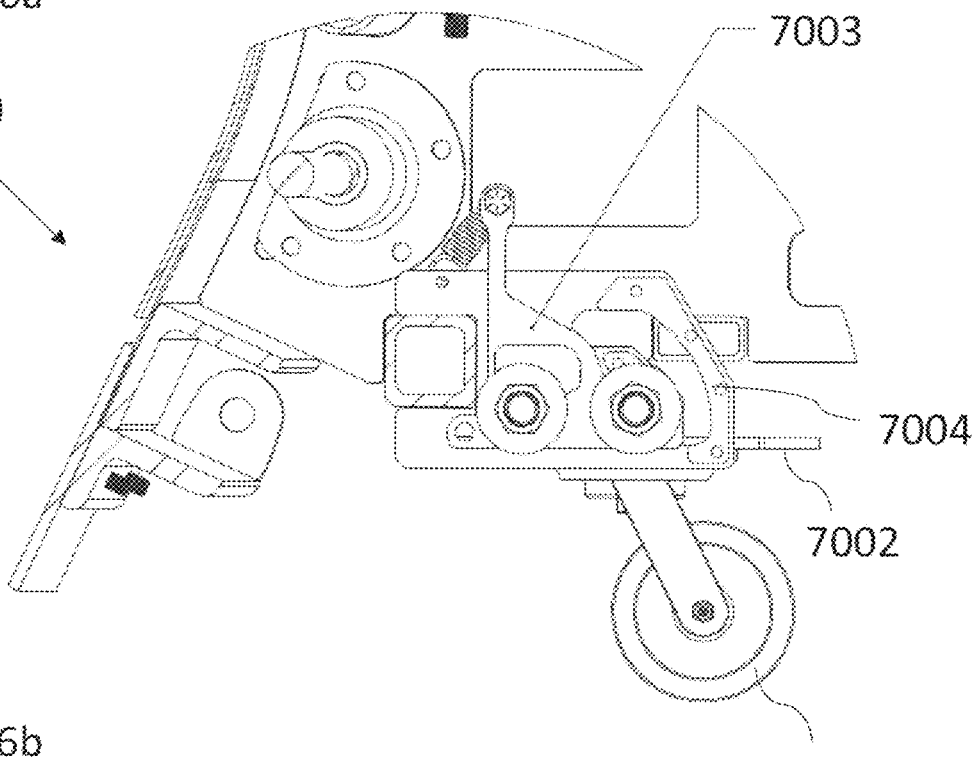
FIG. 6*a* is a side view of an embodiment of a wheel/caster assembly.
Figure 6B:
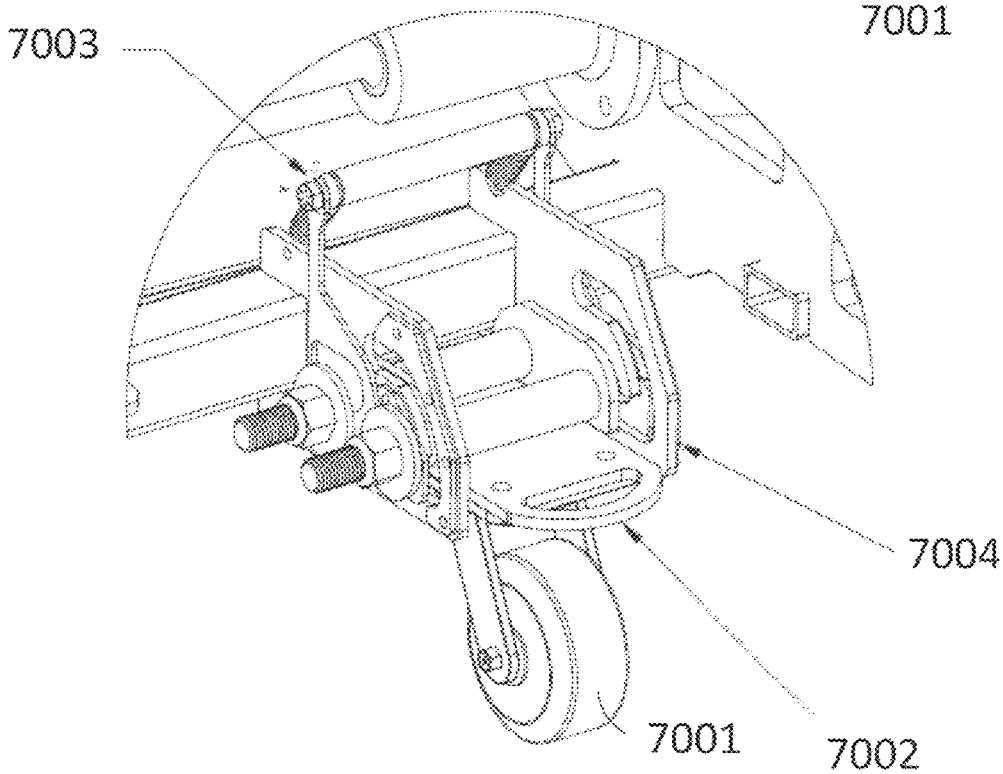
FIG. 6*b* is a top plan view of the wheel/caster assembly of FIG. 6*a;*

FIG. 6*a* is a side view of an embodiment of a wheel/caster assembly 7000. FIG. 6*b* is a top plan view of the wheel/caster assembly of FIG. 6*a*. The wheel/caster assembly 7000 includes a wheel 7001 mounted on a footplate 7002 with bar bracket 7004 with rotatable locking bar 7003. When locking bar 7003 is in the upward position, wheel 7001 is free to rotate. Conversely, when locking bar 7003 is in the downward position, wheel 7001 is in the locked position.

Figure 7A:
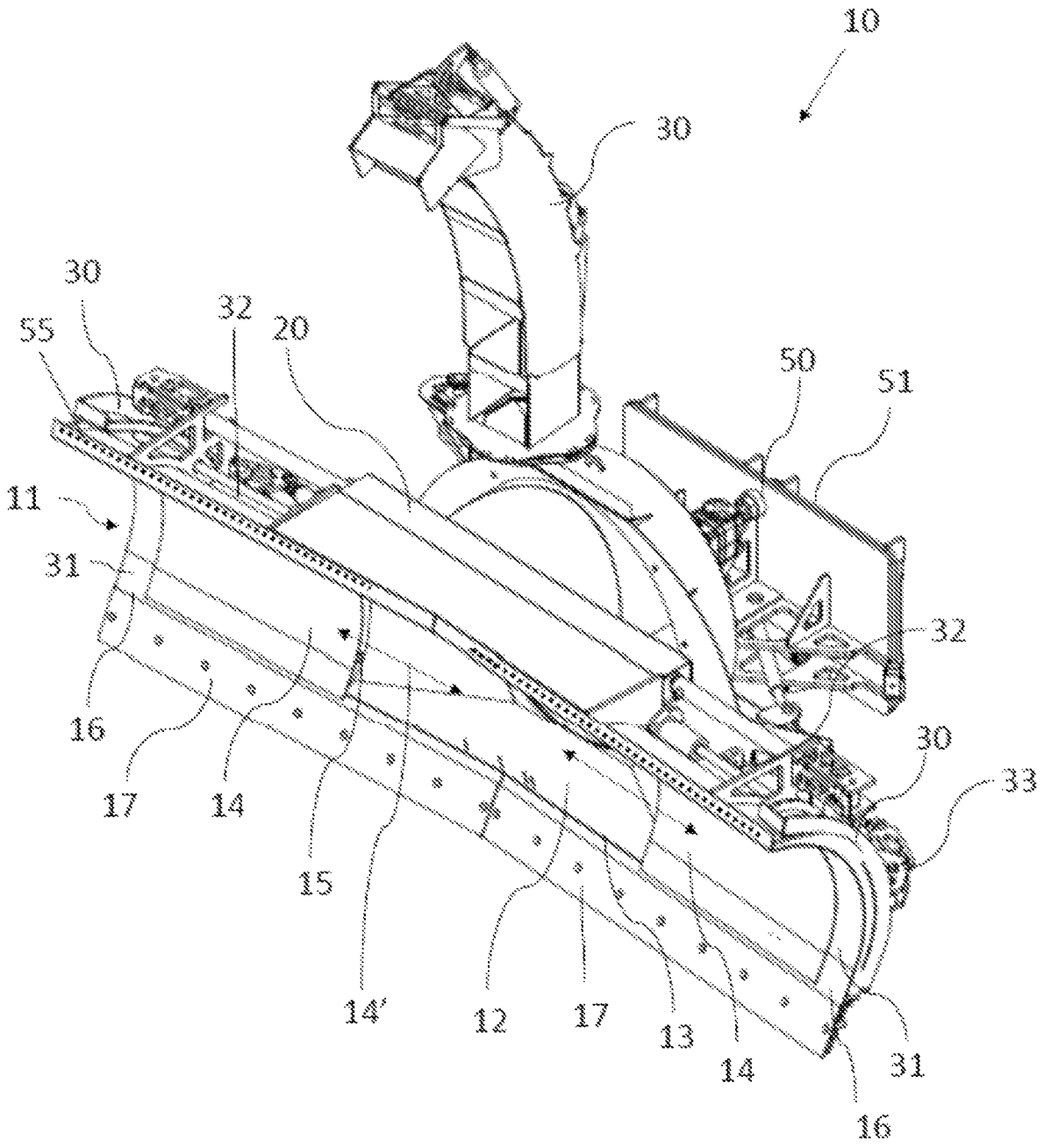
FIG. 7*a* illustrates a schematic view of an embodiment of a plow assembly of the snow plow-blower with blower doors in an open configuration exposing a snow-blower cavity, and the wing or wings in a retracted configuration.
Figure 7B:
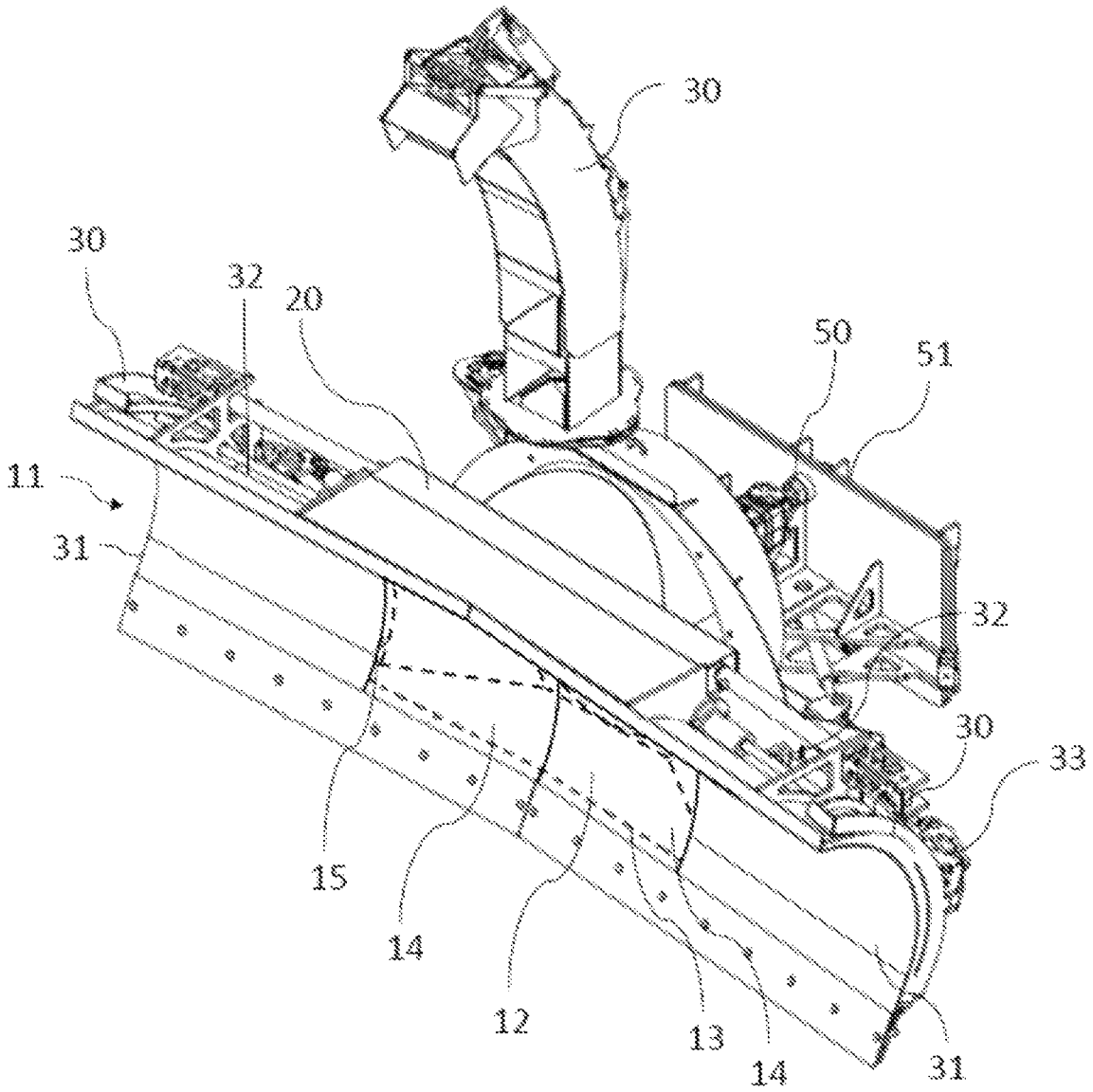
FIG. 7*b* illustrates the schematic view of FIG. 7*a* with the blower doors in a closed configuration closing the snow-blower cavity, and the wing or wings in the retracted configuration.

Referring to FIGS. 7*a*-7*b*, there is shown generally an embodiment of a snow plow-blower apparatus of the present invention appointed to be mounted on a vehicle/machinery or other carrier device. FIG. 7*a* illustrates a schematic view of an embodiment of a plow assembly of the snow plow-blower with blower doors in an open configuration exposing a snow-blower cavity, and the wing or wings in a retracted configuration, shown generally at 10. FIG. 7*b* illustrates the schematic view of FIG. 7*a* with the blower doors in a closed configuration closing the snow-blower cavity, and the wing or wings in the retracted configuration.

In the embodiment shown in FIGS. 7*a* and 7*b*, the snow plow-blower 10 generally includes a plow head blade 11 with a cavity 12 integrated therein, preferably centrally, having an aperture 13 with blower doors 14. FIG. 7*a* shows the blower doors 14 in an open configuration, exposing/opening aperture 13 and cavity 12. Cavity 12 includes a snowblower unit 20 integrated and housed therein. FIG. 7*b* shows the blower doors 14 in a closed configuration, preferably completely sealing shut aperture 13 and cavity 12 so that no snow, ice and water, particles or debris can enter cavity 12 and consequently snow blower unit 20. Snow-blower unit 20 is in communication with a power source and is adapted to move snow, ice and/water, and/or other materials through the snow plow-blower 10 and force it out of at least one discharge chute 30 and/or at least one opening.

The blower doors 14 are adapted to move into open and closed positions/configurations, as shown in FIGS. 7*a* and 7*b*, respectively. In one embodiment, blower doors 14 are adapted to move as one with sliding rods in and out of door alignment housing/structural stiffeners/tracks, shown generally at 15 of the plow head blade 11 so that the blower doors 14 can move laterally or horizontally along the horizontal plane as indicated at arrows 14'. Alternatively, as shown in FIG. 9*a*, blower doors 814 may be constructed with mating tongue and groove/or tracks with the plow head blade 811 configured on the vertical plane so that the blower doors 814 can move upward (opening cavity 812) and/downward (closing cavity 812) along the vertical plane. Referring to FIGS. 7*a* and 7*b*, two blower doors 14 are shown. However, the doors may be constructed of more than two blower doors 14 and may be operative to slide or move in a rotational or linear direction. Alternatively, the blower doors 14 may be formed as a single door that covers aperture 13 and cavity 12.

Blower doors 14 are adapted to move from the open configuration to the closed configuration, thereby completely closing and preferably sealing aperture 13 of cavity 12 and preventing all snow, ice, water, and other material ingress into the snowblower 20 when the snowblower 20 is not being utilized. In one embodiment, blower doors 14 may pivot outward from the plow head blade 11 to further channel snow, ice, and debris into cavity 12 and the snowblower 20.

Plow head blade 11 of the snow plow-blower apparatus 10 is preferably attached to a pivot hinge weldment 50 (i.e., weld unit formed by welding together an assembly of pieces), which in turn is attached to a wobble plate weldment 51 for mounting to a vehicle or moveable machine, or other mechanical implement.

Plow head blade 11 further includes two wings 30, each located on opposing side walls 31 of the plow head blade 11. Wings 30 are shown in the retracted or closed configuration in FIGS. 7*a* and 7*b*.

Wing or wings 30 are retractable in relation to the plow head blade 11. Preferably, wings 30 are stowed behind plow head blade 11 and retract/extend due to moveable weldments 132 and 132' of FIG. 8*a*, or moveable weldment 506-509 of FIG. 12*c*, or moveable weldment 600 of FIG. 7*a*, so that the wings 30 slide laterally outward from behind the plow head blade 11. In another configuration (shown in FIG. 10*a*), the plow head blade 11 is literally continued for the lateral length of each of the wings 30 to enlarge the plow head width and height dimensions. In yet another embodiment, the wings 30 may be retractable/extend from an inner cavity of the plow head blade via track and groove, so that the wings 30 travel on an inner track into the inner cavity to be stowed away, forming a pocket-scoop door type configuration. In this embodiment, the wings 30 extend or slide outward from the channel or pocket to open, and conversely retract into the channel or pocket when closed or stowed away for non-use.

Trip edges (left and right) 16 are located on the bottom of the plow head blade 11 as well as along the bottom-most edge of the blower doors 14 and wings 30. The plow head blade further preferably includes a bottom-most scraper blade or replaceable cutting edge (left and right) 17. One or more material scraper(s) may be attached or integrated on the plow head blade 11, preferably attached laterally/above the plow head blade 55, or to the side walls of plow head blade 31 (i.e., mold board top 55 and side edge 31). One or more LED guides or a light bar may be attached or integrated on the plow head blade, as shown at 30. Preferably one or more light bars may be attached or integrated on top of snowblower 20. A light bar configuration can also be mounted to wobble plate assembly 51 and a vehicle or movable machine receiver mount/hitch such as a truck mount (not shown).

Figure 8A:
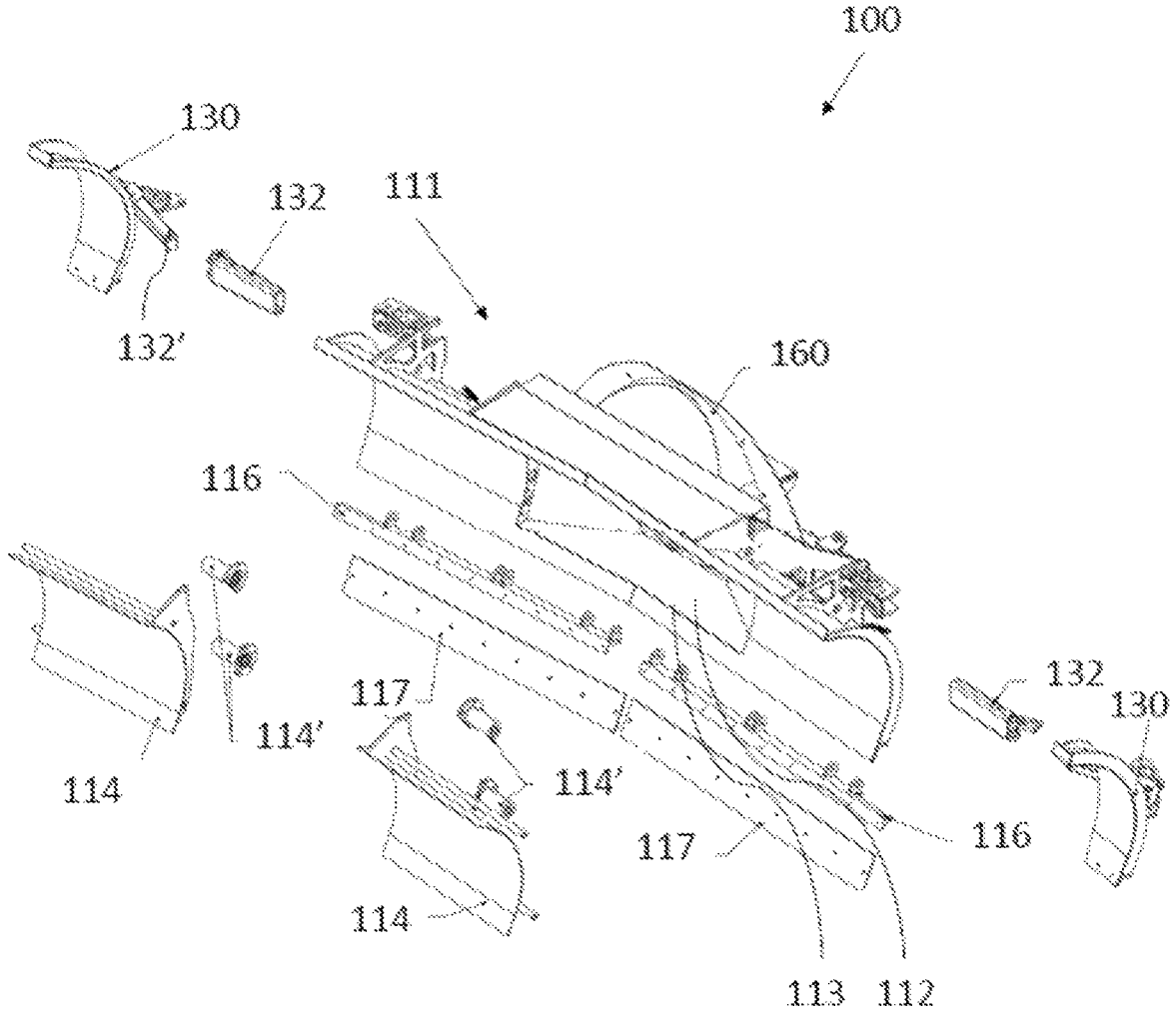
FIG. 8*a* is an exploded view illustrating parts of the assembly of the plow head blade of FIG. 8*a;*
Figure 8B:
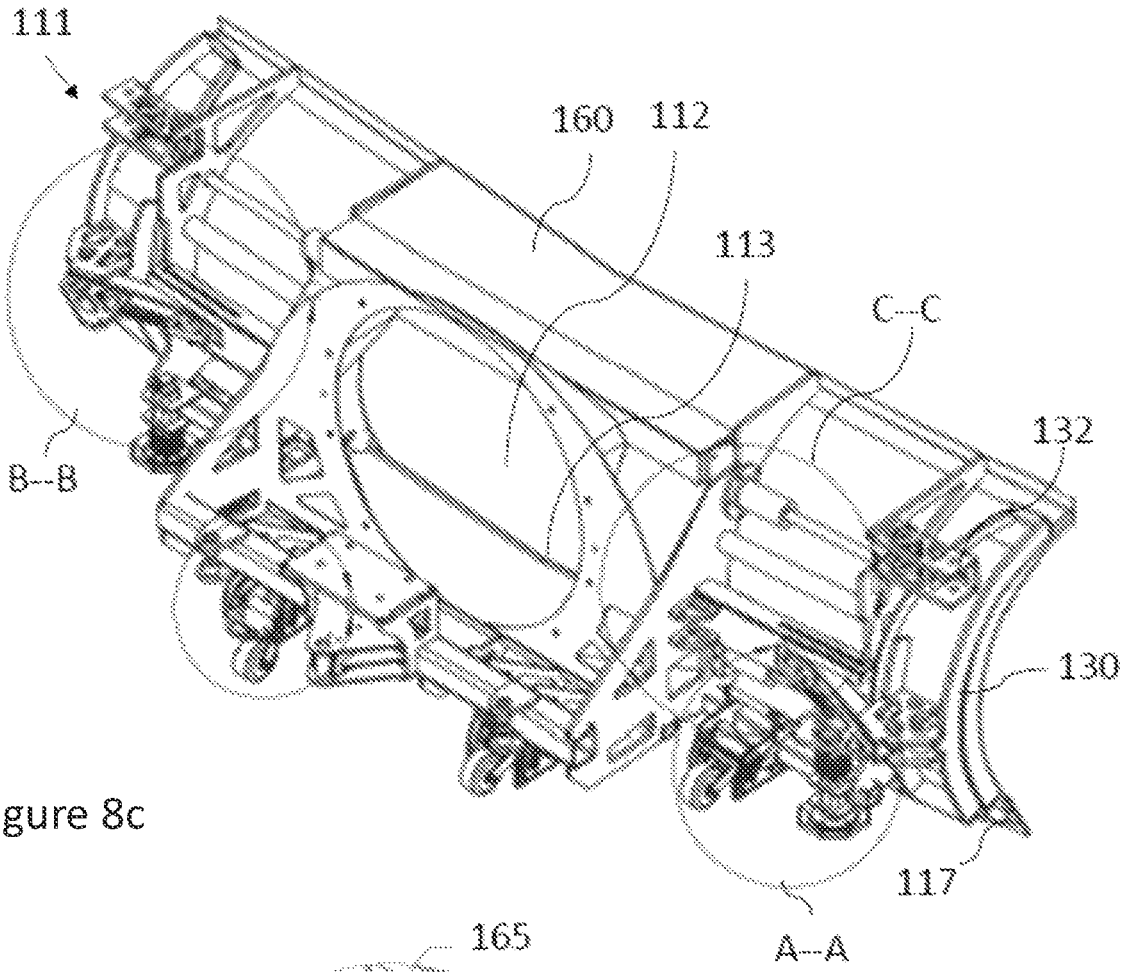
FIG. 8*b* illustrates a schematic back view of parts of the assembly of the plow head blade of FIG. 8*a;*
Figure 8C:
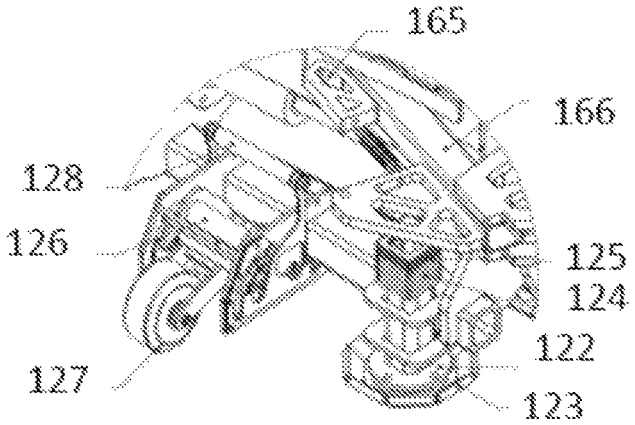
FIG. 8*c* illustrates a cross-sectional view taken at A-A showing a swivel caster wheel assembly on the snow plow blower assembly.
Figure 8D:
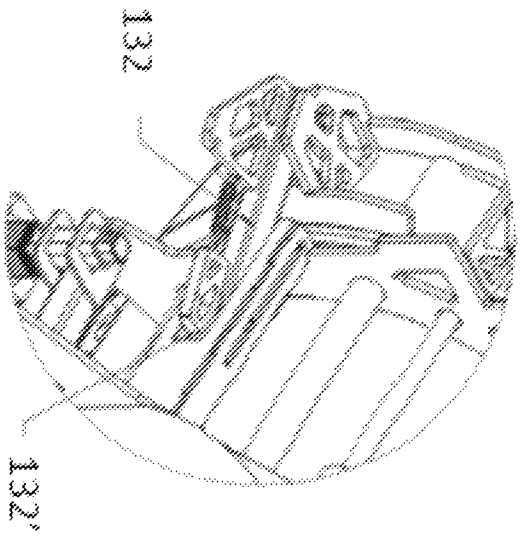
FIG. 8*d* illustrates a cross-sectional view taken at B-B showing a view of the left-wing weldment and wing slide tube weldment.
Figure 8E:
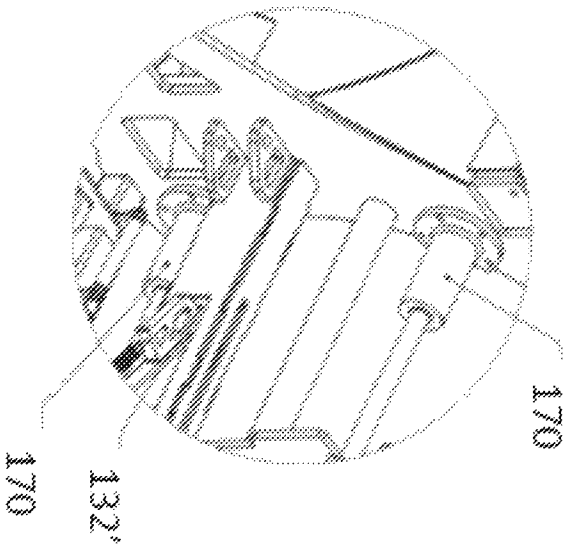
FIG. 8*e* illustrates a cross-sectional view taken at C-C showing a view of the door alignment housing assembly.

FIGS. 8*a*-8*b* illustrate the plow head blade assembly of FIG. 7*a*. FIG. 8*a* illustrates a schematic front view of parts of the plow head blade assembly of FIG. 7*a*, shown generally at 100. FIG. 8*b* illustrates a schematic back view of parts of the assembly of the plow head blade of FIG. 7*a*. FIG. 8*c* illustrates a cross-sectional view taken at A-A showing a swivel caster wheel assembly on the plow head blade apparatus. FIG. 8*d* illustrates a detailed view taken at B-B showing a view of the left-wing weldment and wing slide tube weldment. FIG. 8*e* illustrates a detailed view taken at C-C showing a view of the door alignment housing weldment assembly 170 of FIG. 8*e* and moveable wing weldment 132.

Referring to FIGS. 8*a*-8*e*. Plow head blade 111 is preferably formed via plow structural frame weldments: 403-405, 414 of FIG. 11*b*, 403-405, 408, 414 of FIG. 11*c* and 403-406 of FIG. 11*d* and 503-505 of FIG. 12*b*, or a unit formed by welding together an assembly of pieces and includes an aperture/opening 113 and a cavity 112 adapted to house a snow blower unit. Left and right blower doors 114 weldments are preferably formed and adapted to be mounted on plow head blade 111 via door alignment housing weldment assembly 114'. Left and right trip edge/blade assemblies, 116, are mounted on plow head blade 111, and structural frame weldment 414 of FIG. 11*b*. In turn, a replaceable scraper blade/edge 117 is mounted on the left and right trip edge blades 116. Wing slide tube weldments (left and right) 132 are formed as grooves or rectangular or tubing elements adapted to receive a tong/tongue/tube insert 132' of a wing 130 so that the wing 130 can retract and/or extend from slide tube weldments 132 mounted on plow head blade 111 for lateral extension/retraction positions of the wings 130 from the plow head blade 111. FIG. 8*c* illustrates a cross-sectional view taken at A-A showing a swivel caster wheel assembly on the plow head blade. Preferably, at least four (4) swivel caster wheel assemblies are mounted on the plow head blade 111. Wing slide tube weldment 165 and right (and left) wing weldment 166 are mounted on plow head blade 111. Skid shoe leg-plate weldment 122, skid shoe weldment 123, skid shoe shim 124, skid shoe thin shim 125, caster wheel mount weldment 126, swivel caster 4 in polyurethane wheel 127, which can alternatively be comprised of steel, rubber or other suitable material, and front caster lock assembly 128 are assembled to form the swivel caster wheel assembly. FIG. 8*d* illustrates a detailed view taken at B-B showing a view of the (left) wing weldment 132 and wing slide tube weldment 132'. FIG. 8*e* illustrates a detailed view taken at C-C showing a view of the door alignment housing assemblies 170 and wing slide tube weldment 132'.

Figure 9:
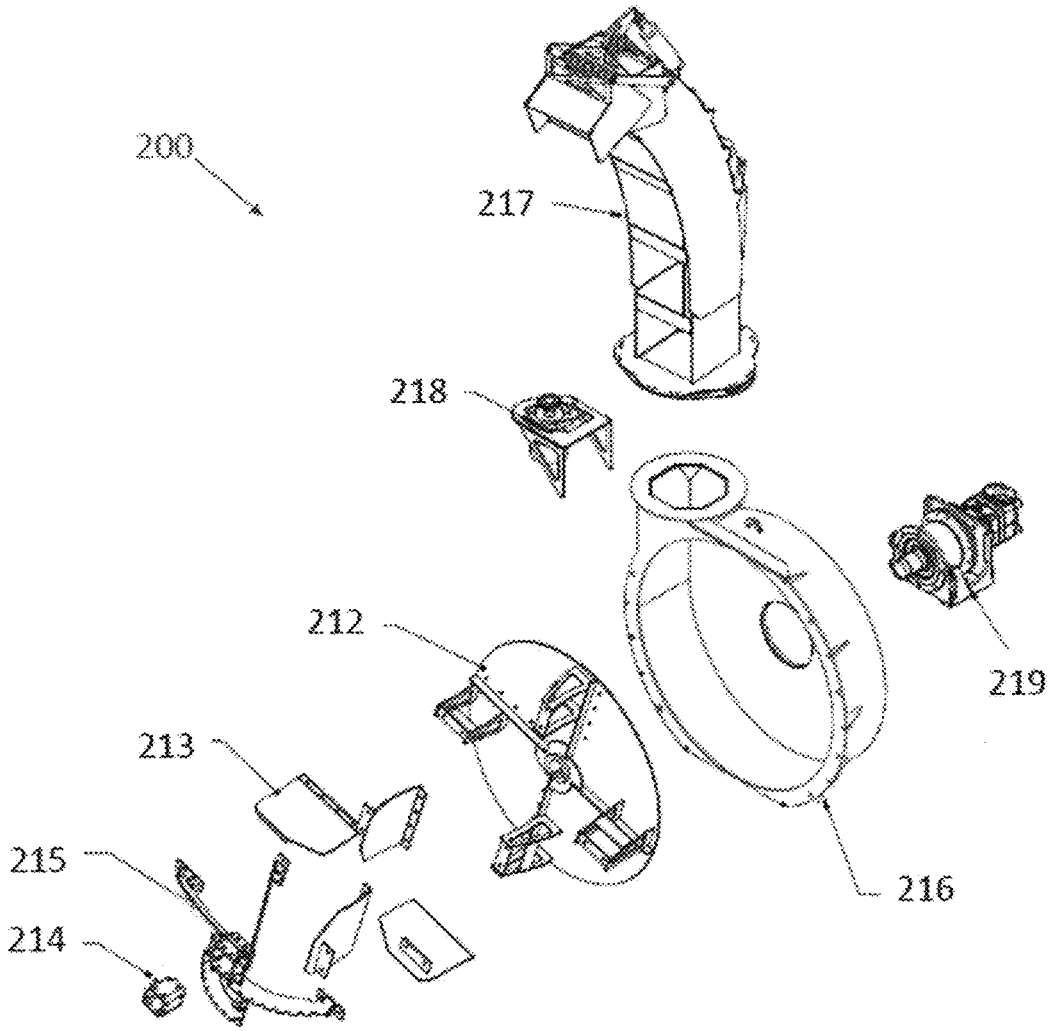
FIG. 9 is an exploded view illustrating parts of the assembly of a rotary blower of an embodiment of a snow plow-blower of the subject invention.

FIG. 9 illustrates an exploded front isometric view of parts of the assembly of a blower of an embodiment of a snow plow-blower of the subject invention, shown generally at 200. Blower 200 assembly is preferably constructed having a telescoping chute assembly 217 mounted in association with a chute motor mounting assembly 218 and hydraulic motor drive assembly 219. A volute weldment 216 houses chute motor mounting assembly 218, motor drive assembly 219, and fan weldment 212 with preferably 8 in fan blade weldment 213, fan knockdown center connector 214 and fan knockdown blade weldment 215.

Figure 10A:
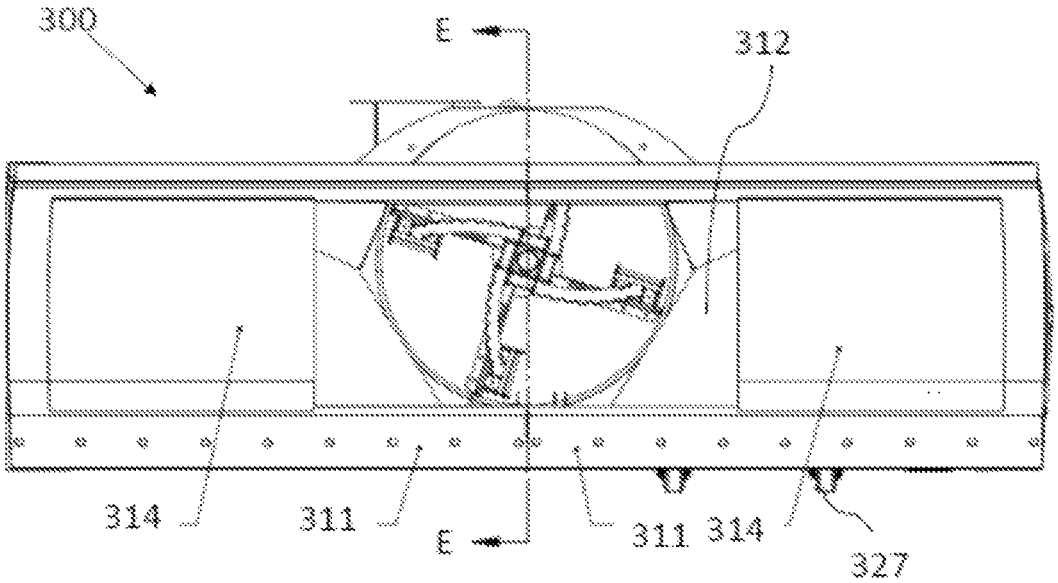
FIG. 10*a* illustrates a front view of the single-stage plow head blade assembly.
Figure 10B:
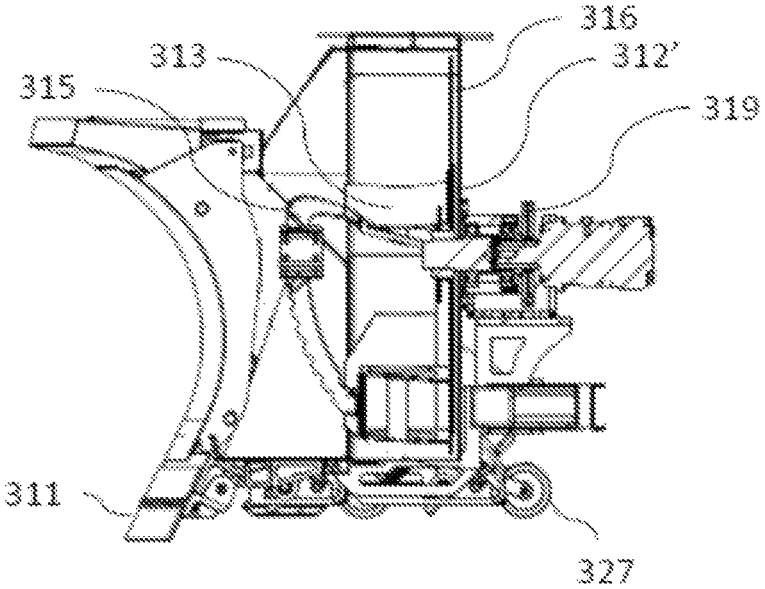
FIG. 10*b* illustrates a cross-section side view taken at E-E of FIG. 10*a;*

FIGS. 10*a*-10*b* illustrate constructs of the plow head blade assembly. FIG. 10*a* illustrates a front view of the plow head blade assembly, shown generally at 300. FIG. 10*b* illustrates an exploded cross-section side view taken at E-E of FIG. 10*a*. Plow head blade 300 includes left and right blower doors 314, preferably formed via weldment. A scraper blade or replaceable cutting edge 311, preferably a left and right scraper blade, is mounted on the bottom edge of the plow head blade 300. Caster wheels 327 (at least one and preferably four) are located on the rear of the plow head blade 300 and/or bottom of the blower box-plow frame weldment. Plow head blade includes a cavity 312, shown exposed as the blower doors 314 are in the open configuration. Cavity 312 houses therein a blower unit generally including a fan weldment 312', an 8 in fan blade weldment 313, a fan knockdown blade weldment 315, a volute weldment 316 and a hydraulic motor drive assembly 319. Fan knockdown blade weldment 315 constitutes a snow moving part which is, optionally, attached to a telescoping shaft and of which the snowbeater is comprised.

Figure 11A:
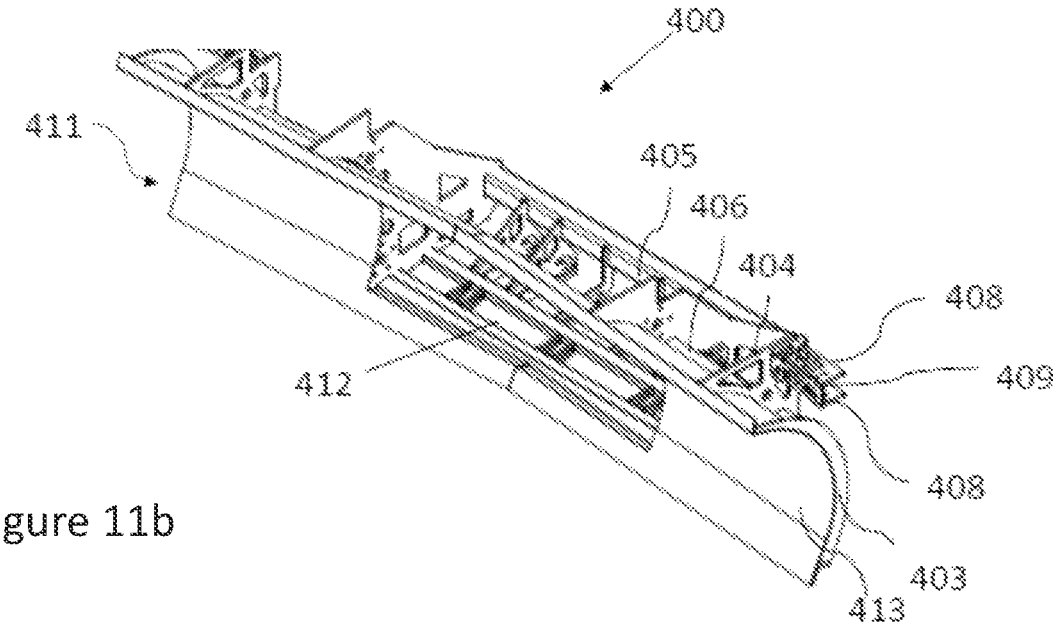
FIG. 11*a* is a front, axonometric view illustrating the left and right-wing of the plow head blade frame weldment.
Figure 11B:
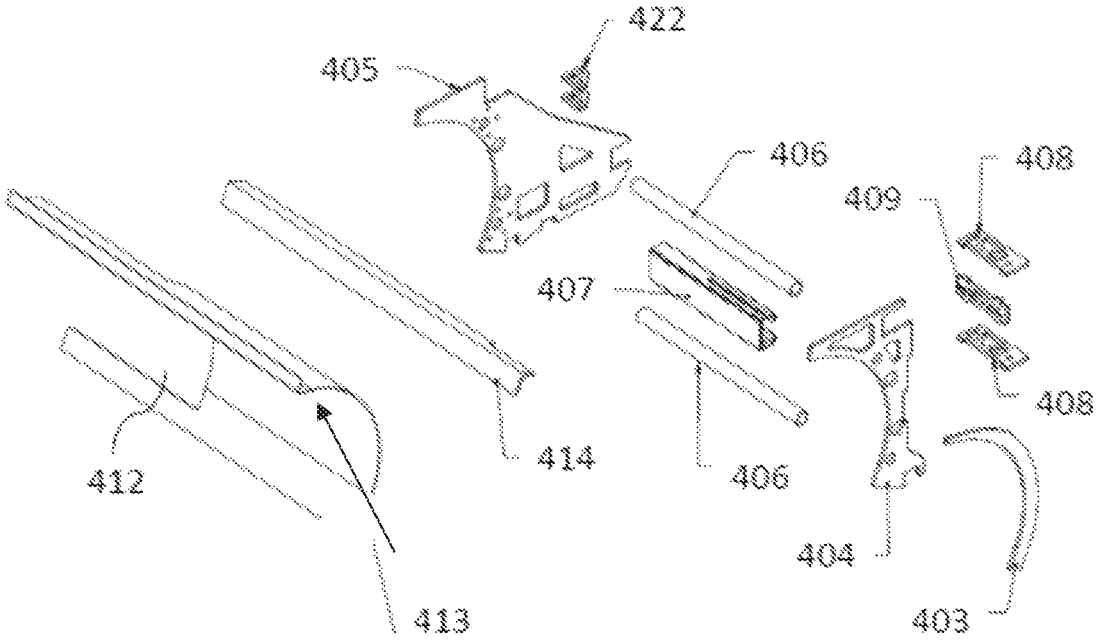
FIG. 11*b* is an exploded view illustrating the left side of the plow head blade assembly of FIG. 11*a;*
Figure 11C:
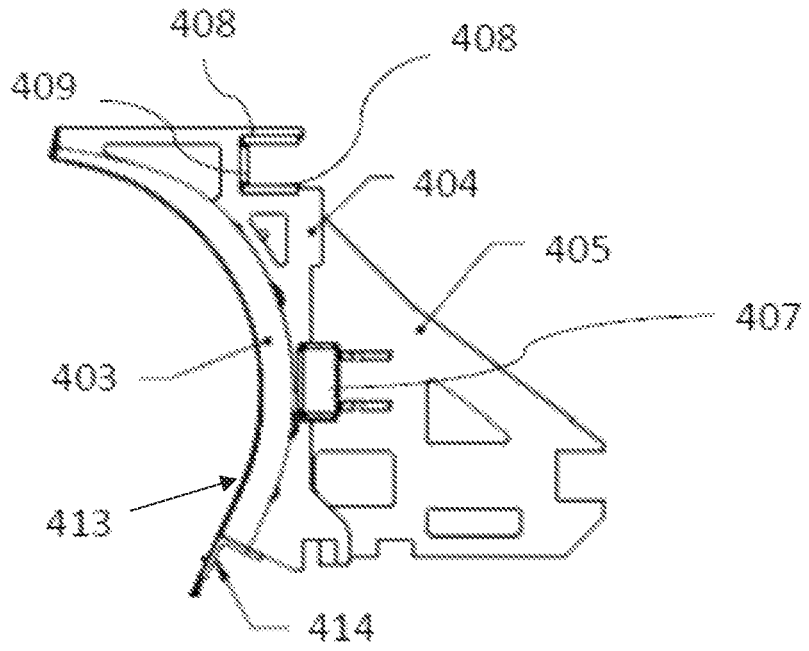
FIG. 11*c* is a side view illustrating a portion of a ribbed mold board.
Figure 11D:
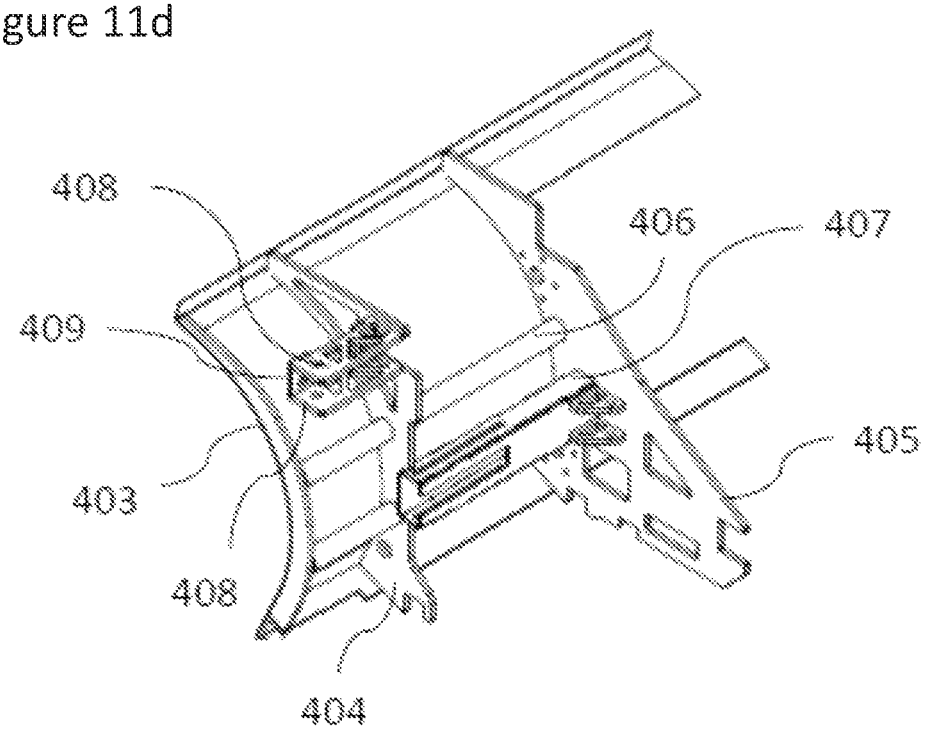
FIG. 11*d* is a rear-axonometric view illustrating the plow head assembly of FIG. 11*a;*

FIGS. 11*a*-11*d* illustrate the assembly of an embodiment of the plow head blade, showing the (left) wing construction of the plow head blade. It is noted that the right-wing construction corresponds to the left-wing construction, welded, or attached together to form the plow head blade assembly. FIG. 11*a* illustrates a front, axonometric view of the left and right wings of the plow head blade frame weldment, shown generally at 400. FIG. 11*b* illustrates a parts assembly exploded view of the wing assembly of FIG. 11*a*. FIG. 11*c* is a left-side view of FIG. 11*a*. FIG. 11*d* is a rear axonometric view illustrating the plow head assembly of FIG. 11*a*. Wing assembly (left shown) 400 mounts with the right-wing assembly to form the plow head blade, partially shown at 411. Plow head blade (partially shown/left-wing assembly shown) is constructed having a cavity 412 opening (partially shown) formed in a (left) moldboard 413 flush-mounted on a left frame angle 414. A plow frame blower box rib 405 is mounted in the back of the moldboard 413. Wing slide tube weldment 407 and frame stiffener pipes 406 are mounted on one side to plow frame blower box rib 405 with door cylinder mount plate 422, and on the opposing side to a plow frame center rib 404. A plow frame outer rib 403 is mounted to the moldboard 413. Wing or wings (not shown in this figure; see FIG. 7*a*) are mounted to plow frame center rib 404 by door cylinder mount top and bottom 408 and door cylinder mount back 409.

Figure 12A:
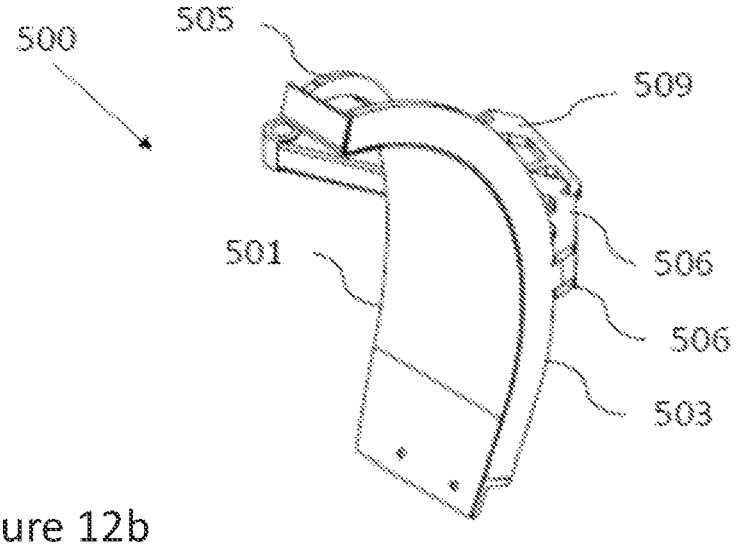
FIG. 12*a* is a front-isometric view of a wing assembly.
Figure 12B:
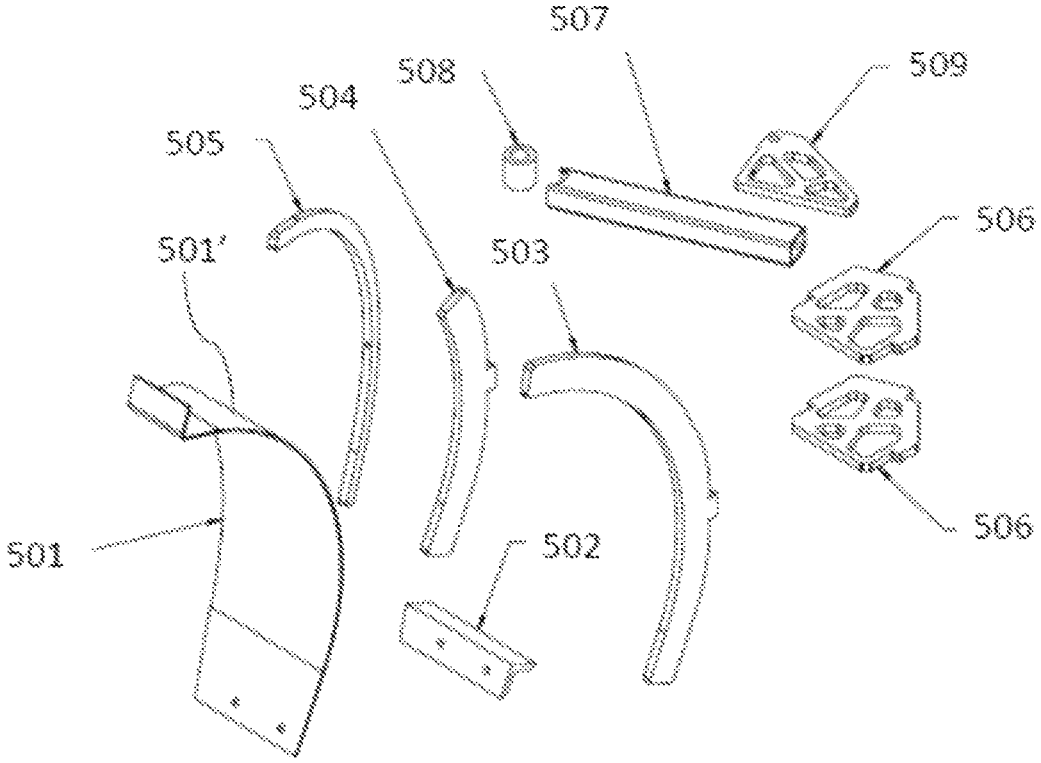
FIG. 12*b* illustrates an isometric assembly view of the wing.
Figure 12C:
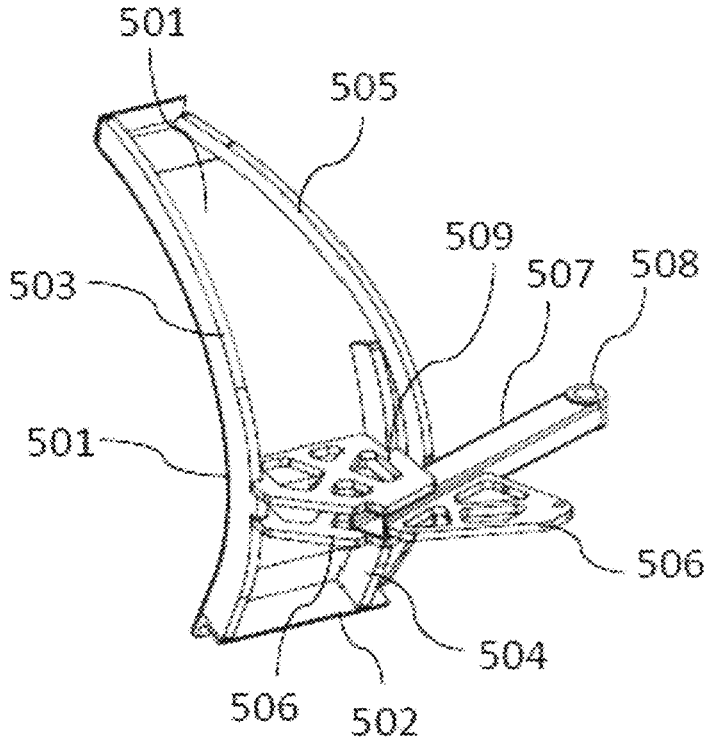
FIG. 12*c* is a rear-isometric view of the wing.
Figure 12D:
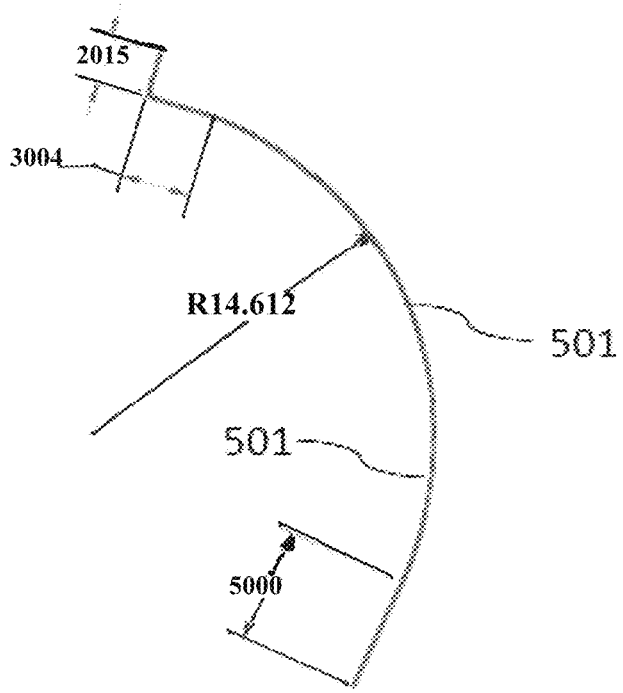
FIG. 12*d* illustrates a profile view of the wing, showing the wing radius of curvature.

FIGS. 12*a*-12*d* show views of a wing assembly (left and right). FIG. 12*a* is a front isometric exploded view of a left-wing assembly, shown generally at 500. FIG. 12*b* illustrates an isometric exploded view of the wing assembly. FIG. 12*c* illustrates a rear isometric view of the wing. FIG. 12*d* illustrates a profile view of the wing, showing a bend radius of the wing. FIGS. 12*a*-12*d* show left views of a wing assembly. FIG. 12*a* illustrates a front isometric view of wing assembly, shown generally at 500. FIG. 12*b* illustrates an isometric assembly view of the left-wing assembly. FIG. 12*c* illustrates a rear isometric view of the wing. FIG. 12*d* illustrates a profile view of the left side of the wing, showing a bend radius of the wing. The plow head blade (see FIG. 7*a*) includes opposing left and right wings. A preferred embodiment of the wing is shown herein at 500, representing the left-wing. It is noted that the corresponding oppositely located right scoop wing is the mirror-handed image of the left-wing. Wing 500 includes a scoop wing face/front 501 and back/rear 501' with a left base angle 502 mounted thereon. Back/rear 501' of scoop wing 500 has a wing outer gusset 503, wing center gusset 504 and wing inner gusset 505 mounted therein. Wing arm connector plates 506, wing arm connecting tube 507, wing arm connecting bushing 508 and wing cylinder mount plate 509 are assembled for mounting the scoop wing 500 to a plow head blade.

Figure 13A:
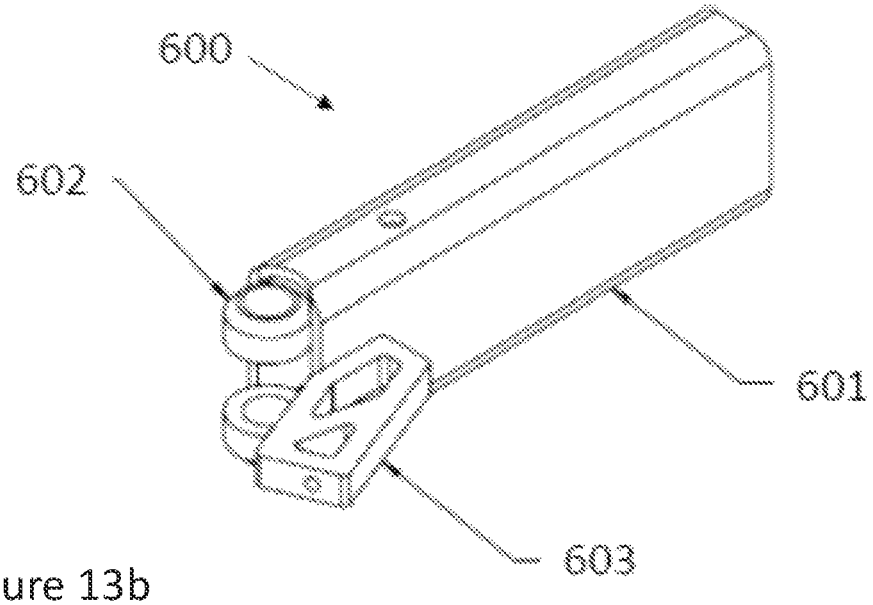
FIG. 13*a* illustrates a rear-isometric view of the left-wing, slide tube, pin and stop mount assembly.
Figure 13B:
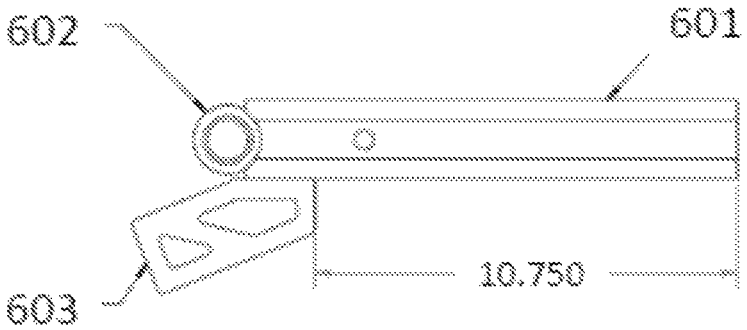
FIG. 13*b* illustrates a top view of the left-wing slide tube, pin, and stop mount assembly.
Figure 13C:
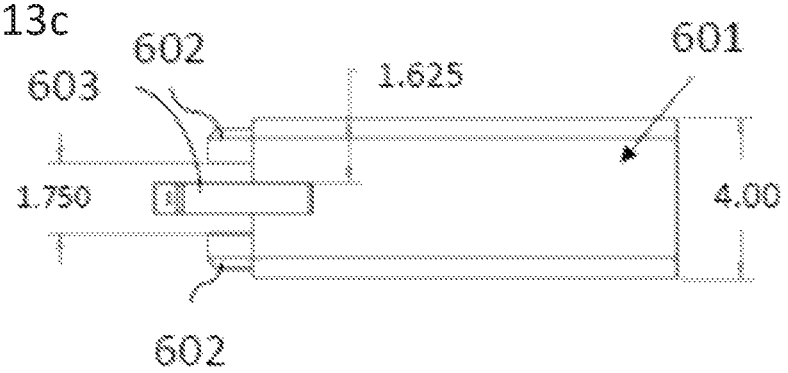
FIG. 13*c* illustrates a rear view of the wing slide tube, pin, and stop mount assembly.

FIG. 13*a* illustrates a top isometric view of the wing slide tube mount, shown generally at 600. FIG. 13*b* illustrates a top plan view of the wing slide tube mount. FIG. 13*c* illustrates a front view of the wing slide tube mount. Wing side tube mount 600 is constructed having a wing side tube 601, slide tube pin/tube 602 and slide tube wing stop 603. The wing side tube mount 600 is adapted to receive and house the wing arm connecting the tube (see 507 of FIGS. 12*a*-12*d*) of a wing for securing the wing to the plow head blade.

Figure 14A:
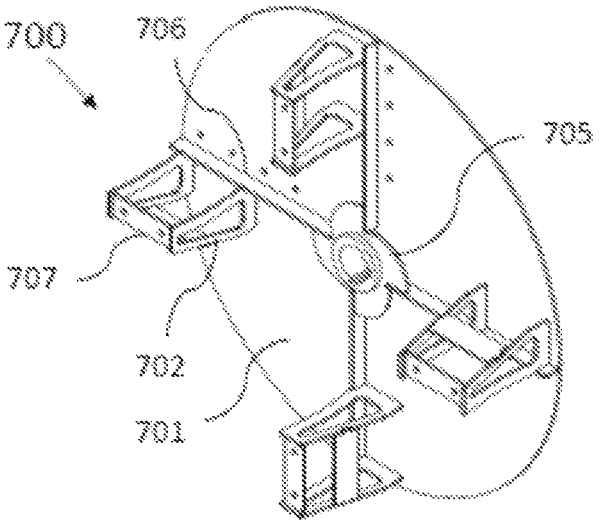
FIG. 14*a* is a top side isometric view illustrating the fan weldment.
Figure 14C:
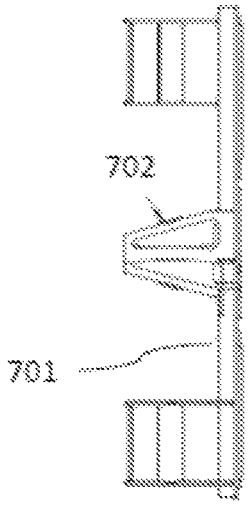
FIG. 14*c* is a side view of the fan or rotary impeller weldment.
Figure 14B:
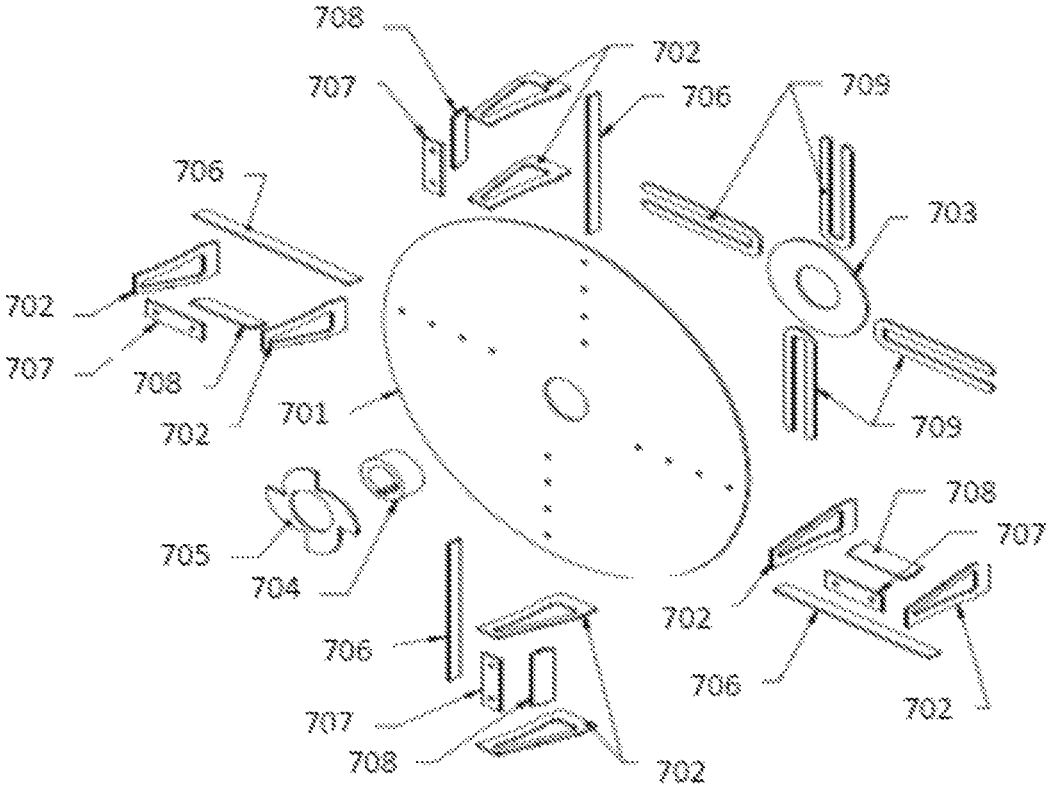
FIG. 14*b* is an exploded view illustrating the fan weldment.

FIGS. 14*a*-14*c* show views of an embodiment of a rotary fan weldment of the subject snow plow-blower. FIG. 14*a* illustrates a top isometric view of the fan weldment, shown generally at 700. FIG. 14*b* illustrates an exploded assembly view of the fan weldment. FIG. 14*c* illustrates a left side view of the fan weldment. Fan 700 is constructed generally having a fan back 701, fan blade gusset 702, fan back hub stiffener 703, fan hub 704, fan hub stiffener 705, fan back stiffener 706, blade top mount 707, blade rib stiffener 708 and fan back bolt holder 709.

Figure 15A:
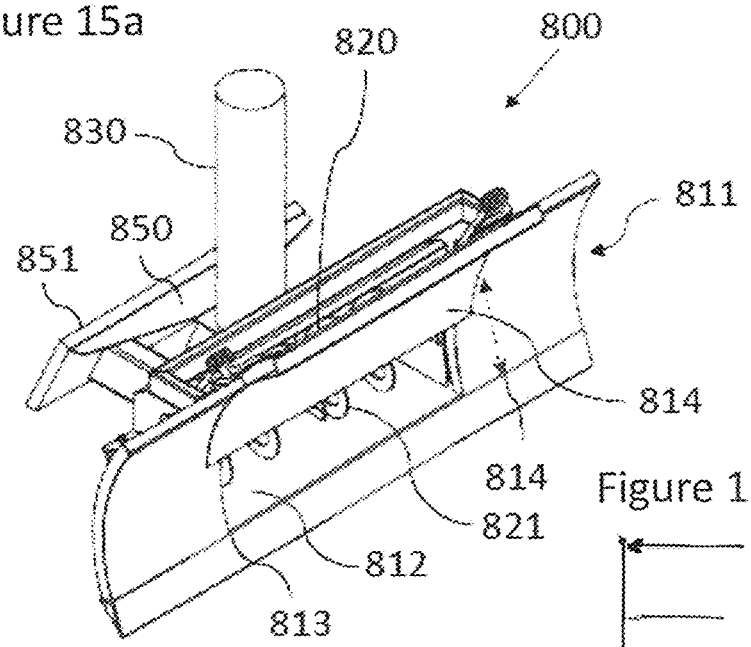
FIG. 15*a* is a front-axonometric view of an embodiment of the subject snow plow-blower showing a single blower door that opens and shuts on the vertical plane and a dual-stage blower.
Figure 15B:
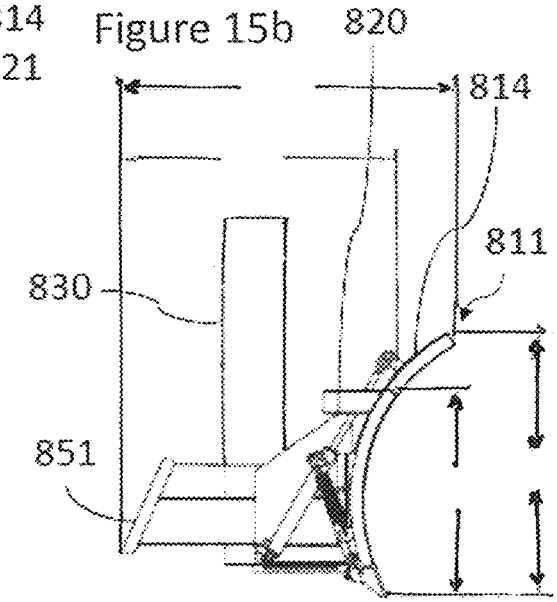
FIG. 15*b* illustrates a side view of the snow plow-blower of FIG. 15*a;*
Figure 15C:
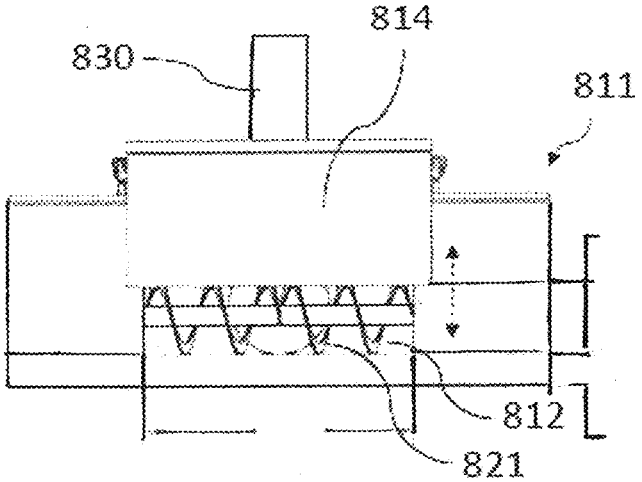
FIG. 15*c* illustrates a front view of the snow plow-blower of FIG. 15*a;*

FIGS. 15*a*-15*c* illustrate views of an embodiment of the subject snow plow-blower. FIG. 15*a* illustrates a front axonometric side view of an embodiment of the subject snow plow-blower, shown generally at 800. FIG. 15*b* illustrates a right-side view of the snow plow-blower of FIG. 15*a*. FIG. 15*c* illustrates a front view of the snow plow-blower of FIG. 15*a* with the blower door partially open. The snow plow-blower 800 includes a plow head blade 811 with a cavity 812 accessible by way of an aperture 813 through blower door 814 in a partially open configuration. FIG. 15*a* shows the blower door 814 in an open configuration, exposing/opening aperture 813 and cavity 812. Cavity 812 includes a snowblower unit 820 integrated and housed therein. Snowblower unit 820 is in communication with a power source and is adapted to move snow, ice and/water, and/or other materials through the snow plow-blower 800 and force it out of at least one discharge chute 830 and/or at least one opening. Snowblower unit 820 includes an impeller (shown in FIG. 8*a*)/auger 821. The subject snow blower unit 820 may be a single stage snow blower (or snow thrower) or a dual-stage snowblower. Where the snowblower is a single-stage blower unit the blower includes an impeller/fan blower. Where the snowblower is a dual-stage blower, the unit includes an impeller/fan and auger or alternatively, one impeller/fan or an impeller/ribbon cutter or an impeller/fan and other engineered device to proficiently process and manage the removal of snow, ice and other materials.

The blower door 814 is adapted to move into open and closed positions/configurations. In one embodiment, blower door 814 is adapted to move upward and downward on the vertical plane via tongue and grooves/tracks, with corresponding mating tongue and groove/tracks of the plow head blade 811 so that the blower door 814 can move along the parabolic vertical plane as indicated at arrow 814'. As such, the blower door 814, shown as a single longitudinal door, moves upward (opening and exposing cavity 812) and/downward (closing cavity 812, causing it to become unexposed) along the parabolic vertical plane.

Figure 16A:
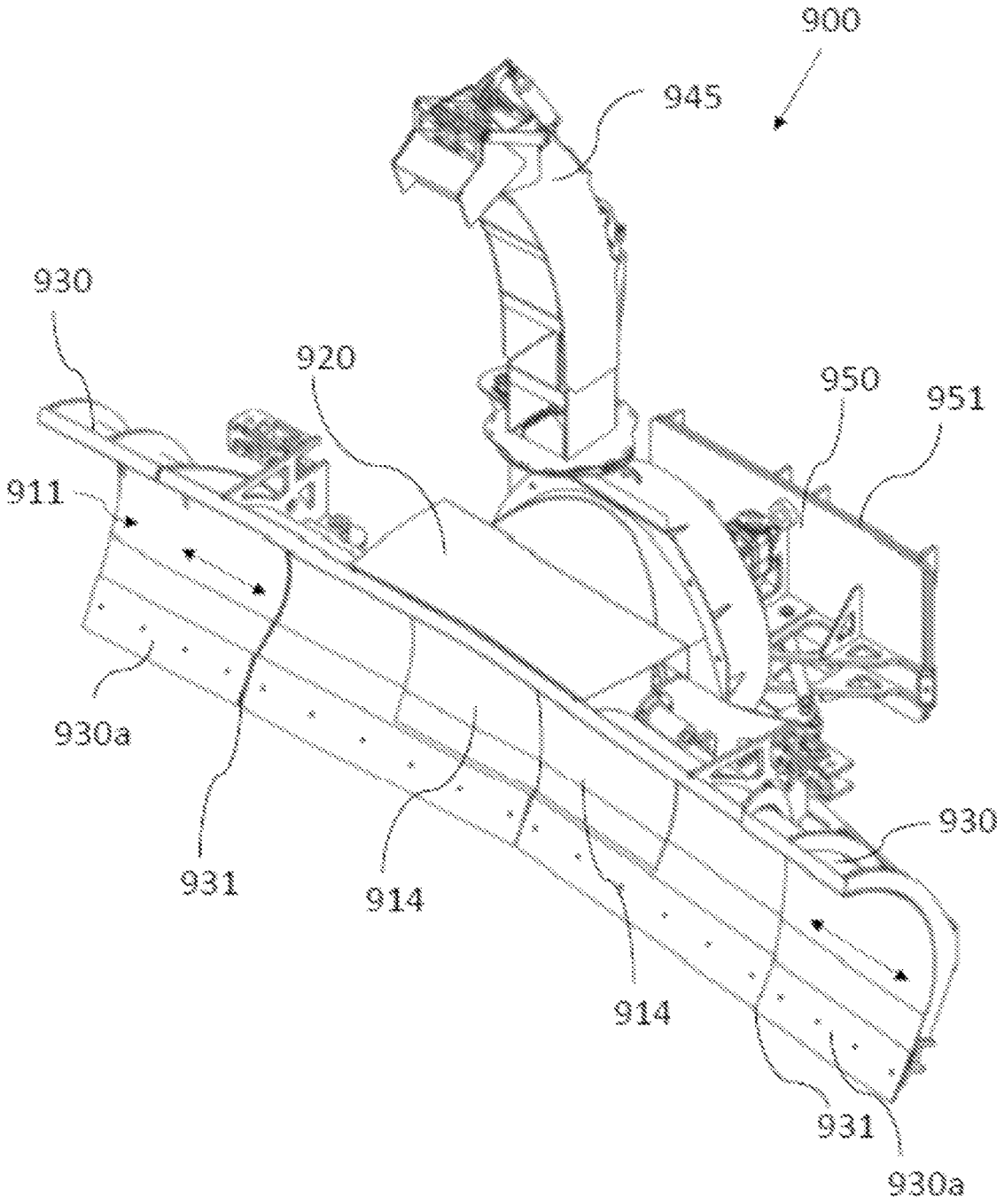
FIG. 16*a* illustrates a schematic view of another embodiment of the snow plow blower showing pivoting wings with the blower doors in a closed configuration closing the snow-blower cavity, and the wing or wings in a straight or non-pivotal position.
Figure 16B:
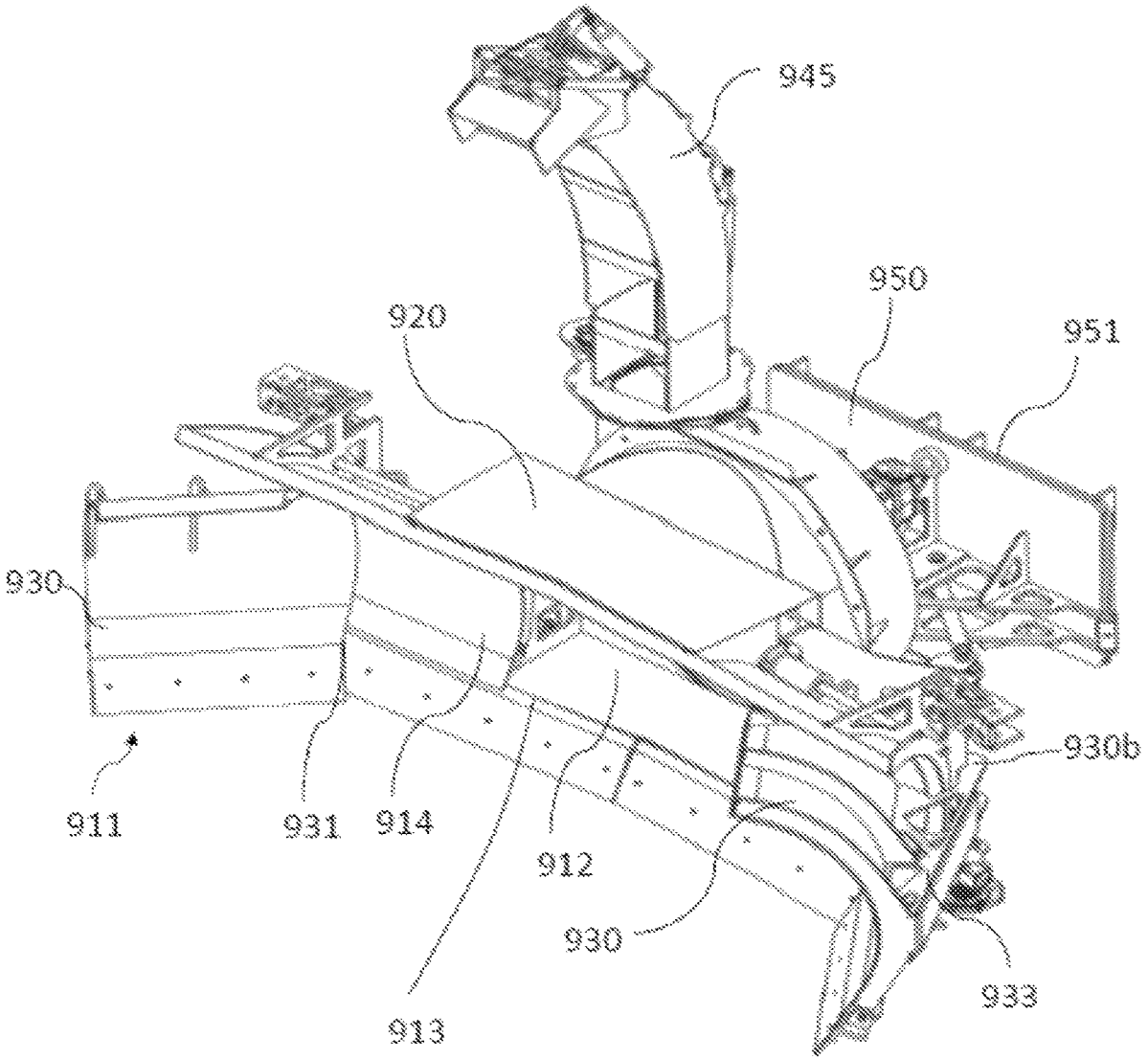
FIG. 16*b* illustrates a schematic view of the snow plow blower model with the blower doors in the open configuration exposing the snow-blower cavity, and the wing or wings in a bucket-like position.

Plow head blade 811 is preferably attached to a pivot hinge weldment 850 (i.e., weld unit formed by welding together an assembly of pieces), which in turn is attached to a wobble plate weldment 851 for mounting to a vehicle, such as a tractor, truck, skid steer, or to a moveable machine or other mechanical implement. Plow head blade 811 further includes at least one wing and preferably two wings (not shown attached), that are adapted to pivot forward or in reverse, varying angles from 0 degrees to 90 degrees relative to the longitudinal axis of the plow head blade 811, varying bucket-like configurations laterally along the side of the plow head blade 811 to move to a retracted or closed configuration stowed behind plow head blade 811 and/or an open configuration laterally along the side of the plow head blade 811 (see FIG. 7*a*, for example). Plow head blade 811 further includes at least one wing, preferably two wings (not shown attached), that are adapted to move in pivot forward or in reverse. The wings can have angles that vary from 0 degrees to 90 degrees relative to width measure (or longitudinal) axis of plow head blade 811. The wings are not stowed behind said plow head blade as shown in FIG. 7*a*;

rather, the wings have a bucket-like angular configuration laterally along the side of the plow head blade 811 as shown in FIG. 16*b*.

FIG. 16*a* illustrates the schematic view of another embodiment of the snowplow blower showing a moldboard having portions thereof acting as pivoting wings with the blower doors in a closed configuration closing the snowblower cavity, and the moldboard portions that act as wing or wings in the nonpivoted or straight plowing position, shown at 900. FIG. 16*b* illustrates the front axonometric view of the snow plow-blower model with the blower doors in the open configuration exposing the snowblower cavity, and the moldboard portions that operate as wings in a pivoted, bucket-like position. The snow plow-blower 900 generally includes a plow head blade 911 with a cavity 912 integrated therein, preferably centrally, having an aperture 913 with blower doors 914. Snowblower unit 920 is in communication with a power source and is adapted to move snow, ice and/water, and/or other materials through the snow plow-blower 900 and force it out of at least one discharge chute 930 and/or at least one opening. The blower doors 914 are adapted to move into open and closed positions/configurations. Herein two blower doors 914 are shown. However, the doors may be constructed of more than two blower doors 914 and may be formed as sliding or movable panels. Alternatively, the blower doors 914 may be formed as a single door that covers aperture 913 and cavity 912. In yet another alternative, the plow head blade does not include the integrated aperture, and acts as the blower door since it can be moved upward/downward to expose the aperture and cavity for ingress into the blower unit.

Blower doors 914 are adapted to move from the open configuration to the closed configuration, thereby completely closing and preferably sealing aperture 913 of cavity 912 and preventing all snow, ice, water or/and other material ingress into the snow blower 920 when the snowblower 920 is not being utilized. Similarly, blower doors 914 are adapted to move from a partially open to a partially closed configuration to limit the quantity of snow, ice, water, and other material ingress into the snowblower 920, thereby enabling the proficient management and removal of snow, ice, and other material. Plow head blade 911 is preferably attached to a pivot hinge weldment 950 (i.e., weld unit formed by welding together an assembly of pieces) so that the whole plow head blade 911 and blower unit/box and chute can be lifted or angled during plowing. In turn, weldment 950 is attached to a wobble plate weldment 951 for mounting to a tractor, truck, skid steer, or other mechanical implement.

Plow head blade 911 further includes at least one wing and preferably two wings 930, each typically located on opposing side walls 931 of the plow head blade 911. Portions of the moldboard that act as wings 930 are pivotal, retractable, or movable in relation to the plow head blade 911. Moving portions of the moldboard to a pivoted, bucket-like position decreases the lateral length of the moldboard, making the plow head blade shorter in width.

Wings 930, shown at the straight plowing position 930*a*, can be pivoted along a horizontal axis 933 via hinge 930*b* so that the wings 930 move to a pivoted or angled scoop position. In the angled scoop position (i.e., position 930*b* of FIG. 10*b*) the wings 930 can channel, angle, or otherwise direct the snow, ice and/or debris toward the center of the plow head blade 911 and into cavity 912 when the blower doors 914 are open. It is noted that the wings 930 are preferably arched or curved and located on opposite sides of the plow head blade 911 may be in different positions and/or geometrically different shaped embodiments. For example, one wing blade may be in the pivoted position shown at 930*b*; while the other wing blade may be in the lateral position shown at 930*a*. Further, one wing may be arched or curved, and the other wing may be straight.

Figure 17:
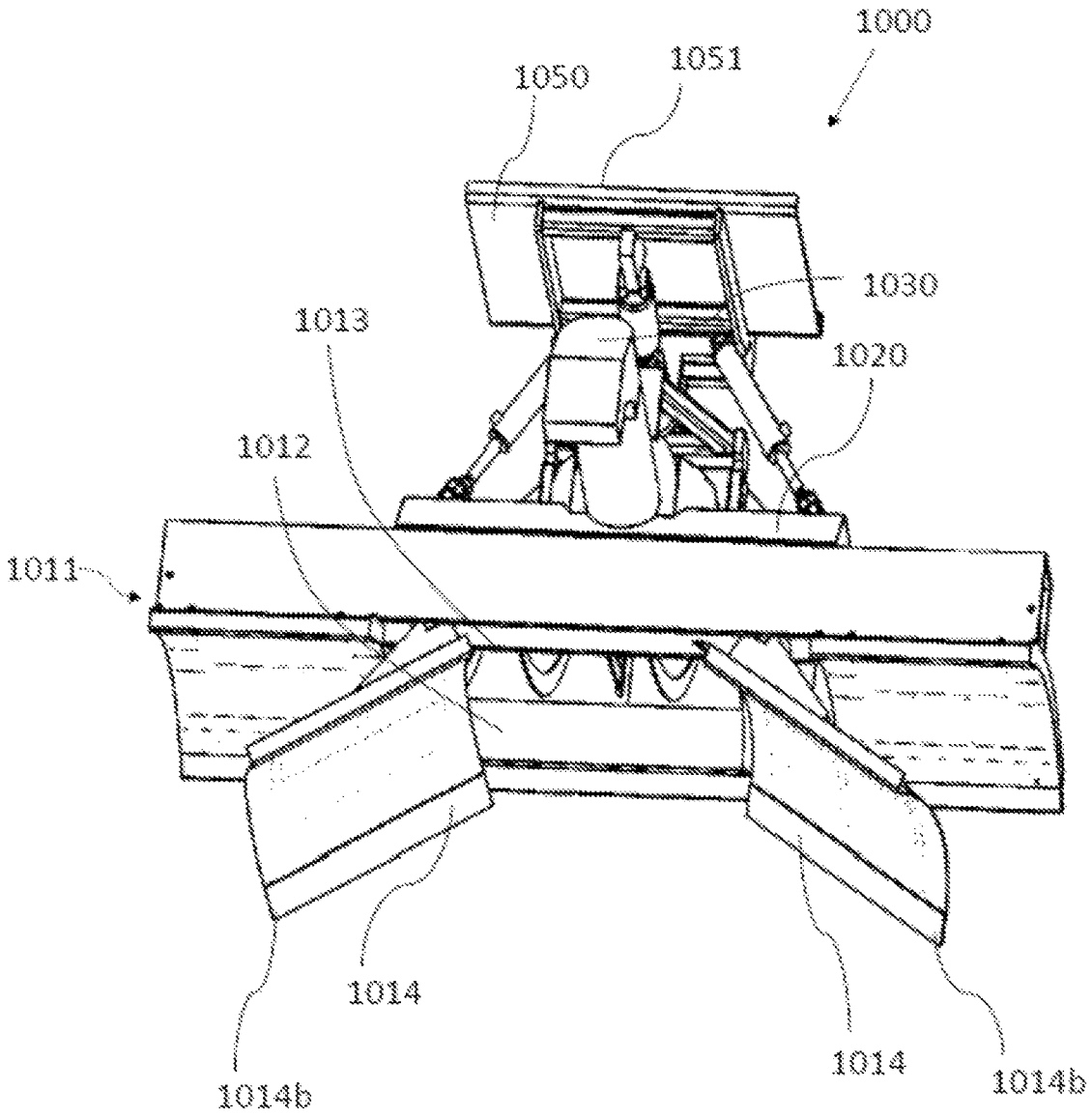
FIG. 17 illustrates a schematic view of another embodiment of the snow plow blower showing the blower doors open and pivoted to channel snow into the aperture and cavity with blower unit housed therein.

FIG. 17 illustrates a schematic view of another embodiment of the snow plow-blower apparatus 1000 showing the blower doors open and pivoted to channel snow into the aperture and cavity with blower unit housed therein, shown generally at 1000. The snow plow-blower apparatus 1000 generally includes a plow head blade 1011 with a cavity 1012 integrated therein, preferably centrally, having an aperture 1013 with blower doors 1014. Snowblower unit 1020 is in communication with a power source and is adapted to move snow, ice and/water, and/or other materials through the snow plow-blower 1000 and force it out of at least one discharge chute 1030 and/or at least one opening. The chute may be rotatable within a range from 1 to 360 degrees, said chute being a standard chute, a telescoping chute, or a folding chute or combinations thereof where the device may blow/throw snow ice and other materials in any direction required. Preferably, snow plow-blower includes at least one of hydraulic, electrically, or pneumatically powered telescoping and/or folding chute, electronically controlled using a wired or wireless controller.

The blower doors 1014 are adapted to move into open and closed positions/configurations. Herein two blower doors 1014 are shown. The blower doors 1014 are moveable along a hinge track or tongue and groove-like channel to move into a pivoted position shown at 1014*b* and pivoted back against the plow head blade 1011 for a closed position. It is noted that varying degrees of pivot are contemplated to address the angle of blower doors 1014 for channeling or directing snow through aperture 1013 and into cavity 1012, thereby enabling the operation to proficiently manage the time required for removal of snow, ice, and other materials. Plow head blade 1011 is preferably attached to a pivot hinge weldment 1050 attached to a wobble plate weldment 1051 for mounting to a tractor, truck, skid steer, vehicle, movable machine, or other mechanical implement. Plow head blade 1011 may further include one or more wings.

Figure 18:
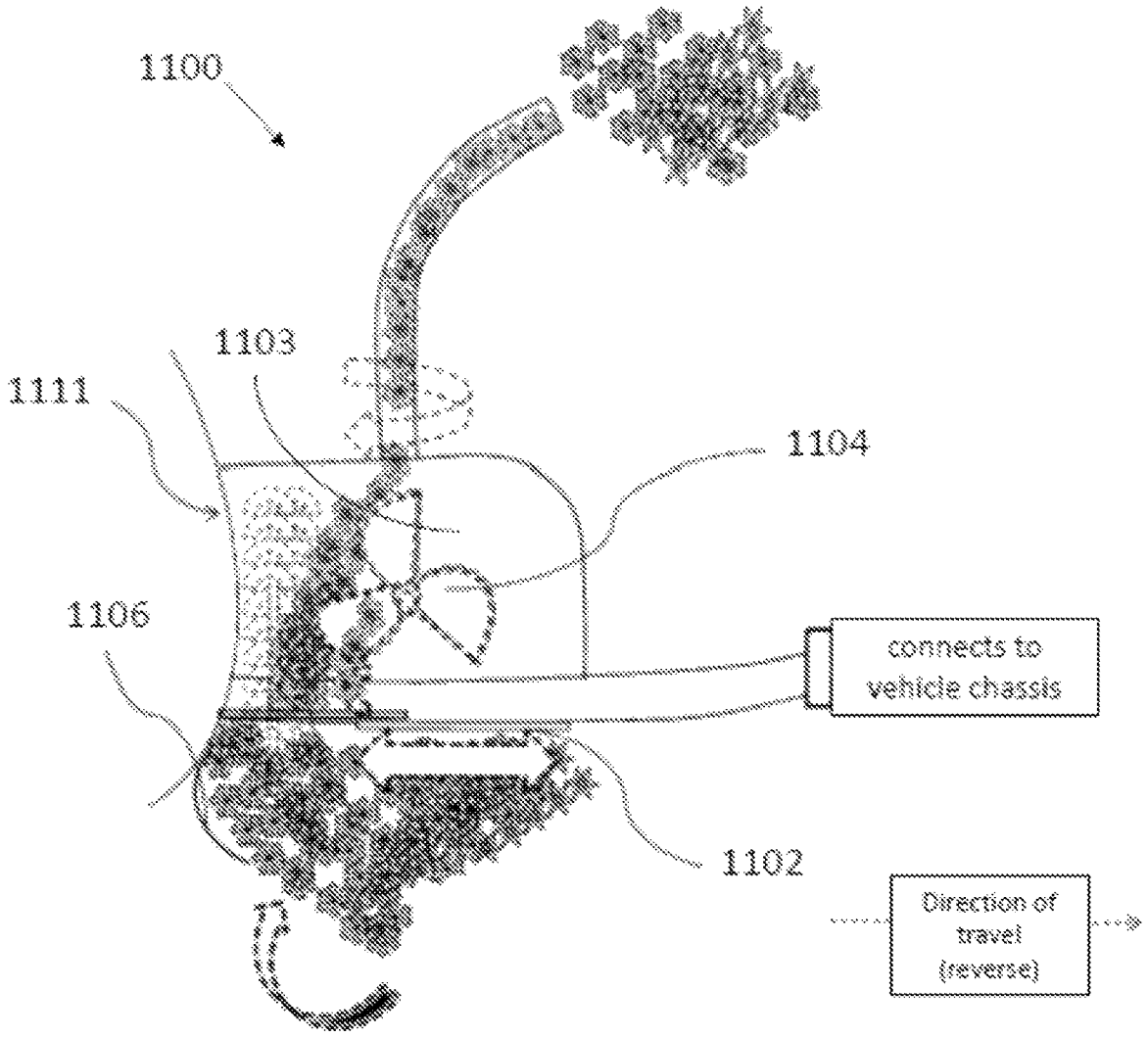
FIG. 18 illustrates an embodiment of the subject invention having a horizontally mounted door that slides open to expose the blower unit/box chamber above the back blade while the back blade directs snow simultaneously during operation of the blower and plowing in a direction opposite to the travel direction (i.e., reverse).

FIG. 18 illustrates an embodiment of the subject invention having a horizontally mounted door that slides open to expose the blower unit/box chamber above the back blade while the back blade directs snow simultaneously while operating the blower and plowing in the opposite direction of travel (i.e., in reverse), shown generally at 1100. In this embodiment a back blade 1106 is located behind plow head blade 1111. A horizontally mounted door 1102 is provided that slides open to expose a blower box chamber/cavity 1103 having a snow blower unit 1104 housed therein. The structure of the plow head blade 1111 and cavity 1103 are described hereinabove. The back blade 1106 is adapted to direct at least a vehicle length or moveable machine length worth of snow, ice or other material simultaneously while operating the blower and plowing in the opposite direction of travel (i.e., reverse), contemplated for use in situations, such as against a garage door or any other situation wherein a user may need to back blade snow, ice/other material; thereby enabling the user to proficiently manage the time required for removal of snow, ice/other material.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A material moving machine incorporating an auxiliary material moving assembly, wherein:

a. said auxiliary material moving assembly comprises at least one attachment arm and/or at least one material moving element;

b. a snow plow-blower comprises: a plow head blade with a moldboard; at least one blower door; a snow blower unit having a cavity containing snow moving means for moving snow, ice and other materials out through at least one discharge chute and/or at least one opening; said at least one blower door being adapted to move to an open configuration to expose said cavity, and from said open configuration to a closed configuration to thereby prevent snow, ice and other material ingress into said snow blower unit c. said auxiliary material moving assembly comprises at least part of said snow moving means and is configured for rotational movement in conjunction, independently and/or concomitantly with said material moving machine for proficient handling, removal, and management of material;

d. said auxiliary material moving assembly is mounted on said moldboard or placed along its sides, in back of, beneath, or at a location proximal to said moldboard, or proximal to said cavity, or proximal to said blower, and/or proximal to said moving machine, and wherein said auxiliary material moving element is a. located above and outside of said cavity;

b. configured to move from a position located above and outside of said cavity to a position located inside of said cavity;

c. built on both sides of said at least one blower door, inside the cavity or outside the cavity;

d. configured to move upward and downward over said cavity to open and close said cavity; and e. said auxiliary material moving element is configured to operate at least partially outside and/or inside of said cavity to assist in the proficient handling, removal and successful management of snow, ice and/or other materials.

2. The material moving machine of claim 1, wherein said auxiliary material moving element is one or more auger, screw-like auger, ribbon-cutter, snow cutter, snow beater, wheel-cutter, rotary fan, impeller, broom, rotary (sweeping) broom, rotating paddle, and/or any combination mechanical device thereof that permits handling, removal and management of snow, ice and/or other materials.

3. The material moving machine of claim 1, wherein said moldboard configurations comprise one or more of a straight blades, an angled blade, a scooped blade, a windrow blade, a conical blade, a rotatable blade, a pivotable blade, a wedge blade, a V-shaped blade and/or combinations thereof.

4. The material moving machine of claim 1, wherein said auxiliary material moving element is associated with an activating device and a controller, and thereby configured to move in a direction comprising one or more of horizontally left and right or vertically or diagonal and/or curved directions over said cavity to open and close said cavity.

5. The material moving machine of claim 1, comprising a power source selected from the group consisting of hydraulic power, pneumatic (air/fluid) power, internal combustion engine power, mechanical energy direct linkage power including a PTO, chemical energy power, electrical energy power, energy engineered from power sources and electromagnetic energy power or energy engineered from known power sources.

6. The material moving machine of claim 1, comprising a specific or universal wired or wireless communication controller device and switching device for operating/controlling substantially all operative functions of the auxiliary material moving assembly and snow plow-blower apparatus, so that said snow blowing or snow throwing function and said snow plowing functions can be carried out concomitantly or independently of each other wirelessly by the use of said specific/universal wired/wireless communication/controller device, and/or a smart device type application for raising or lowering the snow plow-blower apparatus or by articulating the plow head blade attack angle, varying the pitch, yaw and roll of the plow head blade, opening and closing the doors, varying the speed of the blower, controlling the heat devices, controlling a mechanical scraper guide and/or turning headlights, LED guide lights/light bar lights on and off and turning LED machine lights on and off.

7. The material moving machine of claim 1, comprising at least one caster wheel and/or skid assembly, wherein said caster wheel and/or skid assembly a. can be operated manually;

b. can be operated via gravity assist;

c. can be powered from a source of energy;

d. can be powered and controlled; and e. each of operations "a" through "d" can be carried out in conjunction, independently and/or concomitantly to a material moving machine, or a snow-plow blower apparatus.

8. In a material moving machine having mounted thereon an auxiliary material moving assembly with at least one attachment arm and at least one material moving element as recited by claim 1, the improvement wherein:

a. said material moving machine comprises a single stage, dual stage, or multi stage snow plow-blower having a cavity with at least one cavity door therein for receiving and discharging material; and b. said material moving element is configured for rotational movement and to operate on either side of said at least one cavity door for proficient handling, removal, and management of material.

9. In a material moving machine having mounted thereon an auxiliary material moving assembly with at least one attachment arm and at least one material moving element as recited by claim 8, the improvement wherein:

a. a material moving unit comprises at least one of a bucket, a plow, or a material blower having a deflector and/or scraper blade;

b. said material moving element is configured to operate inside, or outside, or partially inside and outside or around an exterior surface of said material moving unit; and c. said auxiliary material moving assembly is configured for rotational movement in conjunction, independently and/or concomitantly with said material moving machine for proficient handling, removal, and management of material.

10. The material moving machine of claim 9 wherein, said material moving element comprises at least one auger, screw-like auger, ribbon-cutter, snow cutter, snow beater, wheel-cutter, rotary fan, impeller, rotary (sweeping) broom, rotating paddle, and combinations thereof that permits handling, removal and management of snow, ice and/or other materials.

11. The material moving machine of claim 9, wherein, said material moving element comprises at least one a. timing device for intermittent operation;

b. controller device having wired or wireless operation; and c. said material moving element is powered by at least one or more of hydraulic power, electrical power, and other source of power.

12. The material moving machine of claim 9, wherein said attachment arm has at least one attachment point configured for mountable adjustment on said material moving machine;

a. said attachment arm is foldable or rotatable to provide different positions of said auxiliary material moving element proximal to said material moving machine;

b. said material moving element encompasses movement along a horizontal, vertical, and/or depth plane for different positions when mounted on said material moving machine;

c. said material moving element can rotate or spin in one or more rotational/spinning directions, clockwise and/or counter-clockwise;

d. said material moving element is configured to telescope, extend, bend, fold, retract, slide, and/or rotate about at least one axis, as required for its intended purpose, in any number of degrees of freedom and/or directions, thereby having the ability to extend, collect/grab, scrape and/or back-drag materials.

13. An auxiliary material moving assembly configured to be mounted on a material moving machine as recited by claim 1, said auxiliary material moving assembly comprising at least one attachment arm and at least one material moving element configured for rotational movement in conjunction, independently and/or concomitantly with said machine for proficient handling, removal, and management of material.

14. The auxiliary material moving assembly as recited in claim 13, wherein said auxiliary material moving element comprises one or more auger, screw-like auger, ribbon-cutter, snow cutter, snow beater, wheel-cutter, rotary fan, impeller, rotary (sweeping) broom, rotating paddle, or other mechanical device that permits handling, removal and management of snow, ice and/or other materials.

15. The auxiliary material moving assembly of claim 13, wherein said material moving machine comprises at least one foldable or rotatable auxiliary moldboard being one or more of straight, curved, box, V-shaped and wedge-shaped, and said auxiliary material moving element is configured to be located proximal to said moldboard.

16. The auxiliary material moving assembly of claim 13, having at least one controller device comprising an electrical, electronic operating Central Processing Unit (CPU), Electrical Panel, Switches, Specific Electronic panel circuitry system for operator end-user control of said auxiliary material moving assembly and/or said material moving machine upon which said controller device is adapted to be mounted.

17. The auxiliary material moving assembly of claim 13, wherein said at least one attachment arm is foldable or rotatable to provide multiple positions and angles of said auxiliary material moving element proximal to said material moving machine ranging from about 1 degree to about 360 degrees, wherein said foldable or rotatable operation is carried out manually, automatically via gravitational assist, and/or by use of a controller device.

18. The auxiliary material moving assembly of claim 17, wherein said at least one attachment arm comprises a fold-down arm, fold-down hinge, and/or one or more motor or hydraulic assembly for operational folding or rotating movement.

19. The auxiliary material moving assembly of claim 17, wherein said at least one attachment arm comprises one or more motor or hydraulic assembly for operational folding or rotating movement.

20. An auxiliary material moving assembly configured to be mounted on a material moving machine as recited by claim 1, said auxiliary material moving assembly comprising at least one attachment arm and at least one material moving element configured to operate in conjunction, independently and/or concomitantly with said machine for proficient handling, removal, and management of material, further comprising:

a. a timing device for intermittent operation;

b. a controller device having wired or wireless operation;

c. a material moving element powered by at least one or more of hydraulic power, electrical power, and other source of power.

21. The auxiliary material moving assembly of claim 20, wherein:

a. said at least one attachment arm has at least one attachment point configured for mountable adjustment on said material moving machine;

b. said attachment arm is foldable or rotatable to provide different positions of said auxiliary material moving element proximal to said material moving machine;

c. said material moving element encompasses movement along a horizontal, vertical, and/or depth plane for different positions when mounted on said material moving machine;

d. said material moving element can rotate or spin in one or more rotational/spinning directions, clockwise and/or counter-clockwise;

e. said material moving element is configured to telescope, extend, bend, fold, retract, slide, and/or rotate about at least one axis, as required for its intended purpose, in any number of degrees of freedom and/or directions, thereby having the ability to extend, collect/grab, scrape and/or back-drag snow, ice, and/or other materials with an optional protective cover (cap), and/or back-blade.

22. The auxiliary material moving assembly of claim 20, wherein said at least one material moving element is interchangeable, and is at least one auger, ribbon, screw-like auger, ribbon-cutter, snow cutter, snow beater, wheel-cutter, rotary fan, impeller, broom, sweeper, sweeper-broom, rotary (sweeping) broom, blower, edge, scraper, edge-scraper, dragger/puller, pusher, paddle, rotating paddle, drum cutter, ice-breaker, and/or a combination thereof.

23. The auxiliary material moving assembly of claim 13, wherein said material moving machine is a snow plow-blower comprising: a plow head blade with a moldboard; at least one blower door; a snowblower unit having a cavity containing material moving means for moving snow, ice and other materials out through at least one discharge chute and/or at least one opening; said at least one blower door being adapted to move to an open configuration to expose said cavity, and from said open configuration to a closed configuration to thereby prevent snow, ice and other material ingress into said snow blower unit.

* * * * *